US006288313B1

(12) United States Patent
Sato et al.

(10) Patent No.: US 6,288,313 B1
(45) Date of Patent: Sep. 11, 2001

(54) KEYBOARD MUSICAL INSTRUMENT HAVING SPLIT REAR TOP BOARD AND/OR VISUAL DISPLAY UNIT

(75) Inventors: Shigeaki Sato; Atsushi Matsumura, both of Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/491,913

(22) Filed: Jan. 27, 2000

(30) Foreign Application Priority Data

| | | |
|---|---|---|
| Sep. 10, 1999 | (JP) | 11-258091 |
| Oct. 8, 1999 | (JP) | 11-288711 |
| Oct. 8, 1999 | (JP) | 11-288712 |

(51) Int. Cl.[7] ..... G10C 3/02
(52) U.S. Cl. ..... 84/177; 84/189; 84/470 R
(58) Field of Search ..... 84/177–181, 189, 84/470 R, 477 R, 478, 479 R, 483.1

(56) References Cited

U.S. PATENT DOCUMENTS

| | | | | |
|---|---|---|---|---|
| 390,169 | * | 9/1888 | Hudson . | |
| 1,294,866 | * | 2/1919 | Borja . | |
| 1,682,767 | * | 9/1928 | Opelt . | |
| 2,134,680 | * | 1/1938 | Beck . | |
| 2,138,669 | * | 11/1938 | Tower . | |
| 5,301,588 | * | 4/1994 | Revenaugh et al. | 84/182 X |
| 5,864,078 | | 1/1999 | Van Koevering . | |
| 5,908,997 | | 6/1999 | Arnold et al. . | |
| 6,084,167 | * | 7/2000 | Akimoto et al. | 84/477 R |

* cited by examiner

*Primary Examiner*—Jeffrey Donels
(74) *Attorney, Agent, or Firm*—Morrison & Foerster

(57) ABSTRACT

A grand piano has a split top board, i.e., plural sub-boards selectively opened by a pianist for emphasizing higher registered sounds or lower registered sounds and a visual display, which teaches the pianist how to tune the grand piano in the desired mode for selectively emphasizing the higher/lower registered sounds.

29 Claims, 45 Drawing Sheets

KEYBOARD MUSICAL INSTRUMENT HAVING SPLIT REAR TOP BOARD AND/OR VISUAL DISPLAY UNIT

FIELD OF THE INVENTION

This invention relates to an acoustic keyboard musical instrument and, more particularly, to an acoustic piano having a rear top board and/or a visual display unit.

DESCRIPTION OF THE RELATED ART

A typical example of the acoustic grand piano is shown in FIG. 1. Though not shown in FIG. 1, hammer action mechanisms, hammers, sets of strings and damper mechanisms are accommodated in a housing 1. A side board 2, a key bed 3, an upper beam 5 and a wooden frame (not shown) form in combination the housing 1, and a sound board 6 horizontally extends over the wooden frame. The housing 1 has an upper opening over the sound board 6. Legs 7 downwardly project from leg blocks 8, which are attached to the housing 1. Thus, the legs 7 support the housing 1 and the other component parts accommodated therein. A keyboard 9 is mounted on the key bed 3, and is exposed to a space between the upper beam 5 and a player. The sets of strings are stretched over the sound board 6, and the hammer action mechanisms are linked with the keyboard 9 so as to drive the hammers for rotation under the sets of strings.

When a pianist depresses one of the keys of the keyboard 9, the associated hammer action mechanism is actuated, and the associated hammer is driven for rotation. The hammer strikes the set of strings, and the set of strings vibrate for generating a piano sound. The sound board 6 resonates with the vibrations, and the piano sound is radiated through the upper opening.

A rear top board 10 is hinged along one side to the side board 2, and swings on the hinges. A front top board 11 is hinged along the rear end to the front end of the rear top board 10, and swings on the hinges. When the pianist lifts the front end of the front top board 11, the front top board 11 turns around the hinge, and the pianist turns out the front top board 11 onto the upper surface of the rear top board 10 as shown. Then, the front portions of the strings are seen through the front portion of the upper opening. If the pianist lifts the other side of the rear top board 10, the rear top board 10 turns around the hinges, and the sets of strings are completely seen through the upper opening.

A lid prop assembly 12 is hinged to the other side of the side board 2. The rear top board 10 is brought into contact with the leading end of the lid prop assembly 12, and the lid prop assembly 12 keeps the rear top board 12 inclined. When a pianist wants to play a tune on the keyboard 9, he opens the upper opening so as to radiate the piano sounds from the sound board 6 through the upper opening to the outside.

When the pianist leaves from the grand piano, he lowers the rear top board 10 onto the side board 2 to close the rear portion of the upper opening, and turns the front top board 11 to close the front portion of the upper opening. The upper opening is perfectly covered with the front top board 11 and the rear top board 10. The front top board 11 and the rear top board 10 prevents the hammer action mechanisms, the hammers, the damper mechanisms and the sets of strings from dust and unexpected damage. If the pianist plays a tune on the keyboard 9 without lifting the front/rear top boards 11/10, the front top board 11 and the rear top board 10 impede the radiation of piano sounds, and reduce the loudness of the piano sounds.

A music rack assembly 13 is provided over the front portion of the upper opening, and has a desk board 13*a*.

Though not shown in FIG. 1, a ridge is fixed to a lower end of the desk board 13*a*. When the desk board 13*a* stands up, a player places a music score on the desk board 13*a*, and the ridge prevents the music score from sliding down. The desk board 13*a* falls, and allows the front top board 11 to lie thereon.

Pianists want to give expression to their feelings through the sounds. A pianist may emphasize a lower register, and another pianist may want to emphasize higher register. Accordingly, the pianist strongly depresses the keys assigned to the lower register or the higher register so as to give the expression to their feelings. The prior art acoustic piano faithfully responds to the fingers on the keyboard 9, and does not offer any support to the pianist.

The music rack assembly 13 only keeps a music score or another document lying thereon. Notes and letters are written in the music score and the documents, and the messages are unchanged. If a player wants a certain piece of information, he searches the music score and/or the document for the piece of information. A beginner may want to check a manual for the grand piano for his practice. However, it is impossible to place both music score and the manual on the music rack assembly.

SUMMARY OF THE INVENTION

It is therefore an important object of the present invention to provide a grand piano, which permits a player to selectively emphasize registers.

It is also an important object of the present invention to provide a musical instrument, which a player easily establishes in a desired mode of operation.

To accomplish the first object, the present invention proposes to make a top board serve as an equalizer.

To accomplish the second object, the present invention proposes to prompt a player to establish the musical instrument in the desired operation mode through a visual display unit physically independent of a music rack assembly.

In accordance with one aspect of the present invention, there is provided an acoustic keyboard musical instrument comprising a housing having an upper opening, plural music strings stretched inside of the housing and assigned notes of a scale, respectively, a keyboard exposed to a player and having plural keys assigned the notes of the scale, respectively, plural vibration generating mechanisms respectively linked with the keys and selectively actuated by the associated keys manipulated by the player for producing acoustic sounds through vibrations of the associated music strings and a split top board having plural sub-boards respectively assigned parts of the upper opening and independently changed between open positions where associated parts of the plural music strings are open to the ambience and closed positions where the associated parts are covered therewith.

In accordance with another aspect of the present invention, there is provided a keyboard musical instrument comprising a housing defining an inner space, a key board supported by the housing and including plural keys respectively assigned notes of a scale and selectively depressed by a player, a sound generating system accommodated in the housing and generating sounds having the notes identical with the notes assigned to the depressed keys, a desk board supported by the housing, and keeping a document standing there against for providing a piece of information to the player, and an image producing system including a video display independent of the desk board and the housing, supported by the housing and responsive to an image-carrying signal for producing visual images on a screen thereof and a controller responsive to instructions of the player for generating the image-carrying signal.

In accordance with yet another aspect of the present invention, there is provided an acoustic keyboard musical instrument comprising a housing having an upper opening, plural music strings stretched inside of the housing and assigned notes of a scale, respectively, a keyboard exposed to a player and having plural keys assigned the notes of the scale, respectively, plural vibration generating mechanisms respectively linked with the keys and selectively actuated by the associated keys manipulated by the player for producing acoustic sounds through vibrations of the associated music strings, a split top board having plural sub-boards respectively assigned parts of the upper opening and independently changed between open positions where associated parts of the plural music strings are open to the ambience and closed positions where the associated parts are covered with the associated sub-boards, and an information providing means supported by the housing and including a document stand directing a document to the player for providing a first piece of information and a visual display producing visual images on a screen thereof for providing a second piece of information together with the first piece of information.

BRIFF DESCRIPTION OF THE DRAWINGS

The features and advantages of the grand piano and the musical instrument will be more clearly understood from the following description taken in conjunction with the accompanying drawings in which.

DESCRIPTION OF THE PREFERRED EMBODIMENTS

First Embodiment

Figure 1:
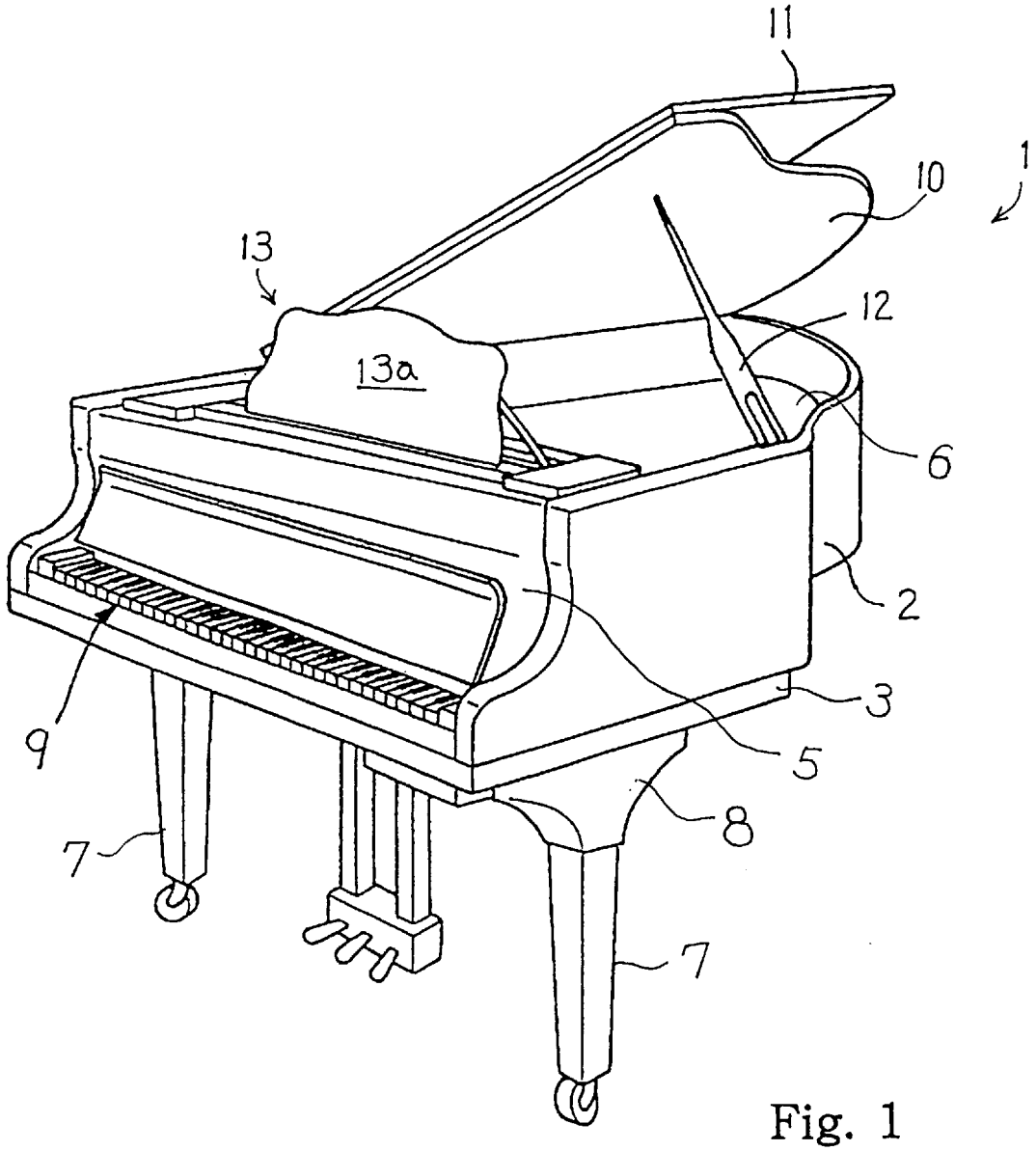
Fig. 1 PRIOR ART
FIG. 1 is a schematic perspective view showing the prior art grand piano.
Figure 2:
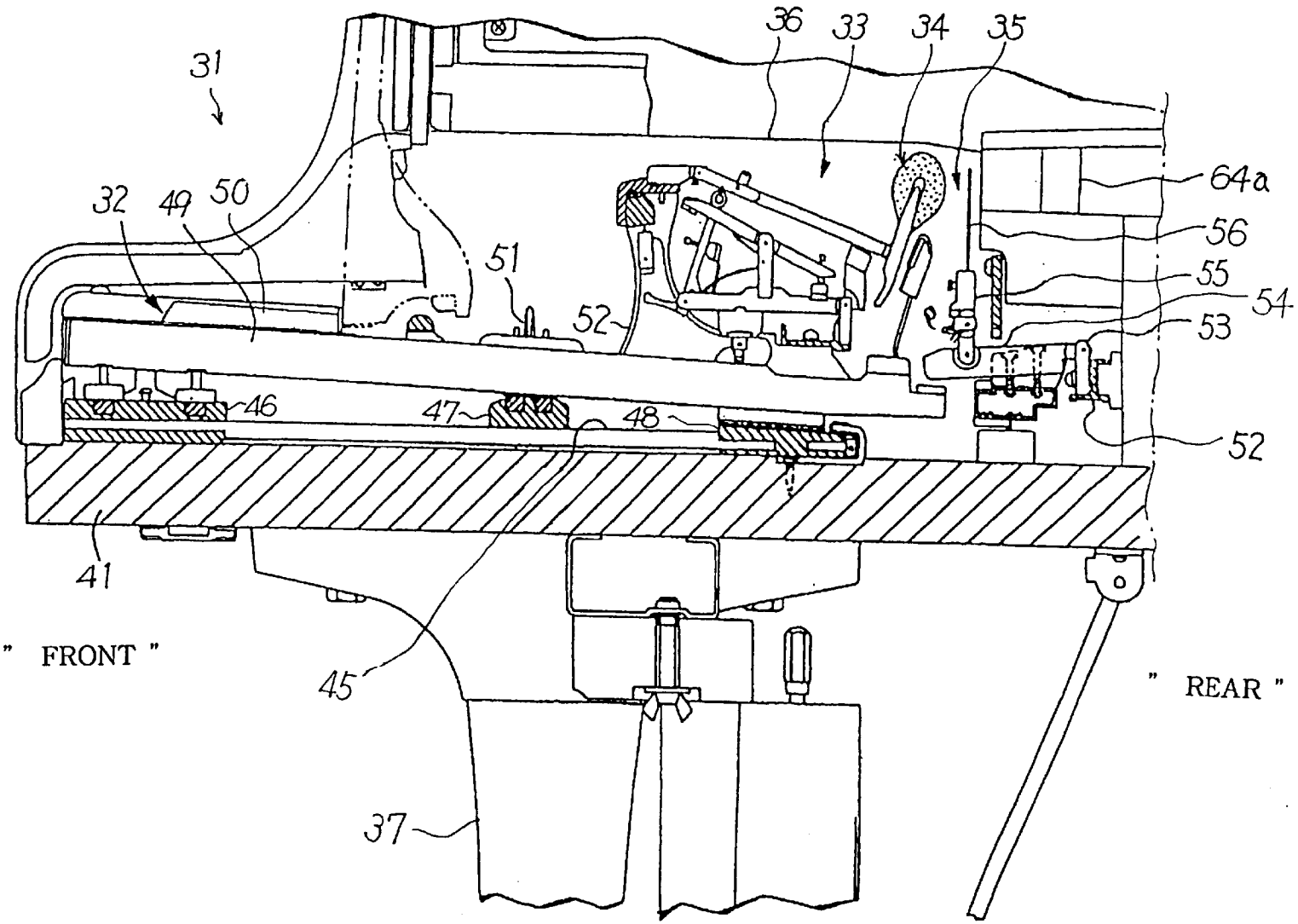
FIG. 2 is a cross sectional side view showing the structure of a part of a grand piano according to the present invention.
Figure 3:
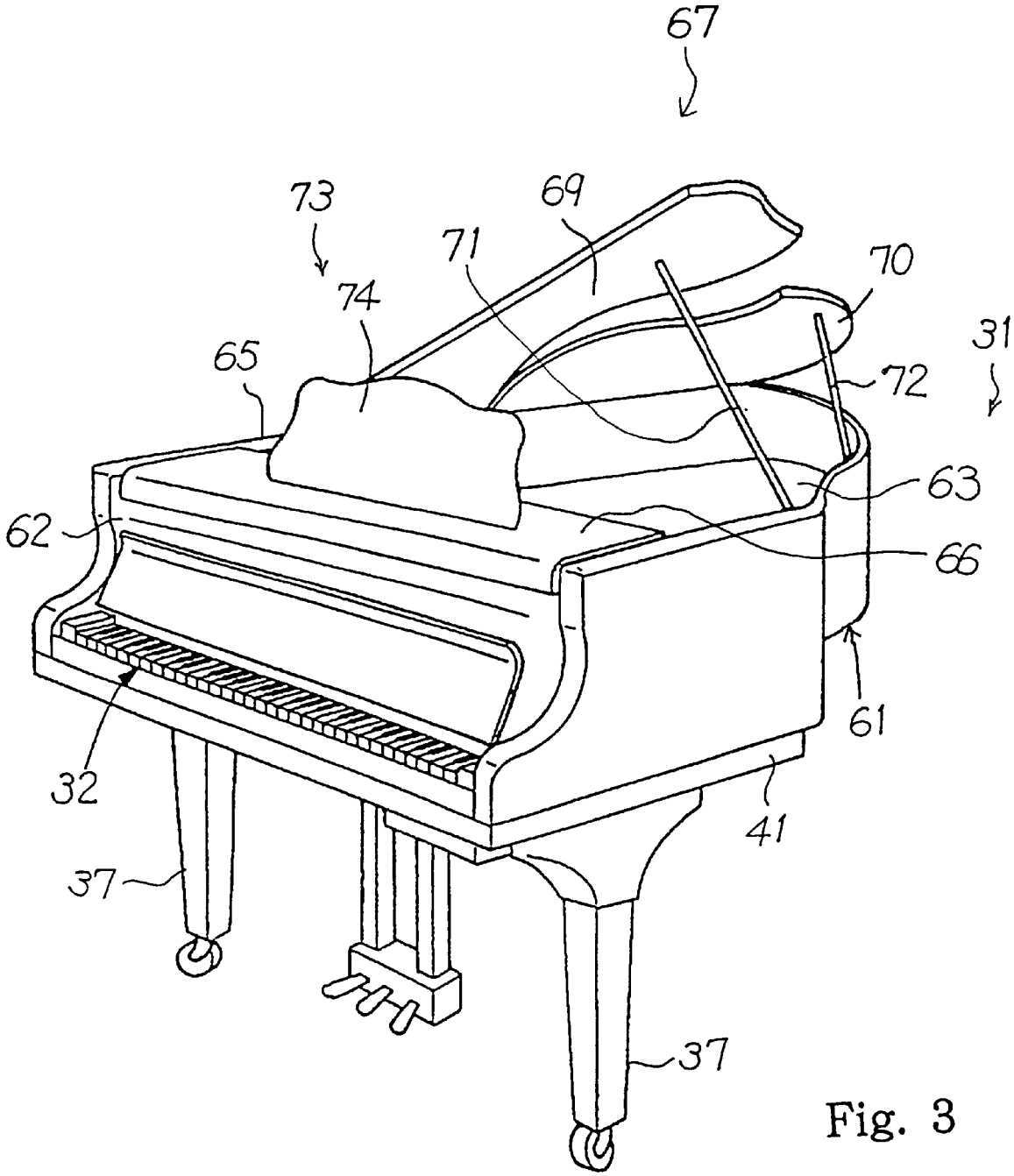
FIG. 3 is a schematic perspective view showing the appearance of the grand piano.

Referring to FIG. 2 of the drawings, a grand piano embodying the present invention comprises a housing 31, a keyboard 32, hammer action mechanisms 33, hammers 34, damper mechanisms 35 and sets of strings 36. The housing 31 is supported by legs 37, and the keyboard 3, the hammer action mechanisms 33, the hammers 34 and the damper mechanisms 35 are assembled inside the housing 31. The sets of strings 36 are stretched over the hammers 34, and are selectively struck by the hammers 34. In the following description, term "front" represents a position closer to a player than a "rear" position. The direction between a front position and a corresponding rear position is hereinbelow referred to as "fore-and-aft direction", and term "lateral" is indicative of a direction perpendicular to the fore-and-aft direction. In this instance, the lateral direction is normal to the paper where the grand piano implementing the first embodiment is drawn as FIG. 1.

The housing 31 is similar in structure to the housing 1 of the prior art grand piano. A key bed 41 forms a part of the housing 31, and the keyboard 32 is placed on the front portion of the key bed 41. A key frame 45 is placed on the key bed 41, and a front rail 46, a balance rail 47 and a rear rail 48 laterally extend in parallel on the key frame 45. White keys 49 and black keys 50 are rotatable with respect to balance pins 51, which project from the balance rail 47. The white keys 49 and the black keys 50 are laid on the well-known pattern. The key frame 45, the front rail 46, the balance rail 47, the rear rail 48, the white keys 49, the black keys 50 and the balance pins 51 as a whole constitute the keyboard 32.

The hammer action mechanisms 33 are equal in number to the white/black keys 49/50, and are linked with the associated white/black keys 49/50. Action brackets 52 are mounted on the key bed 41 at intervals, and the hammer action mechanisms 33 are supported by the action brackets 52. The hammers 34 are also supported by the action brackets 52. The damper mechanisms 35 are provided at the back of the white/black keys 49/50. A damper lever rail 52*a* laterally extends, and damper lever flanges 53 are attached to the damper lever rail 52*a*. Damper levers 54 are rotatably supported by the damper lever flanges 53, respectively, and are engageable with the rear end portions of the white/black keys 49/50. Damper blocks 55 are connected to the leading ends of the damper levers 54, respectively, and damper wires 56 interconnect the damper blocks 55 and damper heads (not shown). The damper heads are spaced from the associated sets of strings 36, and are brought into contact therewith.

A pianist is assumed to depress one of the white/black keys 49/50. The white/black key 49/50 is moved from the rest position toward the end position. The associated hammer action mechanism 33 is actuated, and the associated damper lever 54 is pushed up. The damper lever 54 is rotated in the clockwise direction around the damper lever flange 53, and the damper block 55 and the damper wire 56 space the damper head from the associated set of strings 36. Thus, the damper mechanism 35 allows the set of strings 36 to vibrate. The depressed white/black key 49/50 rotates the hammer action mechanism 33 in the clockwise direction, and escapes from the associated hammer 34. Then, the hammer 34 starts a free rotation in the counter clockwise direction, and strikes the associated set of strings 36. The set of strings 36 vibrates so as to generate a piano sound. When the pianist releases the depressed black/white key 49/50, the depressed white/black key 49/50 returns toward the rest position. The rear end portion of the white/black key 49/50 is sunk, and allows the damper lever to turn in the counter clockwise direction. The damper head is brought into contact with the set of strings 36, again, and damps the vibrations. The hammer action mechanism 33 is engaged with the hammer 34, again.

FIGS. 3, 4, 5 and 6 show the appearance of the grand piano implementing the first embodiment. As described hereinbefore, the housing 31 is constructed in a similar manner to the housing 1, and a side board 61, an upper beam 62 and a wood frame (not shown) form other parts of the housing 31. The upper beam 62 is wider than an upper beam of a standard grand piano, and the upper edge is higher than that of the standard grand piano. A sound board 63 extends over the wood frame, and the sets of strings 36 are stretched between hitch pins (not shown) and tuning pins (not shown). Bridges 64*a*/64*b* (see FIG. 2) are inserted between the sound board 63 and the sets of strings 36 so as to give tension to the sets of strings 36.

Figure 7:
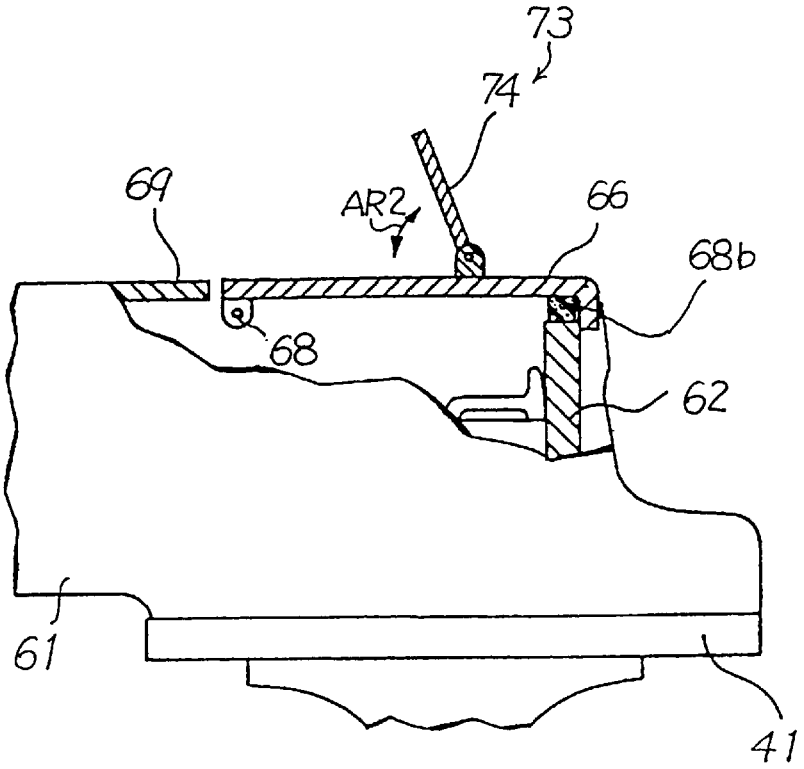
FIG. 7 is a partially cut-away side view showing a music rack assembly provided on a front cover board.

The side board 61 has a straight portion 65, which extends in the fore-and-aft direction. The side board 61 and the upper beam 62 define an upper opening, and a front cover board 66 and a rear top cover 67 are provided for the upper opening. The front cover board 66 is rotatably connected at both sides thereof to the side board 61 by means of a pair of pins 68 (see FIG. 6), and is rotatable around the pair of pins 68 as indicated by arrow AR1. Thus, the grand piano implementing the first embodiment has the front cover board 66 instead of the front top board 11, and the front cover board 66 is directly supported by the side board 61. When the front cover board 66 stands up, a person can see the inside of the housing 31 through the front portion of the upper opening. On the other hand, when the pianist lowers the front cover board 66 onto a cushion 68*b* (see FIG. 7) on the upper edge of the upper beam 62, the front cover board 66 closes the front portion of the upper opening. As described hereinbefore, the upper beam 62 is wider than an upper beam of a standard grand piano, and keeps the front cover board 66 horizontal.

The rear top board 67 is split into a front sub-board 69 and a rear sub-board 70, and serves as a kind of equalizer. The front sub-board 69 and the rear sub-board 70 are rotatably connected to the straight portion 65 of the side board 61, and lid prop assemblies 71 and 72 are hinged to the other side of the side board 61. The front- sub-board 69 and the rear sub-board 70 independently stand up, and also independently fall onto the side board 61. The lid prop assemblies 71 and 72 keep the front sub-board 69 and the rear sub-board 70 inclined over the middle/rear portions of the upper opening. A pianist may render both middle and rear portions open. However, another pianist covers one of the middle/rear portions with the associated front/rear sub-board 69/70.

Thus, the three portions of the upper opening are selectively opened and closed. When the rear top board 10 stands up, the upper opening is fully opened, because the front top board 11 is hinged to the rear top board 10. On the other hand, the front cover board 66, the front sub-board 69 and the rear sub-board 70 are independently supported by the side board 61, and, accordingly, the pianist easily opens and closes the upper opening. While the pianist is playing a tune on the keyboard 32, he may keep the front cover board 66 on the side board 61, and prevents the hammer action mechanisms 33 from dust. When the pianist leaves from the grand piano, he falls both of the front cover board 66 and the rear top board 67 onto the side board 61, and the front cover board 66 and the rear top board 67 prevent the component parts from dust and damages.

Figure 4:
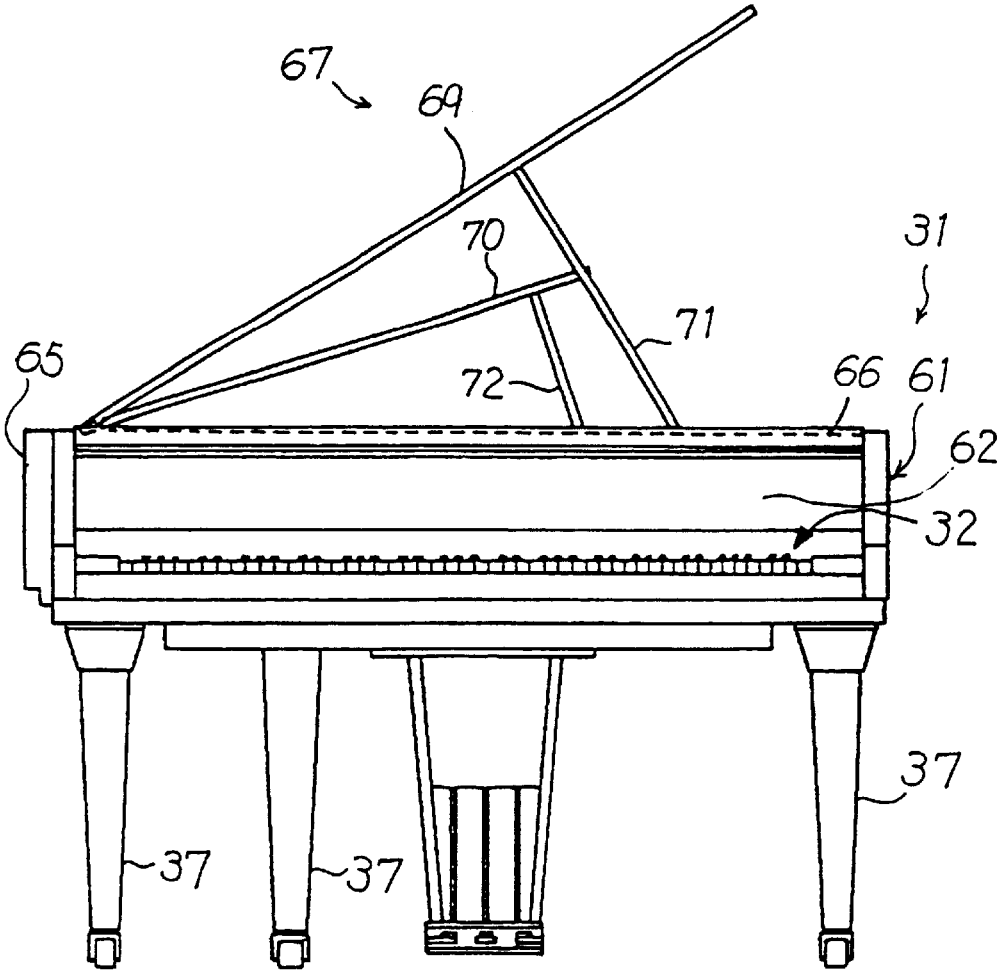
FIG. 4 is a front view showing the appearance of the grand piano from another angle.
Figure 5:
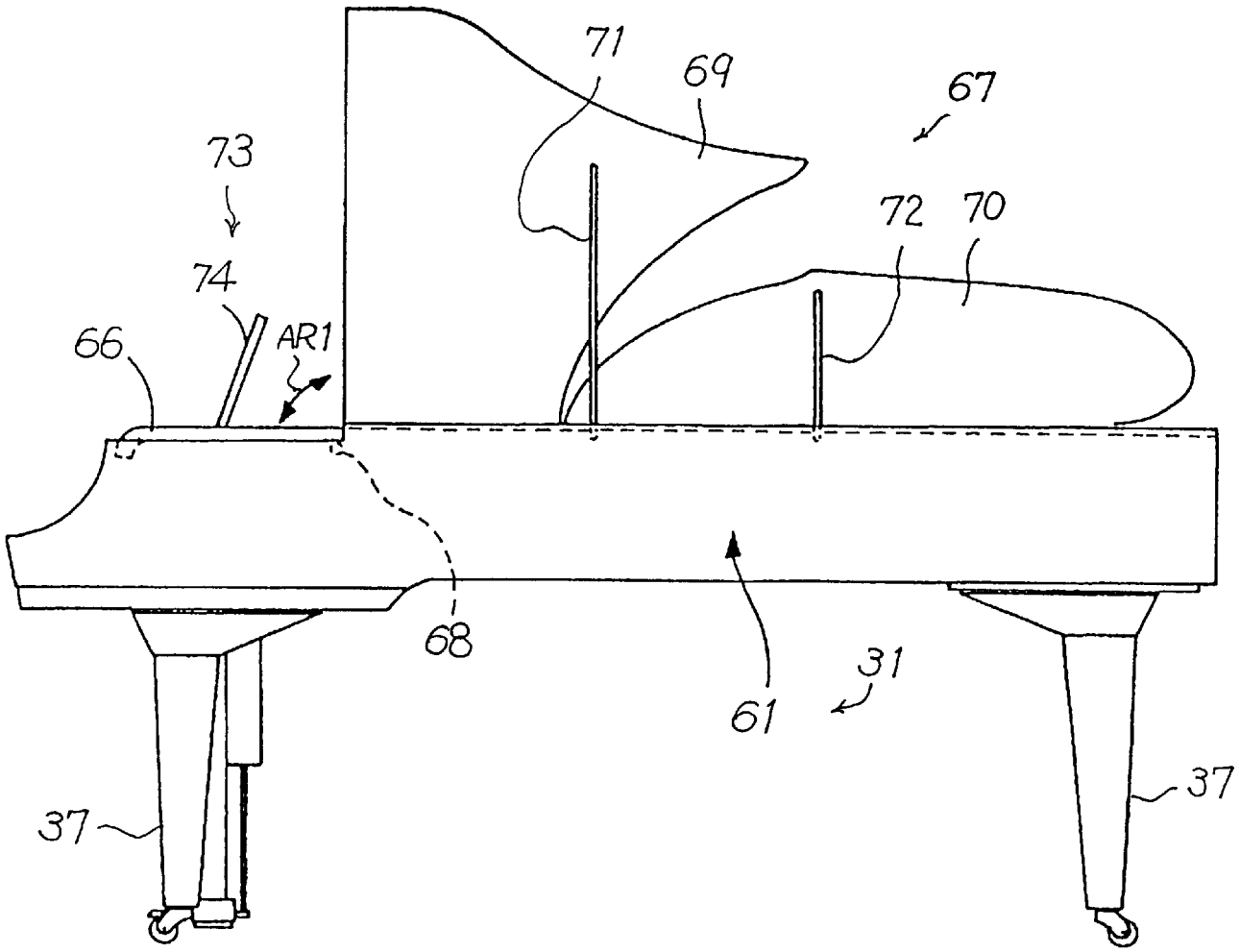
FIG. 5 is a side view showing the appearance of the grand piano from yet another angle.
Figure 6:
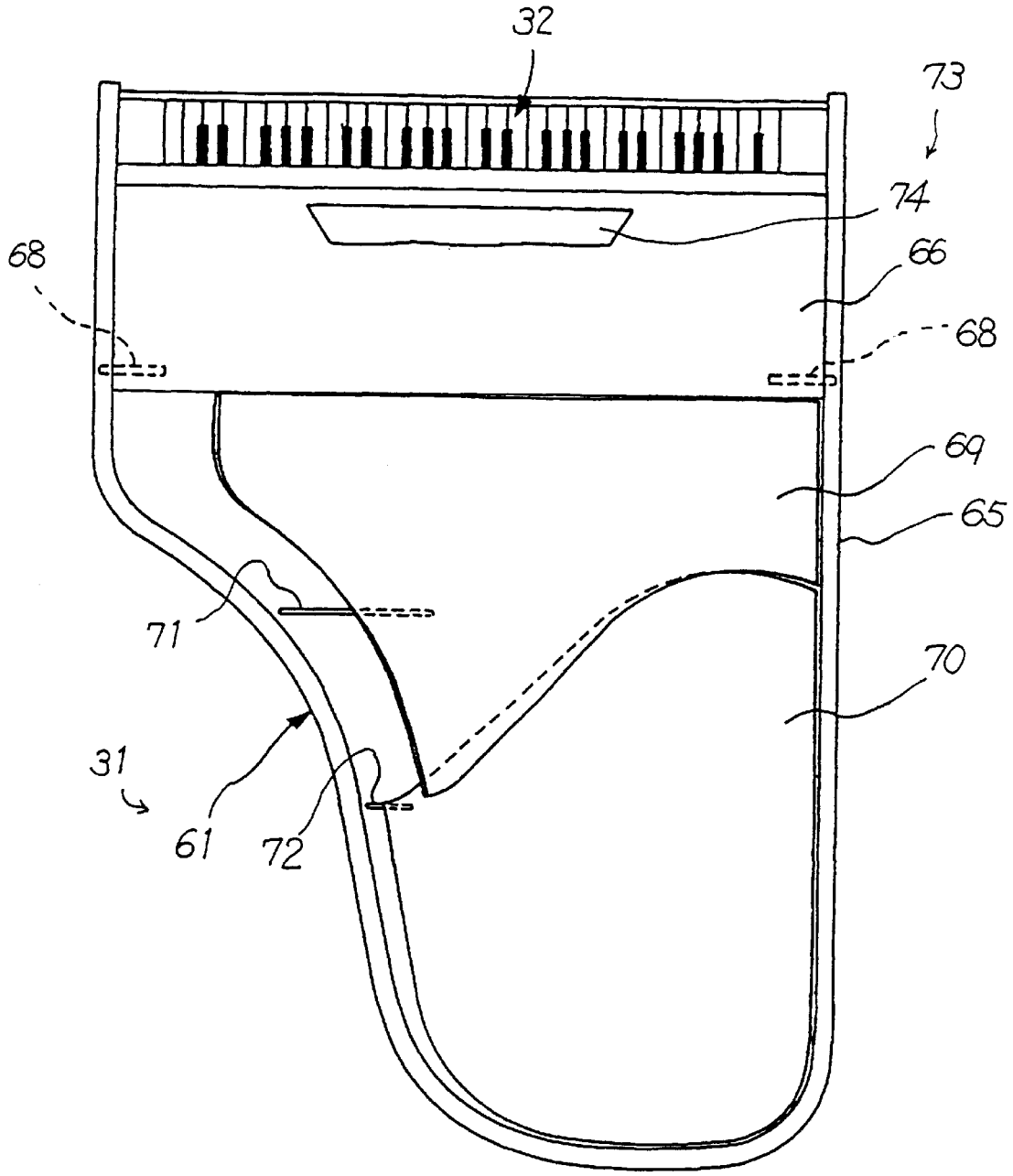
FIG. 6 is a plane view showing the appearance of the grand piano.

As will be better seen in FIG. 4, the lid prop assembly 71 keeps the front sub-board 69 inclined at an angle larger than that of the rear sub-board 70. This is because of the fact that the higher registered sounds tend to be directional rather than the lower registered sounds. This means that the higher registered sounds are much liable to be reflected on the sub-board 69. The lid prop assemblies 71/72 regulate the front sub-board 69 and the rear sub-board 70 to appropriate angles so as to balance the higher registered sounds with the lower registered sounds. The lid prop assemblies 71/72 may be projectable and retractable so as to change the lengths thereof. A pianist can tune an equalizer so as to change the balance between the lower registered sounds and the higher registered sounds by changing the lengths of the lid prop assemblies 71/72.

A music rack assembly 73 is attached to the front cover board 66. However, the music rack assembly 73 is deleted from FIG. 4 in order to clearly show the sub-boards 69/70. The music rack assembly 73 has a desk board 74, which is rotatably supported by the front cover board 66. Any desk rail is required for the music rack assembly 73, and the manufacturer reduces the number of components. As described hereinbefore, the front cover board 66 is horizontal on the side board 61, and a pianist can place a metronome (not shown) on the front cover board 66.

Figure 8:
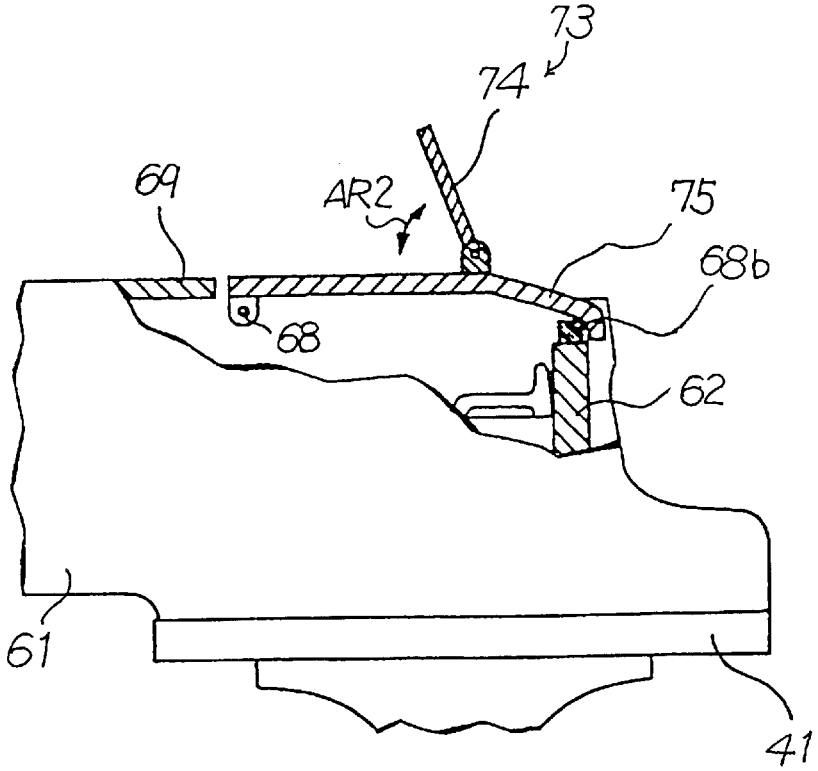
FIG. 8 is a partially cut-away side view showing a modification of the front cover board.

The front cover board 66 may be replaced with a front cover board 75 shown in FIG. 8. The front cover board 75 has a front portion bent from a rear portion, and allows the manufacturer to use the upper beam of the standard grand piano.

The slit rear top board 67 selectively emphasizes a higher register and a lower register, and serves as an equalizer. When a pianist wants to generate all the piano sounds without any emphasis, he lifts both sub-boards 69/70, and makes the lip prop assemblies 71/72 keep the bus-boards 69/70 inclined over the middle/rear portions of the upper opening as shown in FIGS. 3 to 6. While the pianist is playing a tune on the keyboard 32, all the piano sounds are radiated through the middle/rear portions of the upper opening, and the split rear top board 67 does not emphasize any register.

Figure 9:
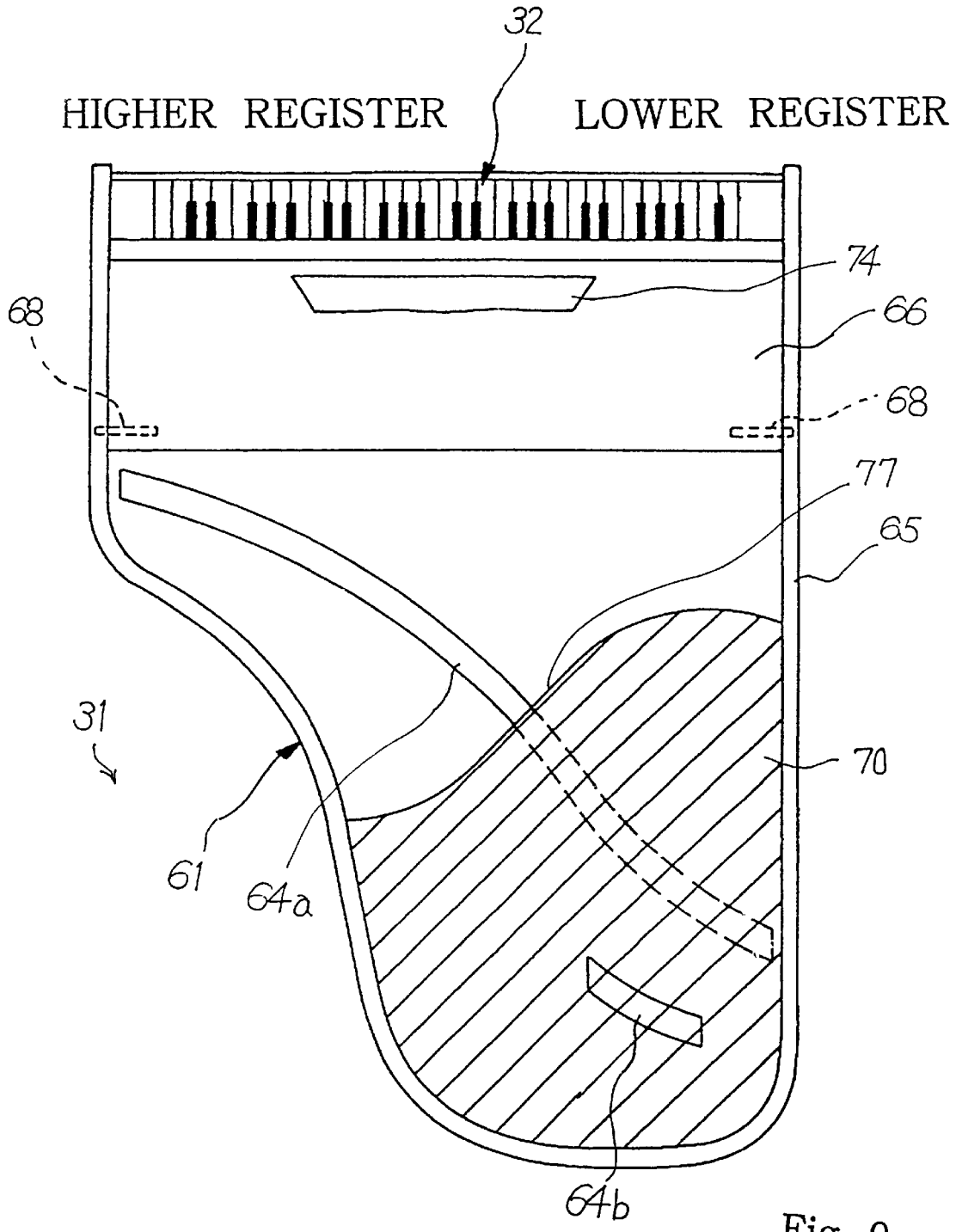
FIG. 9 is a plane view showing a middle portion of an upper opening uncovered with a front sub-board.

When the pianist wants to emphasize a higher register, he lowers the rear sub-board 70 onto the side board 61, and the rear portion of the upper opening is covered with the rear sub-board 70 as indicated by hatching lines in FIG. 9. The front sub-board 69 stands open. The bass bridge **64*b* is under the rear portion of the upper opening. On the other hand, the treble bridge 64*a* extends under the middle/rear portions of the upper opening, and is gently curved. The split line 77 between the front sub-board 69 and the rear sub-board 70 crosses the treble bridge 64*a* around the center of the treble bridge 64*a* at right angle. The left part of the treble bridge 64*a* on the left side of the crossing point convexly projects toward the front end of the housing 31, and the right part convexly projects toward the rear end of the housing 31**.

The sets of strings 36 passing over the right part of the treble bridge **64*a* and the bass bridge 64*b* are covered with the rear sub-board 70, and the rear sub-board 70** impedes the radiation of the piano sounds in the lower register. For this reason, the piano sounds in the lower register are reduced in loudness. However, the piano sounds in the higher register are radiated through the middle portion of the upper opening, and are louder than the piano sounds in the lower register.

Figure 10:
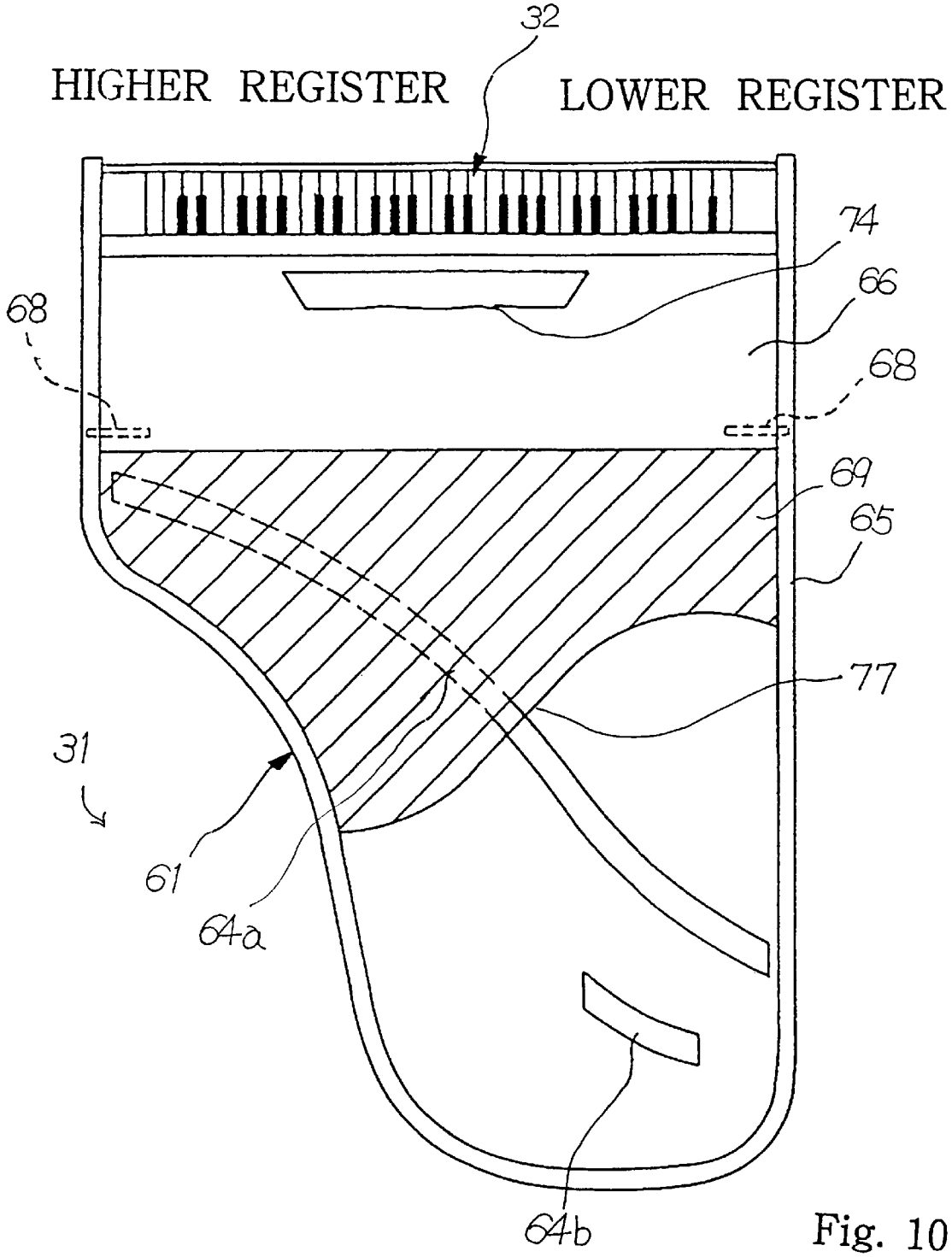
FIG. 10 is a plane view showing a rear portion of the upper opening uncovered with a rear sub-board.

On the other hand, when the pianist wants to emphasize the lower register, he lowers the front sub-board 69 onto the side board 61, and lifts the rear sub-board 70. The lid prop assembly 72 keeps the rear sub-board 70 inclined. As a result, the sets of strings 36 passing over the left part of the treble bridge **64*a* are covered with the front sub-board 69 as indicated by hatching lines in FIG. 10, and the other sets of strings 36 are exposed through the rear portion of the upper opening. The front sub-board 69 impedes the radiation of the piano sounds in the higher register. However, the rear sub-board 69 allows the other sets of strings 36 to radiate the piano sounds in the lower register without any impedance. As a result, even if the pianist evenly depresses the white/black key 49/50 assigned a higher registered sound and the other white/black key 49/50** assigned a lower registered sound, the lower registered sound is louder than the higher registered sound, and the lower register is emphasized.

The top boards 10/11 may be replaced with the front cover board 66 and the split top board 67. Then, the prior art grand piano is remodeled to the grand piano according to the present invention.

Figure 11:
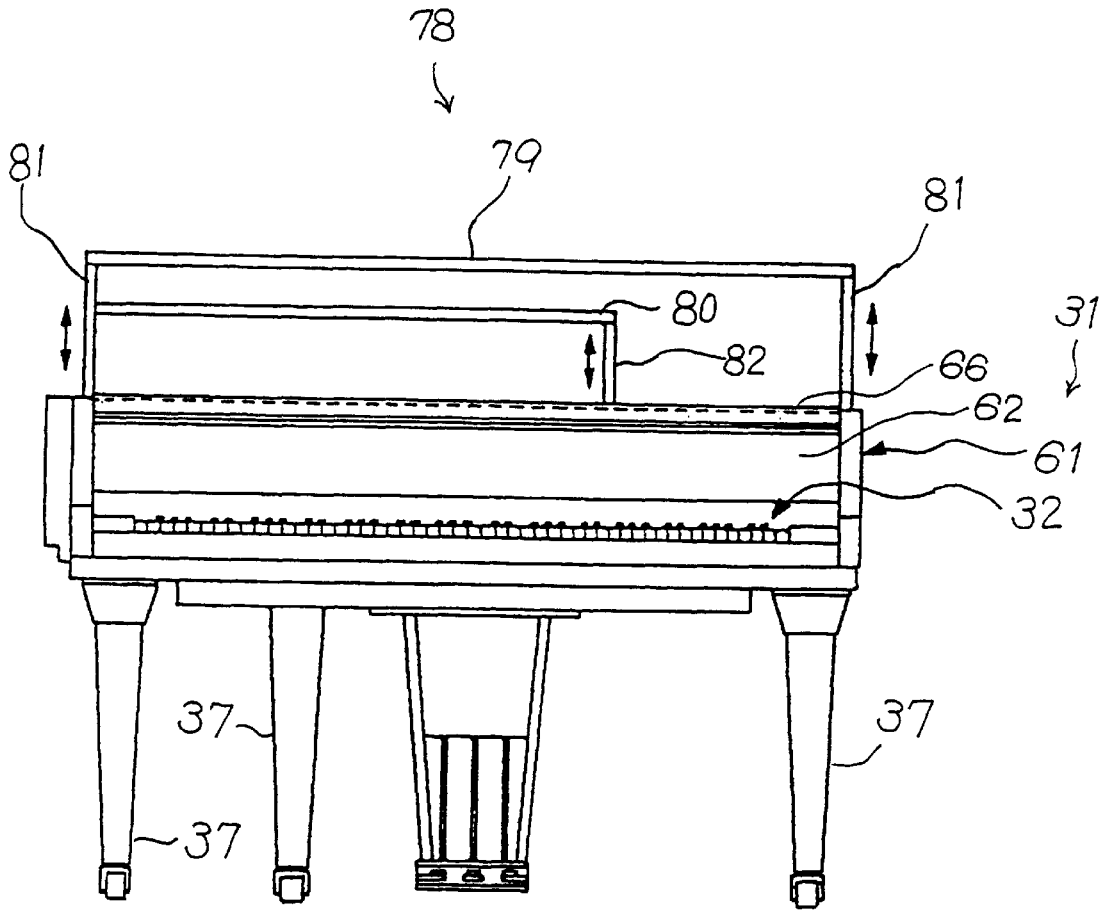
FIG. 11 is a front view showing another modification of the grand piano according to the present invention.

Although the sub-boards 69/70 are hinged to the straight portion 65 in the embodiment described hereinbefore, a split top board 78 may have sub-boards 79/80 movable in the up-and-down direction by means of sliders 81/82 attached to both sides of the sub-boards 79/80 as shown in FIG. 11. The sliders 81/82 allow a pianist to delicately regulate the balance between the higher resistered sounds and the lower registered sounds. The sliders 81/82 move the sub-boards 79/80 without any inclination. Another slider may project differently between the right side and the left side. In this instance, the sub-boards 79/80 are horizontal in the closed positions. However, the sub-boards 79/80 are inclined in the open positions.

In the first embodiment, the hammer action mechanisms 33 and the hammers as a whole constitute plural vibration generating mechanisms.

As will be understood from the foregoing description, the split top board 67 realizes the equalizing function by partially cover the upper opening with the sub-boards 69/70, and allows a pianist to selectively emphasize the piano sounds. Of course, if both sub-board 69/70 are opened, the grand piano generates the piano sounds without any emphasis as similar to the standard grand piano.

The split top board according to the present invention is applicable to a silent piano and an automatic playing piano. The silent piano is fabricated on the basis of a grand piano, and a hammer stopper and an electronic sound generating system are incorporated in the silent piano. Typical examples of the silent piano are disclosed in U.S. Pat. Nos. 5,374,775 and 5,591,927. The split top board according to the present invention is further applicable to other acoustic keyboard musical instrument such as, for example, a harpsichord. In the harpsichord, vibration generating mechanisms selectively pluck the music strings.

Second Embodiment

Figure 12:
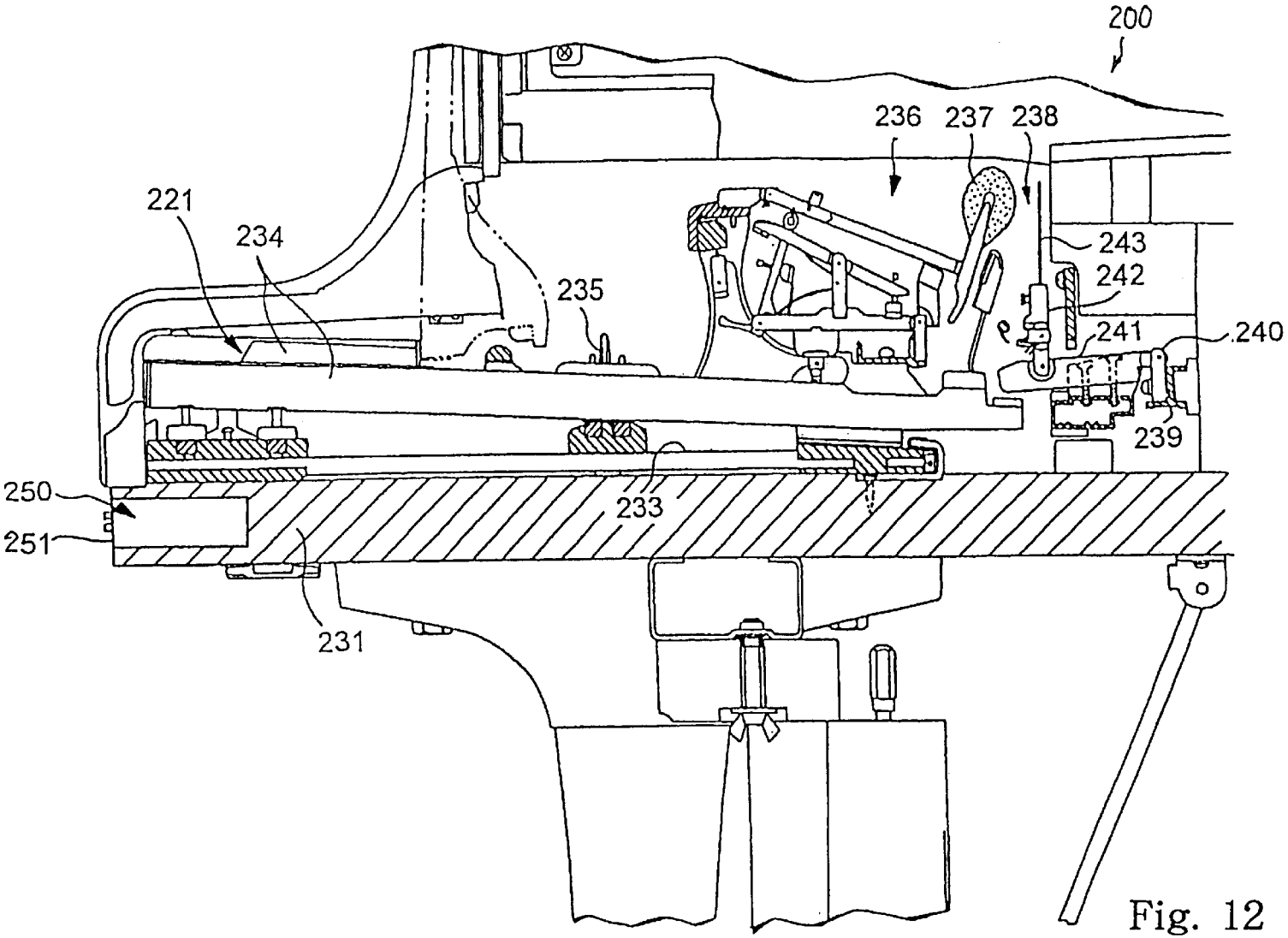
FIG. 12 is a cross sectional side view showing the inside of another grand piano according to the present invention.
Figure 13:
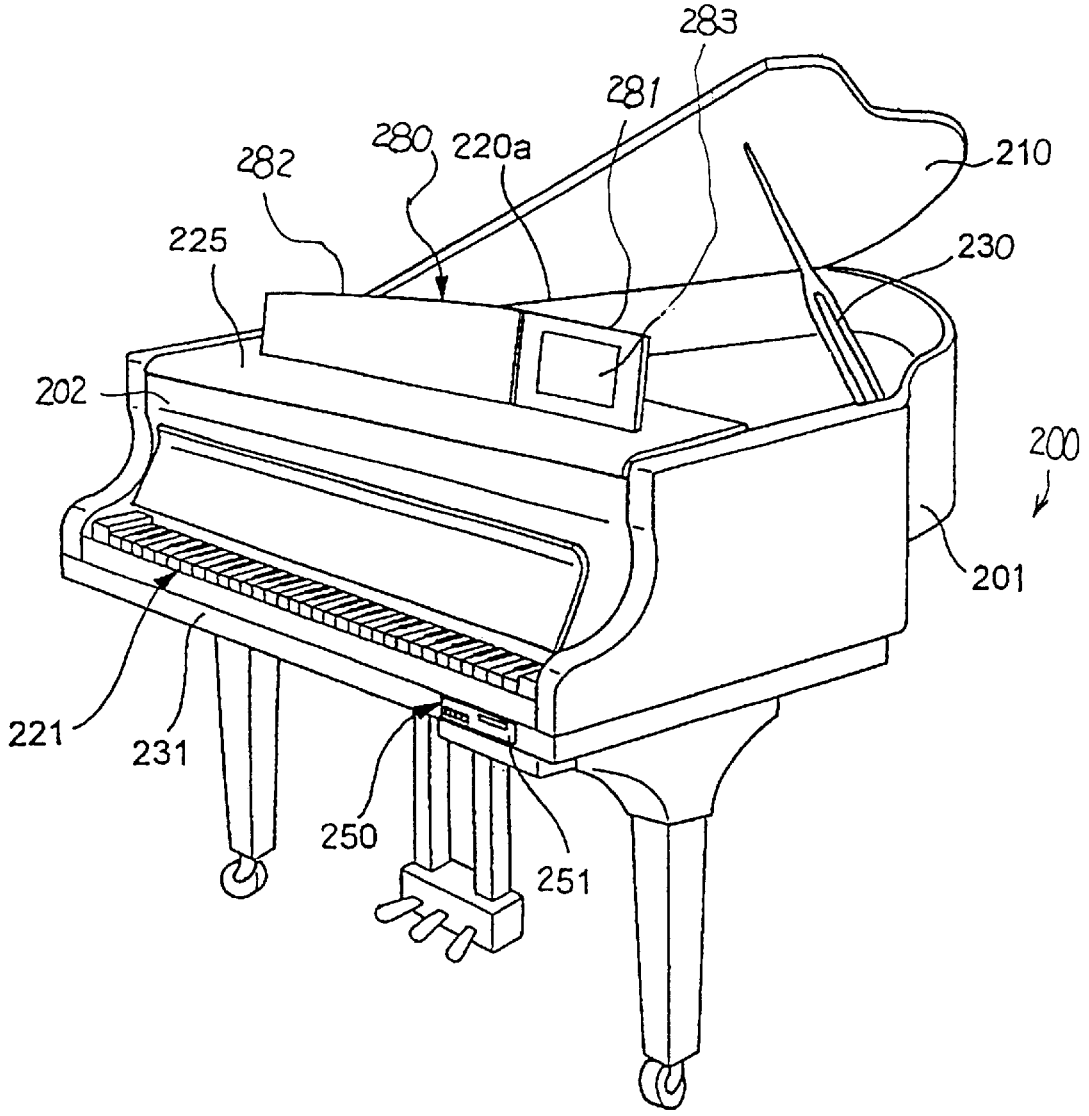
FIG. 13 is a schematic perspective view showing the appearance of the grand piano.
Figure 14:
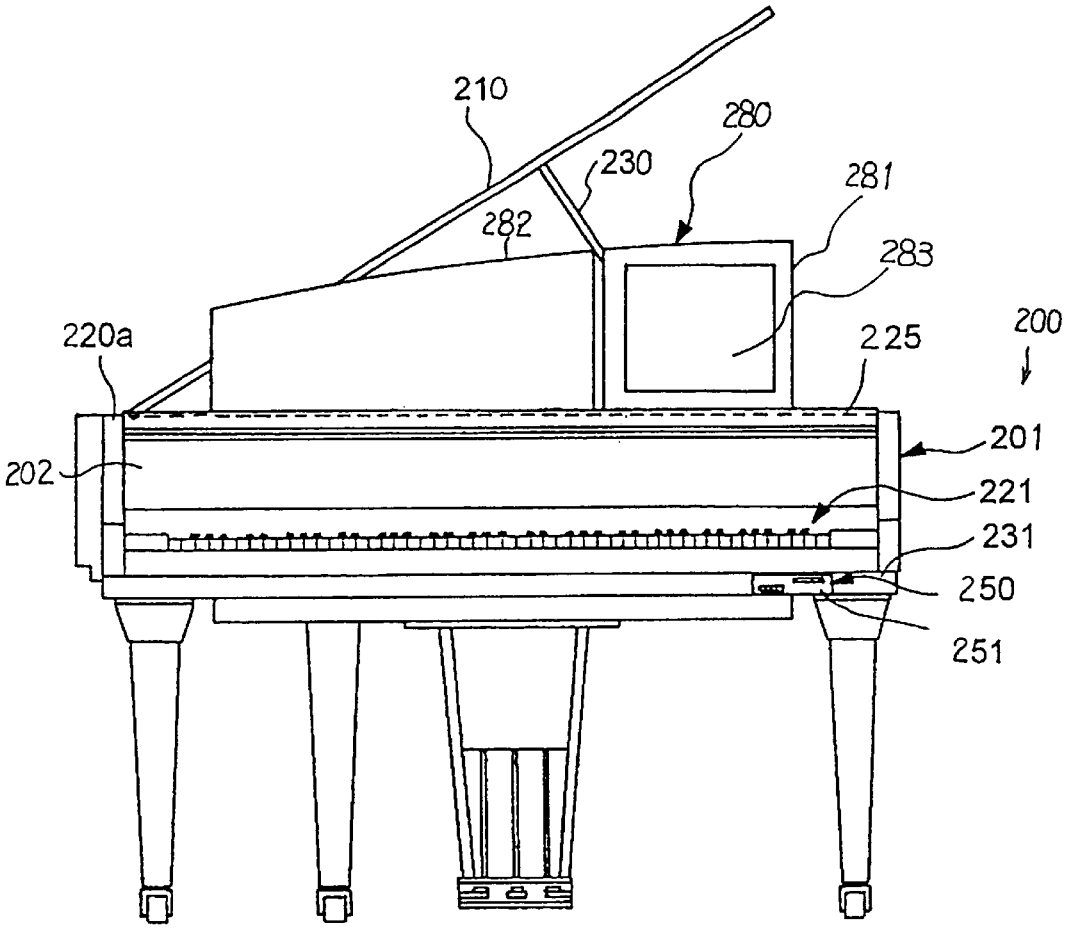
FIG. 14 is a front view showing the appearance of the grand piano from another angle.
Figure 15:
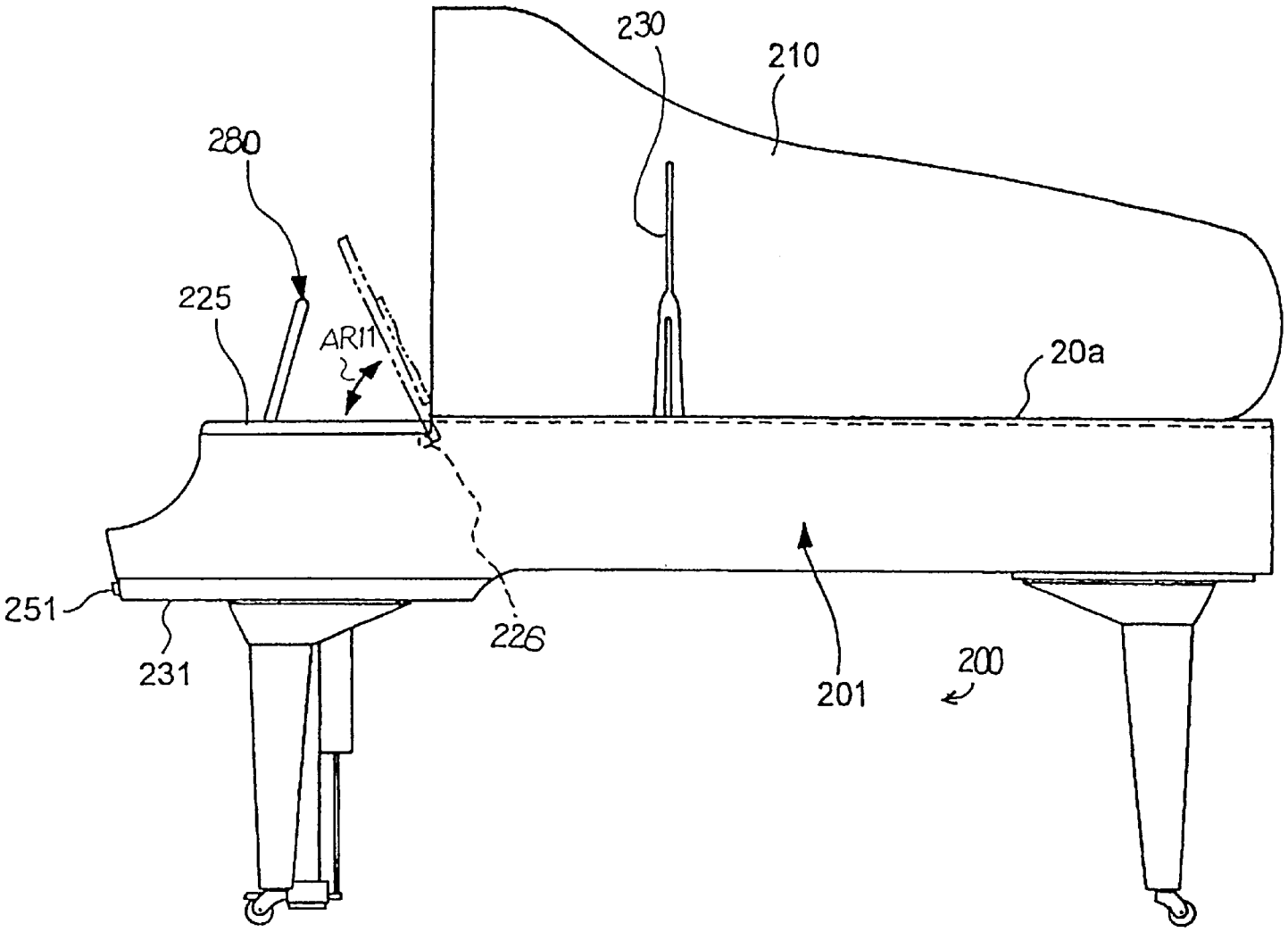
FIG. 15 is a side view showing the appearance of the grand piano from yet another angle.
Figure 16:
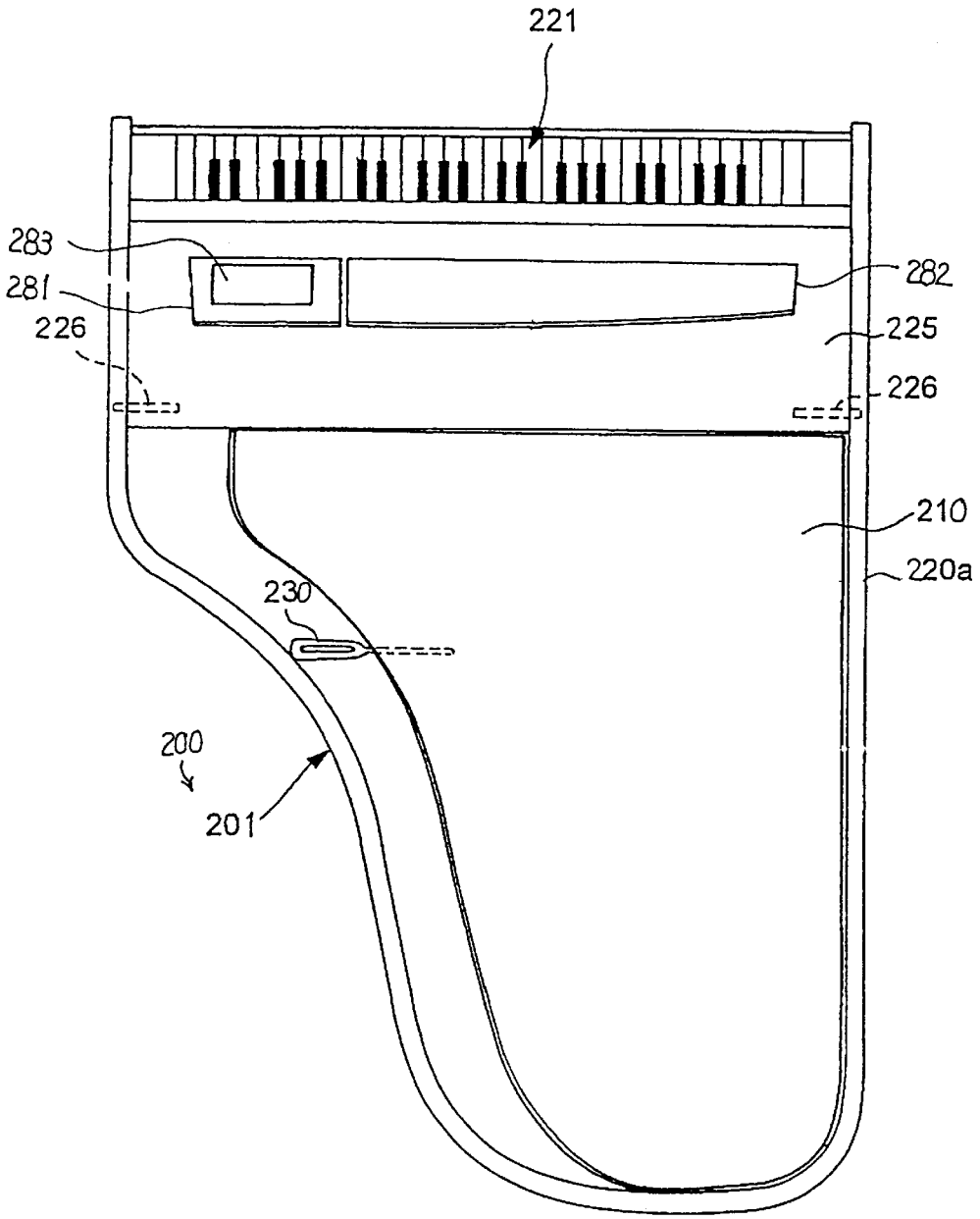
FIG. 16 is a plane view showing the appearance of the grand piano from still another angle.

FIG. 12 illustrates the inside of another grand piano embodying the present invention. A housing 200, hammer action mechanisms 236, hammers 237, damper mechanisms 238 and sets of strings are similar to those of the first embodiment, and description is hereinbelow made on essential parts, only.

On a key bed 231 is placed a key frame 233 which supports a keyboard 221. Black/white keys, which are eighty-eight, 234 are arranged in the lateral direction, and are laid on the well-known pattern. The black/white keys 234 form parts of the keyboard 221 together with a key frame 233 and balance pins 235. The black/white keys 234 are rotatable around the balance pins 235, respectively. The black/white keys 234 are staying in rest positions, respectively, and FIG. 12 shows the black/white keys 234 in the rest positions. When a pianist depresses the black/white keys 234, the black/white keys 234 are sunk, and are moved toward end positions.

The hammer action mechanisms 236 are respectively associated with the black/white keys 234, and are located over the rear portions of the black/white keys 234. A depressed black/white key 234 actuates the associated hammer action mechanism 236. Then, the hammer action mechanism 236 escapes from the associated hammer 237, and gives rise to a free rotation of the hammer 237. The hammer strikes a set of strings. Then, the strings vibrate so as to generate an acoustic sound.

The damper mechanisms 238 are respectively associated with the black/white keys 234 and, accordingly, the sets of strings. The damper mechanisms 238 are located at the back of the hammer action mechanisms 236. A damper rail 239 laterally extends along the keyboard 221, and damper flanges 240 are fixed to the damper rail 239. Damper levers 241 are rotatably connected at rear ends thereof to the damper flanges 240 by means of pins, respectively, and the rear end portions of the black/white keys 234 are engageable with the front ends of the damper levers 241, respectively. The damper blocks 242 are rotatably connected to the leading ends of the damper levers 241, respectively. Damper wires 243 upwardly project from the damper blocks 242, respectively, and damper heads (not shown) are attached to the leading ends of the damper wires 243, respectively.

The depressed black/white key 234 pushes up the front end of the associated damper lever 241, and gives rise to a rotation around the damper flange 240 in the clockwise direction. The damper block 242 coverts the rotation to a straight motion of the damper wire 243 in an up-and-down direction, and lifts the damper head. Thus, the depressed black/white key 234 actuates the associated damper mechanism 238, and causes the damper head to leave from the set of strings before striking the strings with the hammer 237. However, the black/white keys 234 in the rest positions keep the associated damper heads held in contact with the associated sets of strings, and the damper heads prevent the associated sets of strings from resonance with the vibrating strings.

Turning to FIGS. 13, 14, 15 and 16, a side board 201, an upper beam 202, the key bed 231 and a wooded frame (not shown) form in combination the housing 200. The side board 201 and the upper beam 202 define an upper opening. The hammer action mechanisms 236, the hammers 237, the damper mechanisms 238 and the sets of strings are accommodated in the housing 200, and a sound board extends under the sets of strings 236. Though not shown, the sets of strings are stretched between hitch pins and tuning pins, and bridges on the sound board give tension to the sets of strings as similar to a standard grand piano.

The side board 201 has a straight side portion 220*a*. A top board 210 is hinged at one end thereof to the straight side portion 220*a*, and a lid prop assembly 230 is hinged to the other side portion of the side board 201. A pianist lifts the other end of the top board 210, and inclines the top board 210 with respect to the side board 201. The top board 201 rests on the leading end of the lid prop assembly 230, and the lid prop assembly 230 keeps the top board 210 inclined. Thus, the pianist exposes the inside of the housing 200 through a front part of the upper opening to the ambience.

Figure 17:
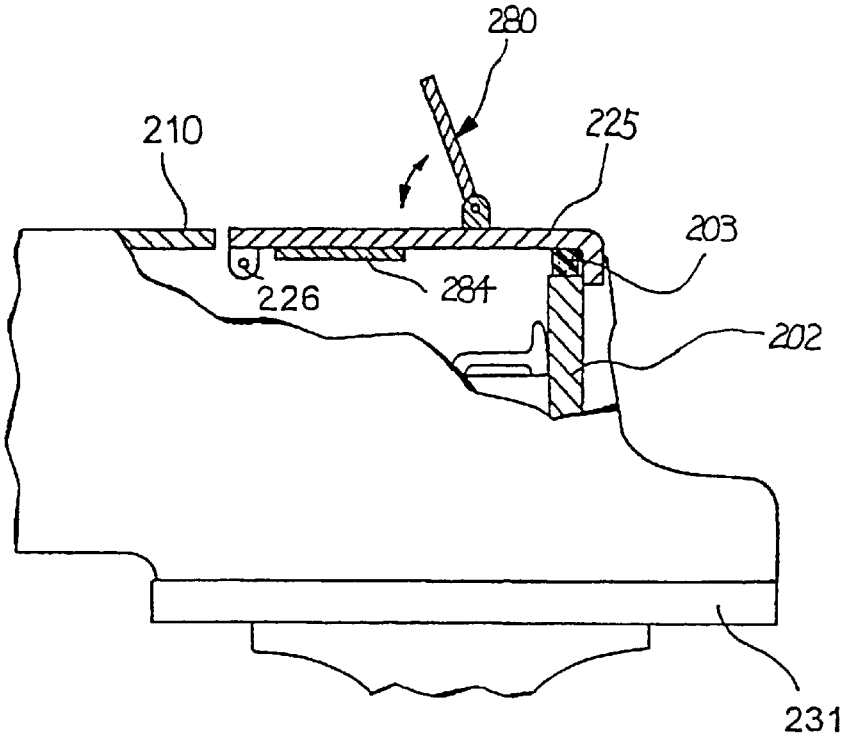
FIG. 17 is a partially cut-away side view showing a music rack assembly on a front cover board.
Figure 18:
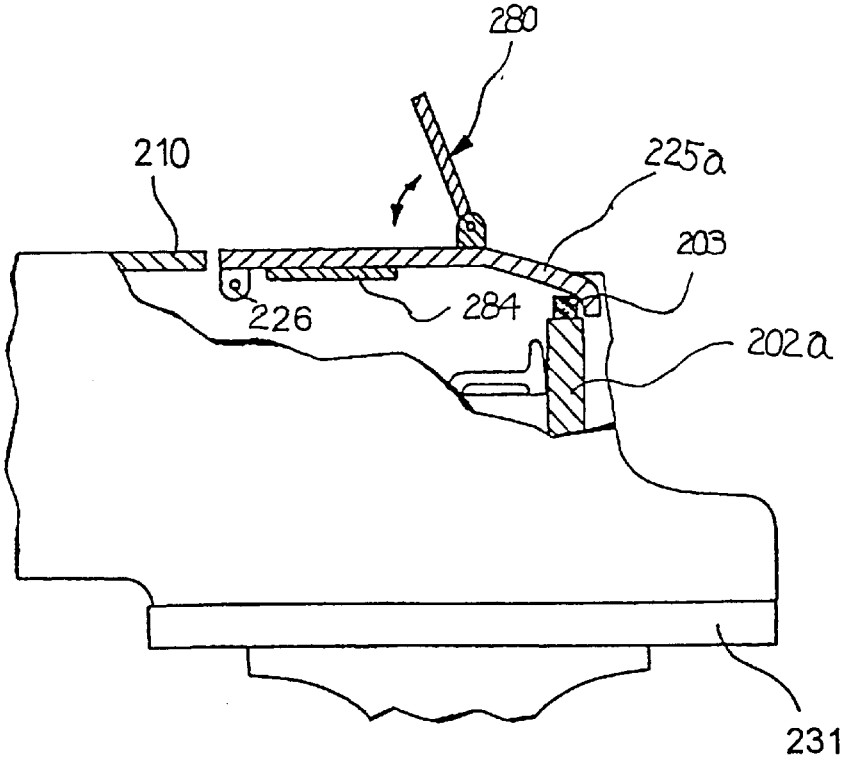
FIG. 18 is a partially cut-away side view showing the music rack assembly on a different front cover board.

A front cover board 225 is connected at both sides thereof to the side board 201 by means of pins 226, and is rotated around the pins 226 as indicated by arrow AR11. When a player lifts a front end of the front cover board 225, the front cover board 225 turns around the pins 226 in the clockwise direction, and exposes the inside of the housing through the front part of the upper opening to the ambience. The upper opening allows a tuner to easily regulate the hammer action mechanisms and the tuning pins. The pianist lowers the front cover board 225 onto the upper beam 202, and covers the front part of the upper opening with the front cover board 225. The front cover board 225 prevents the hammer action mechanisms 236, the hammers 237 and the damper mechanisms 238 from dust and damages. The front cover board 225 is not connected to the top board 210, but to the side board 201. This feature is desirable for owner, because the owner keeps the front part of the upper opening closed at all times. The upper beam 202 is wider than an upper beam of a standard grand piano. When the pianist lowers the front cover board 225 onto a cushion 203 attached to the upper edge of the upper beam 202, the front cover board 225 provides a horizontally extending flat surface as shown in FIG. 17. The pianist may put a metronome on the horizontally extending flat surface. Of course, the upper beam 202*a* of the standard grand piano is available for the housing 200. In this instance, the front cover board 225*a* is bent so as to be fallen onto the cushion 203 as shown in FIG. 18.

Turning back to FIGS. 13 to 16, a music rack assembly 280 is provided on the flat surface of the front cover board 225, and laterally extends in parallel to the keyboard 221. In this instance, the music rack assembly 280 is as long as the keyboard 221. The music rack assembly 280 is split into a right portion 281 and a left portion 282. A visual display 283 is built into the right portion 281, and the left portion 282 serves as a desk board where a music score is placed. In this instance, the visual display 283 is implemented by a liquid crystal display, and forms a part of an image producing system. The lower end of the right portion 281 and the lower end of the left portion 282 are turnably connected to the front cover board 225. Though not shown in the figures, the right portion 281 is tied to the left portion 282 by means of a connector, which is attached to the back surfaces of the right/left portions 281/282. If the connector ties the right portion 281 and the left portion 282 together, a pianist turns the right portion 281 and the left portion 282 together. On the other hand, if the connector unties the right portion 281 from the left portion 282, the right portion 281 and the left portion 282 independently stand up on the front cover board 225, and independently lie on the front cover board 225. Since, the music rack assembly 280 is rotatably supported by the front cover board 225, any desk rail is not required for the music rack assembly 280. Thus, the front cover board 225 allows the manufacturer to delete some component parts from the grand piano, and the production cost is reduced. If pianist uses the grand piano for a piano duet, piano scores may be placed on both right and left portions 281/282. For this purpose, a ridge is formed along the lower edge of the right portion 281 as well as the lower edge of the left portion 282.

A control box 284 is attached to a back surface of the front cover board 225 (see FIG. 17), and is electrically connected to the visual display 283 through signal lines (not shown). The control box 284 forms another part of the image producing system. A display controller (not shown) is incorporated in the control box 284, and supplies scanning signals and image-carrying signals to the visual display 283 so as to reproduce visual images on the screen. The control box 284 allows the manufacturer to decrease component parts of the image producing system built in the right portion 281. For this reason, the right portion 281 is so light that a pianist easily manipulates it.

Figure 19:
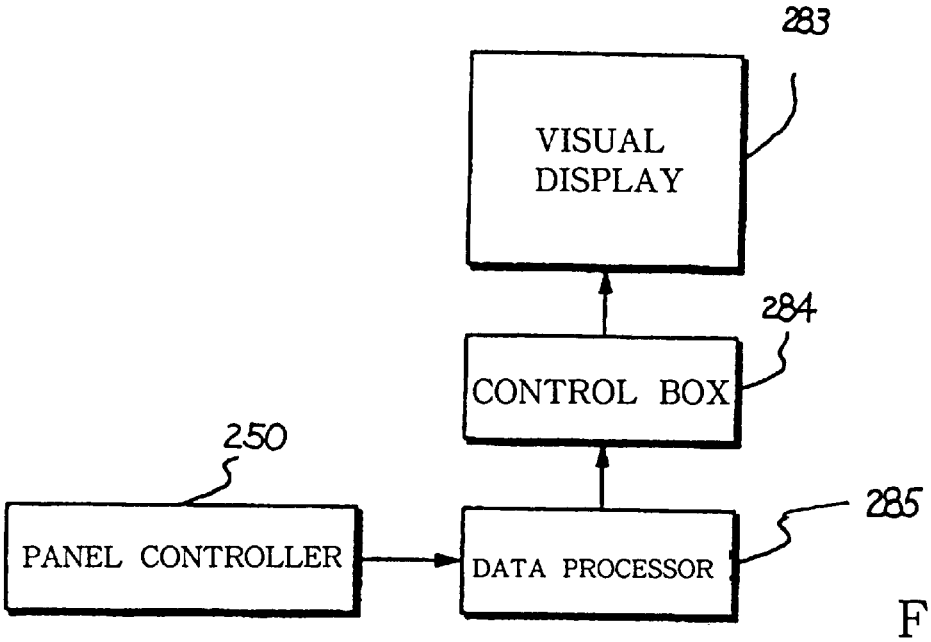
FIG. 19 is a block diagram showing an image producing system incorporated in the grand piano.

The control box 284 is electrically connected to a data processor 285 through an appropriate interface, and the data processor 285 is further connected to a panel controller 250 through the interface. The panel controller 250 is built into the key bed 231, and has a manipulating board 251 exposed to a pianist (see FIGS. 12 and 13). Thus, the data processor 285 is connected through the interface to the panel controller 250 and the control box 284, and the visual display 283 is connected to the display driver in the control box 284 as shown in FIG. 19. Though not shown in FIG. 19, a program memory and a working memory are connected through a shared bus system to the data processor 285. A read only memory device and a random access memory may serve as the program memory and the working memory, respectively.

Switches are provided on the manipulating panel 251, and a slot is formed in the manipulating panel 251. When a compact disc read only memory (not shown) is inserted into the slot, the compact disc read only memory is loaded into a disc driver, and the disc driver transfers digital data codes from the compact disc read only memory to a temporary data storage such as a random access memory. The panel controller 250 keeps the appearance of the grand piano similar to that of a standard grand piano. The manipulating panel 251 is so close to the pianist that he can manipulate the switches and the disc driver without changing his attitude.

The panel controller 250 periodically scans the manipulating panel 251 to see whether or not a pianist manipulates any one of the switches. If the pianist manipulates a switch, the panel controller 250 specifies the switch, and interprets the instruction given through the switch. The panel controller 250 transfers the instruction to the data processor 285, and the data processor 285 instructs the display driver to change the visual images on the screen, by way of example.

Figure 20:
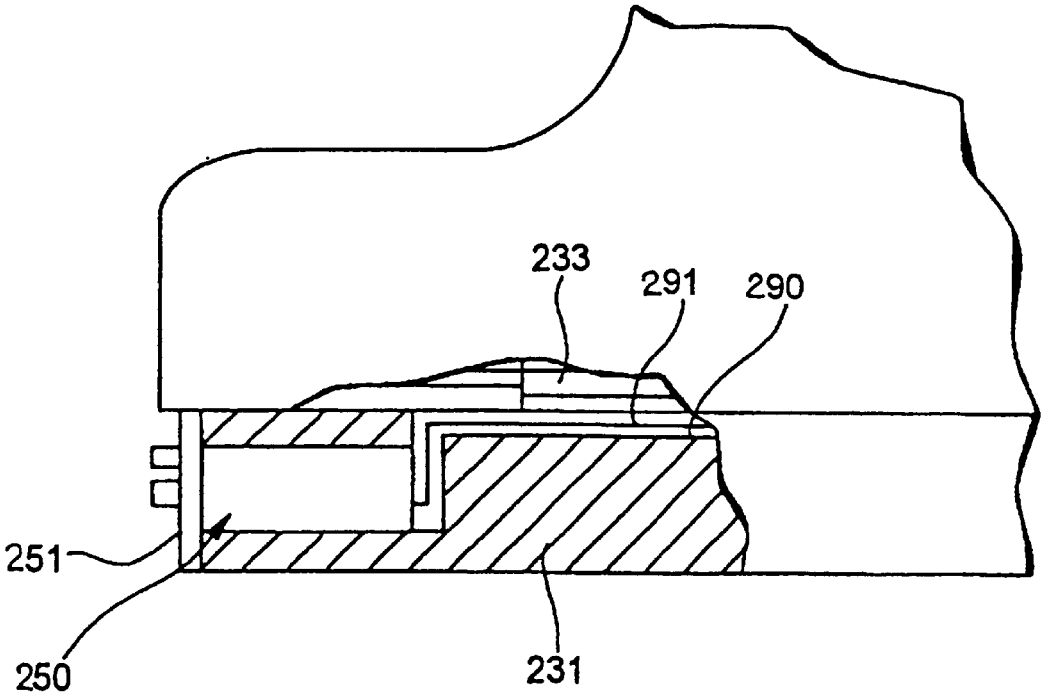
FIG. 20 is a partially cut-away side view showing a built-in panel controller of the image producing system.
Figure 21:
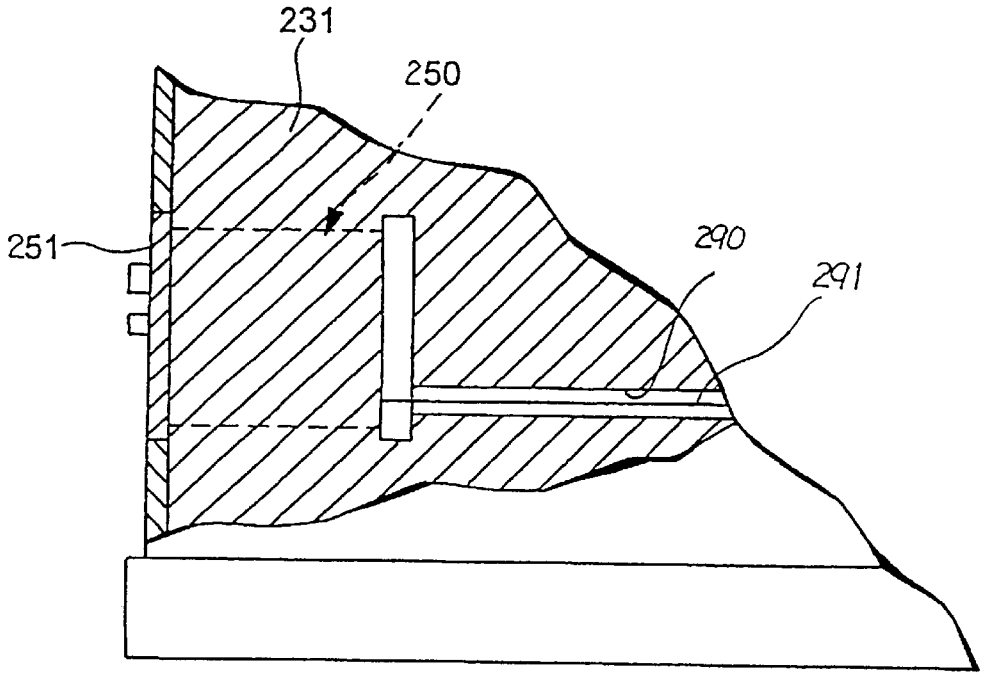
FIG. 21 is a partially cut-way plane view showing the built-in panel controller.

The data processor 285 and the associated memories may be built into the key bed 231 together with the panel controller 250. However, if a personal computer system is used as the data processor and the other electronic components, the personal computer may be accommodated inside the housing 200. A space in the wooden frame may be appropriate for the personal computer. In order to connect the personal computer to the manipulating panel 251, a groove 290 is formed in the key bed 21 as shown in FIGS. 20 and 21, and a cable 291 extends along the groove 290 so as to connect the manipulating panel 251 to the personal computer. The cable 291 in the groove 290 is desirable for the good appearance, because no one sees the cable. Moreover, when a pianist steps on a shift pedal, the key frame 244 is laterally moved. The cable 291 in the groove 290 is not an obstacle against the lateral motion.

When a pianist requires a piece of information, he manipulates the switches on the manipulating panel 251 so as to request the image producing system to give the piece of information to him. The panel controller 250 interprets the instruction, and transfers the instruction to the data processor 285. The data processor determines visual images such as characters representative of a message/comments or a symbol representative of the piece of information, and instructs the display driver in the control box 284 to produce the visual images on the visual display. The display driver is responsive to the instruction from the data processor, and supplies the image-carrying signals in synchronism with the scanning signals to the visual display 283. Then, the visual display 283 produces the visual images on the screen, and the pianist obtains the piece of information through the visual display 283. The pieces of information may be a music score, an instruction from a tutor or a part of the manual book, which teaches how to play the grand piano.

Figure 23:
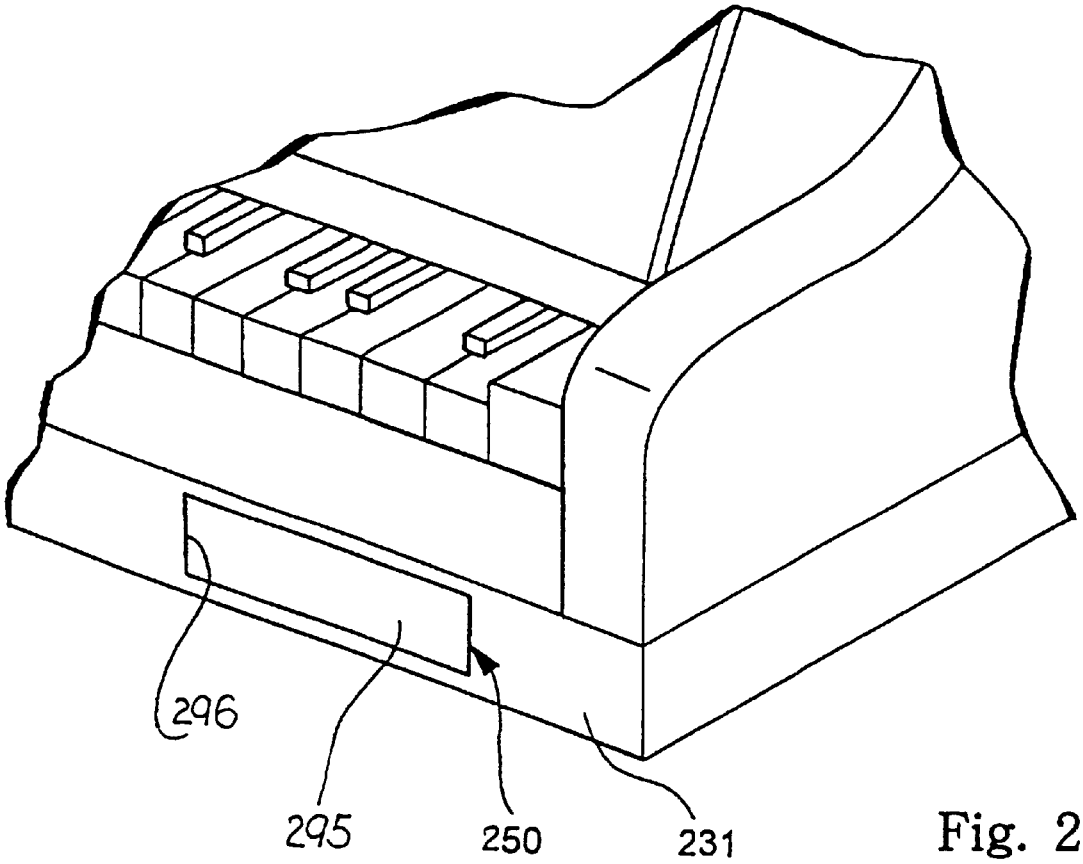
FIG. 23 is a perspective view showing a tray for a manipulating panel retracted into a key bed.
Figure 24:
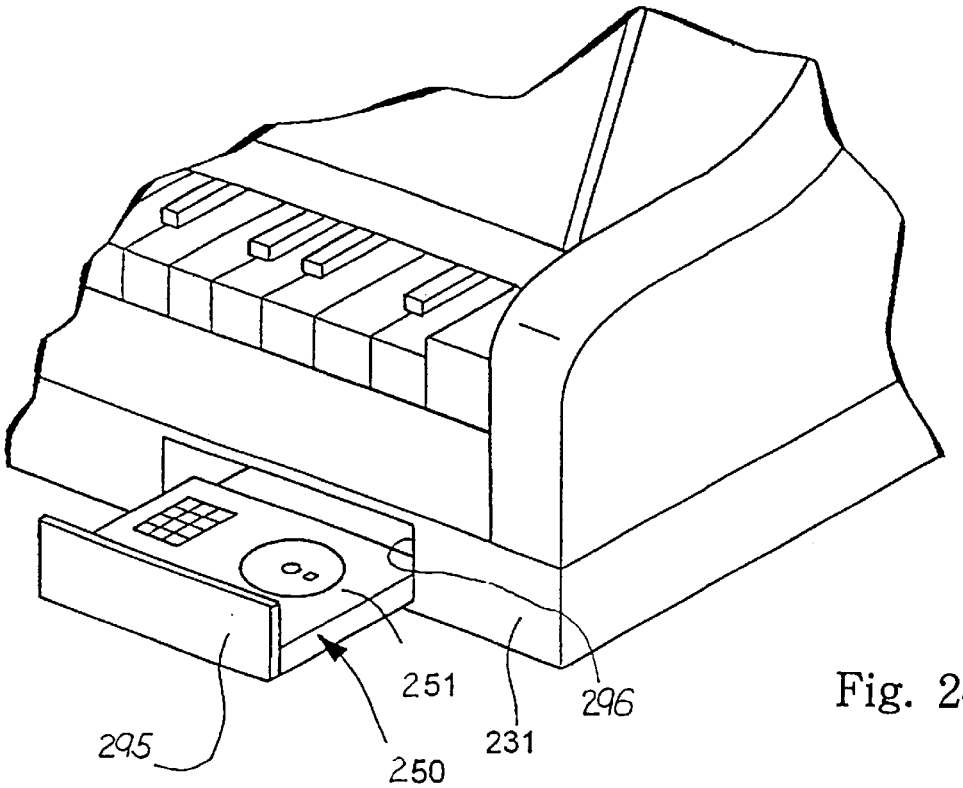
FIG. 24 is a perspective view showing the tray projecting from the key bed.

The visual display may be built into the left portion. A tray 295 may be provided for the manipulating panel 251. In this instance, the tray 295 is retractable into in inner space 296 formed in the key bed 231 (see FIG. 23) and is projectable from the inner space 296 (see FIG. 24). The manipulating panel 251 is mounted on the tray 295. The tray 295 may be painted in the same color as the key bed 231. When the manipulating panel 251 is exposed to the front surface of the key bed 231, the key bed 231 sets a limit on the height of the manipulating panel 251. However, the tray 295 allows the manufacturer to freely design the manipulating panel 251, because the key bed 231 offers a deep inner space 296. When a pianist gives instructions to the data processor 250 through the switches, he pushes a button (not shown), and the tray 295 projects from the inner space 296. Then, the manipulating panel 251 is exposed to the pianist. However, the manipulating panel 251 is disappears into the key bed 231, and the grand piano is improved in appearance. The pianist may manually pull out the tray 295 from the inner space 296.

The front cover board 225 may be replaced with a front cover board 297. The front cover board 297 has a generally L-letter shaped cross section, and a flat cover plate 297*a* is connected to a connecting plate 297*b* at right angle. The connecting plate 297*b* is connected at both sides thereof to the side board 201 by means of the pins 226, and a display stand 298 is fixed to the flat cover plate 297*a*. The visual display 283 is rotatably supported by the display stand 298, and a pianist freely inclines the visual display 283 with respect to the flat cover plate 297*a*. The flat cover plate 297*a* is lower than the front cover board 225, and the manufacturer uses the upper beam 202*a* of the standard grand piano. However, the display stand 298 keeps the visual display 283 as high as the visual display 283 on the front cover board 225. Thus, the front cover board 297 allows the manufacturer to use the upper beam 202*a* of the standard grand piano without sacrifice of the visual angle.

The music rack assembly 280 according to the present invention is applicable to a silent piano and an automatic playing piano. The silent piano is fabricated on the basis of a grand piano, and a hammer stopper and an electronic sound generating system are incorporated in the silent piano disclosed in U.S. Pat. Nos. 5,374,775 and 5,591,927.

As will be understood from the foregoing description, the music rack assembly 280 is so long that the manufacturer can build the visual display 283 into the right part 281 of the music rack assembly 280. Pieces of information to be required are given through the visual display 283 and a music score on the music rack assembly 280 to the pianist. Thus, when the pianist requires any kind of information, he concentrates his attention on the music rack assembly 280, and the piece of information to be required is surely given therefrom.

The music rack assembly 280 keeps the music score and the visual display 283, which are level with the eyes of the pianist, and a piece of information to be required is easily transferred from the music rack assembly 280 to the pianist.

Figure 22:
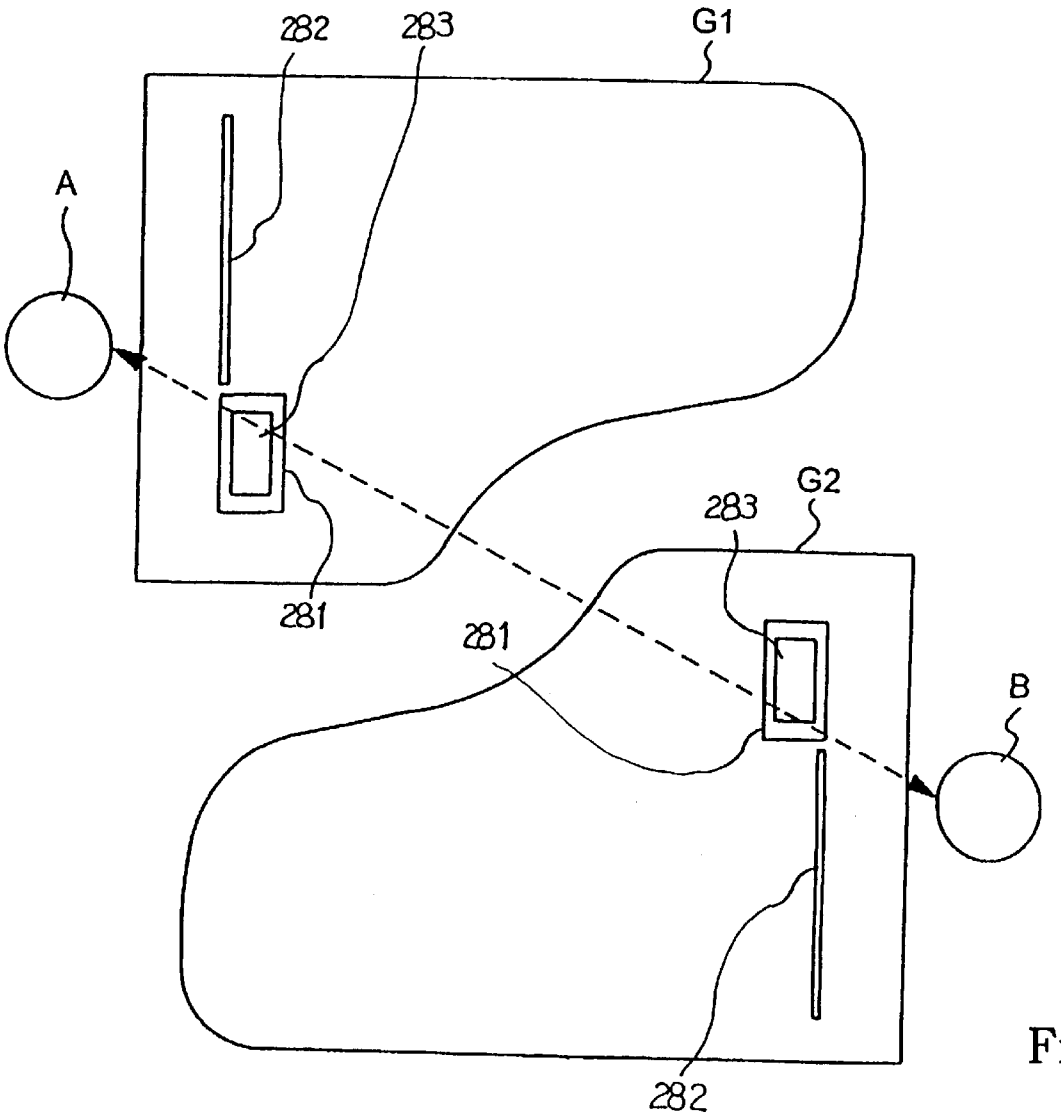
FIG. 22 is a schematic plane view showing two grand pianos for a piano duo.

When a pianist does not need any piece of information through the visual display 283, he may lay the right portion 281 onto the front cover board 225. Two grand pianos G1/G2 are assumed to be used for a piano duo. The grand pianos G1/G2 may be directed in opposite directions as shown in FIG. 22. While pianists A/B are playing the tune on the grand pianos G1/G2, the right portions 281 lie on the front cover boards 225, and allow the pianists A/B to see each other as indicated by broken line. The pianist may use the right portion 281 as a part of the desk board.

Moreover, if the visual display 283 is broken, the manufacturer takes only the visual display 283 to the factory, because the right portion 281 and the left portion 282 are independently supported by the front cover board 225. While the manufacturer is repairing the visual display 283, the pianist can play a tune on the grand piano, because the left portion 282 still stands on the front cover board 225.

In the second embodiment, the hammer action mechanisms 236, the hammers 237, the damper mechanisms 238, the sets of strings, the sound board, the bridges, the pins and the top board 210 as a whole constitute a sound generating system. A sound generating system is also incorporated in the silent piano, and the sound generating system of the silent piano further includes key sensors, a controller, a tone generator and a sound system/headphone. The sound system of the silent piano is usually accommodated in a housing except the sound system/the headphone. A sound generating system of the automatic piano further includes a controller and solenoid-operated key drivers.

Third Embodiment

Figure 26:
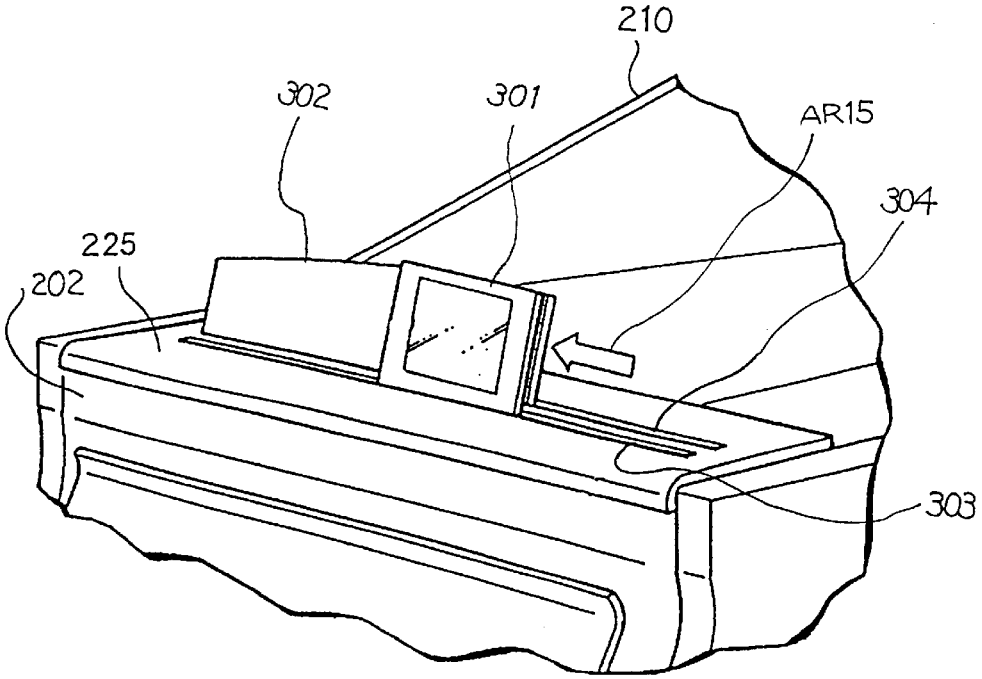
FIG. 26 is a perspective view showing a slidable visual display incorporated in yet another grand piano according to the present invention.
Figure 25:
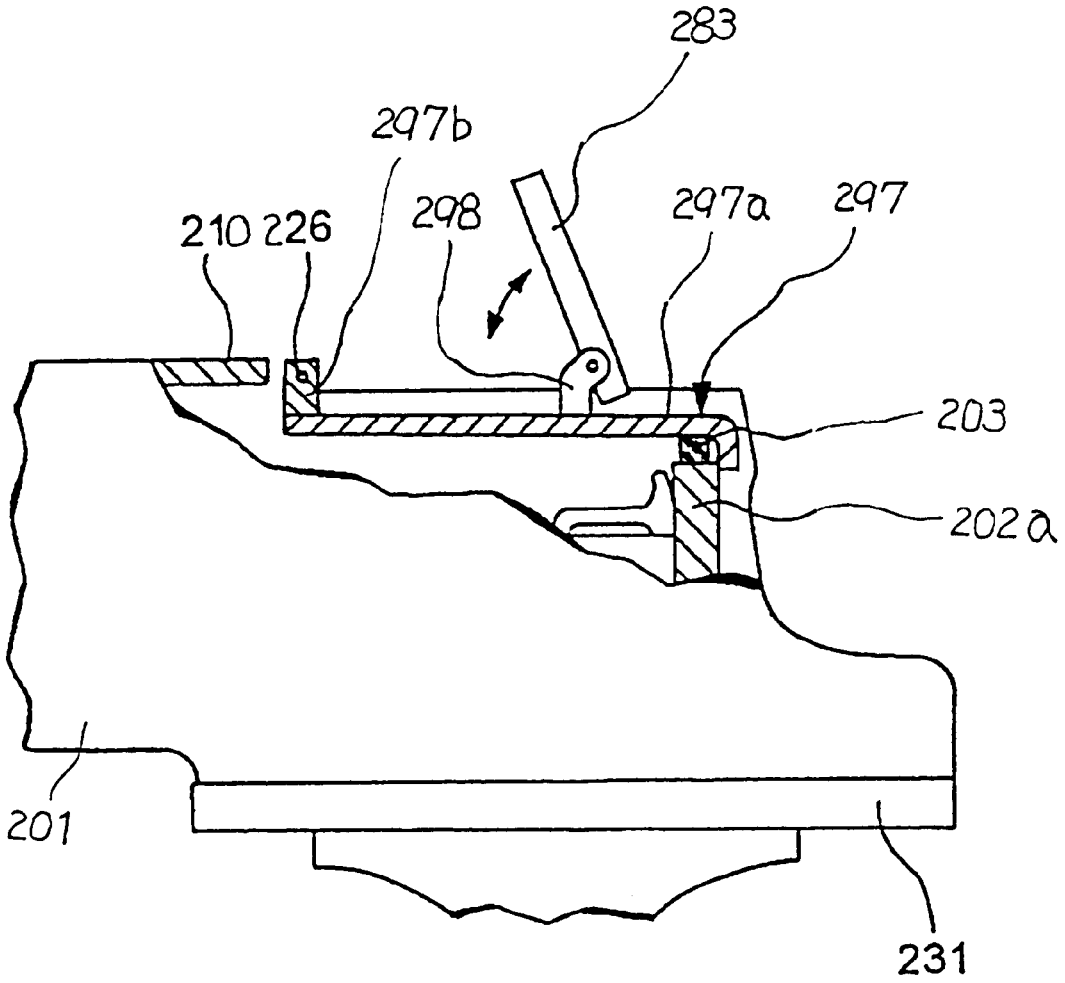
FIG. 25 is a partially cut-away side view showing a modification of a front cover board.

Turning to FIG. 26 of the drawings, a slidable visual display 301 and a slidable desk board 302 are provided on a front cover board. The front cover board and other component parts of the keyboard musical instrument implementing the third embodiment are similar to those of the second embodiment, and, for this reason, the front cover board and the other component parts are labeled with the same references designating corresponding component parts of the second embodiment.

Guide rails 303/304 are embedded in the front cover board 225, and laterally extend in parallel to each other. Suitable sliding members (not shown) are inserted in the guide rails 303/304, and the visual display 301 and the desk board 302 are respectively supported by the sliding members. As a result, the visual display 301 and the desk board 302 laterally slide along the guide rails 303/304, respectively. If the visual display 301 slides as indicated by arrow AR15, the visual display 301 is overlapped with the right portion of the desk board 302.

A pianist locates the visual display 301 and the desk board 302 at desirable positions through the sliding members and the guide rails 303/304, and obtains pieces of information from the visual images on the display 301 and documents on the desk board 302.

If a suitable coupling means is attached to the visual display and the desk board 302 or to the sliding members, the pianist can move the desk board 302 and the visual display 301 together. The coupling means may be detachable.

The slidable visual display 301 according to the present invention is applicable to a silent piano and an automatic playing piano. The silent piano is fabricated on the basis of a grand piano, and a hammer stopper and an electronic sound generating system are incorporated in the silent piano disclosed in U.S. Pat. Nos. 5,374,775 and 5,591,927.

Fourth Embodiment

Figure 29:
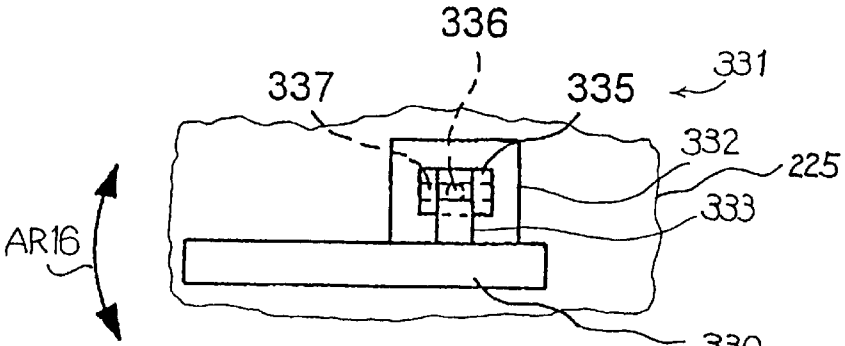
FIG. 29 is a plane view showing the visual display.
Figure 28:
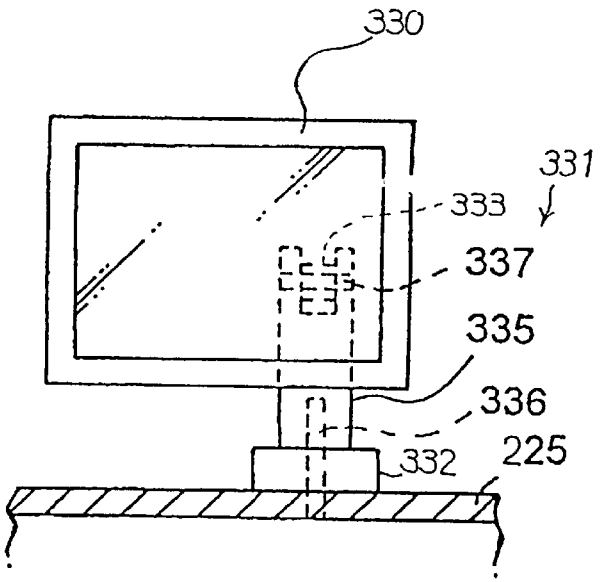
FIG. 28 is a front view showing the visual display.
Figure 27:
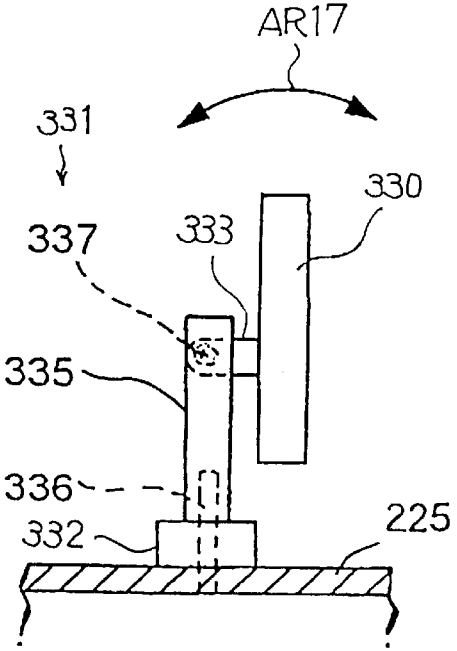
FIG. 27 is a side view showing a visual display independent of a music rack assembly incorporated in still another grand piano according to the present invention.

FIGS. 27, 28 and 29 illustrate a visual display 330 incorporated in yet another grand piano embodying the present invention. The visual display 330 is supported by a flexible pedestal 331. The flexible pedestal 331 is independent of a desk board (not shown), and a music score, by way of example, stands against the desk board. The other structure of the grand piano is similar to that of the second embodiment, and description is focused on the flexible pedestal 331.

The flexible pedestal 331 includes a block 332, an arm 333, a column 335, and pins 336/337. The block 332 is fixed to the front cover board 225, and the arm 333 is fixed to the rear surface of the visual display 330. The column 336 is connected to the block 332 by means of the pin 336, and is turnable around the pin 336 as indicated by arrow AR16. On the other hand, the arm 333 is connected to the leading end portion of the column 335 by means of the pin 337, and is turnable around the pin 337 as indicated by arrow AR17. Thus, the visual display 330 is three-dimensionally movable with respect to the front cover board 225 and, accordingly, a pianist, who sits in front of the keyboard.

Thus, the pianist can arbitrarily regulate the attitude of the visual display 330, because the visual display 330 is independent of the desk board. The visual display independent of the desk board according to the present invention is applicable to an electric keyboard, another acoustic keyboard musical instrument such as, for example, a harpsichord, a silent piano and an automatic playing piano. The silent piano is fabricated on the basis of a grand piano, and a hammer stopper and an electronic sound generating system are incorporated in the silent piano disclosed in U.S. Pat. Nos. 5,374,775 and 5,591,927.

Fifth Embodiment

Figure 30:
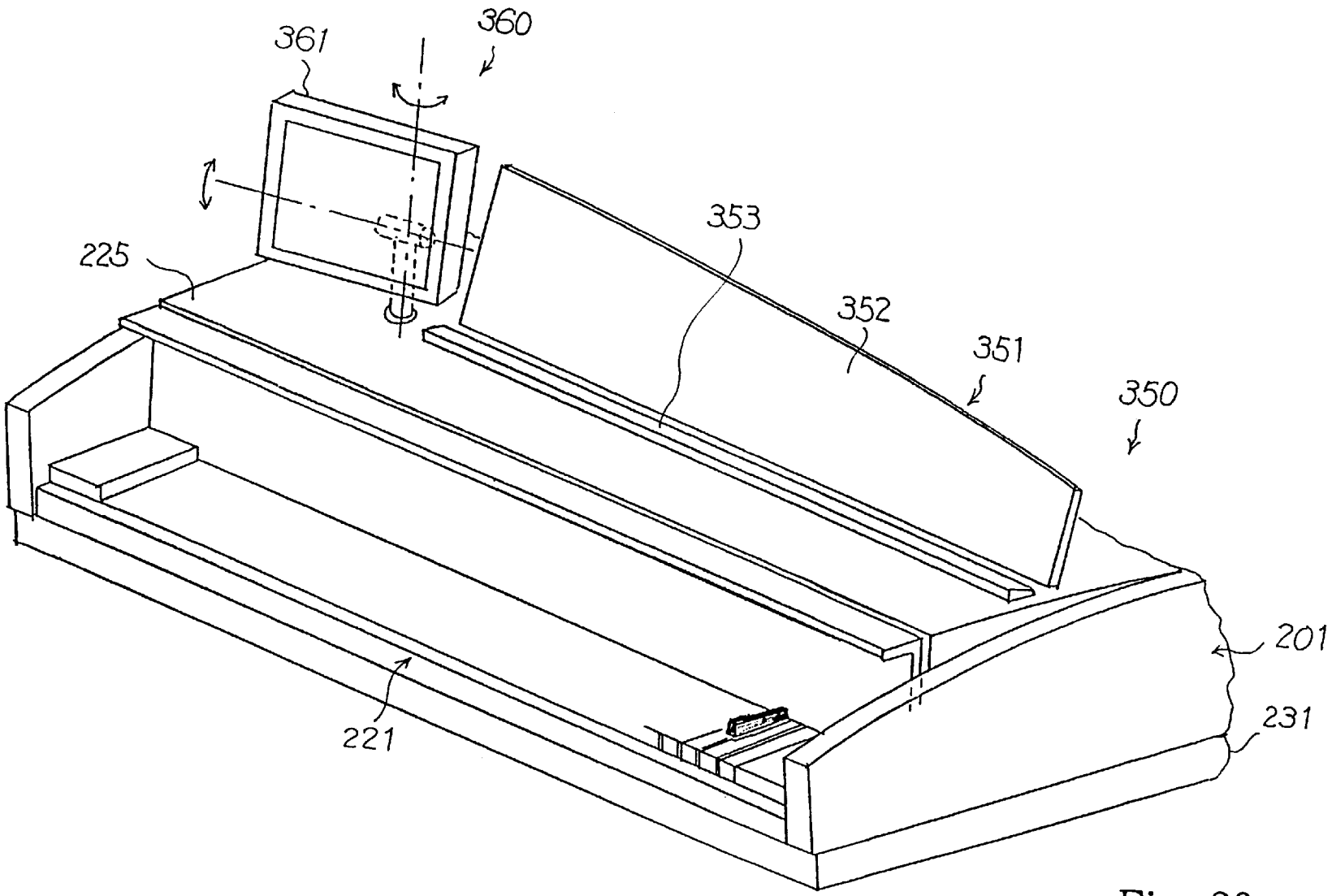
FIG. 30 is a perspective view showing a visual display independent of a music rack assembly incorporated in yet another grand piano according to the present invention.

Turning to FIG. 30 of the drawings, a keyboard musical instrument embodying the present invention comprises an acoustic piano 350 and an image producing system 360. In this instance, the acoustic piano 350 is a grand piano similar to that of the second embodiment except a music rack assembly 351, and component parts are labeled with the same references designating corresponding component parts of the second embodiment without description.

The music rack assembly 351 includes a desk board 352 and a ridge 353. The desk board 352 laterally extends on the front cover board 225, and is turnable as similar to the left portion 282. The ridge 353 is spaced from the bottom portion of the desk board 225, and extends in parallel to the desk board 352. The space between the desk board 352 and the ridge 353 is regulated in such a manner that a piano score or a score book stands against the desk board 353. The ridge 353 keeps the music score or the score book on the desk board 352, and allows a pianist to turn over the leaves of the music score.

The image producing system 360 includes a visual display 361. The other component parts of the image producing system are similar to those of the second embodiment. The visual display 361 is independent of the music rack assembly 351, and, accordingly, a pianist three-dimensionally changes the attitude of the visual display 361. The visual display 361 independent of the music rack assembly 351 according to the present invention is applicable to an electric keyboard, another acoustic keyboard musical instrument such as, for example, a harpsichord, the silent piano and an automatic playing piano.

Sixth Embodiment

Figure 31:
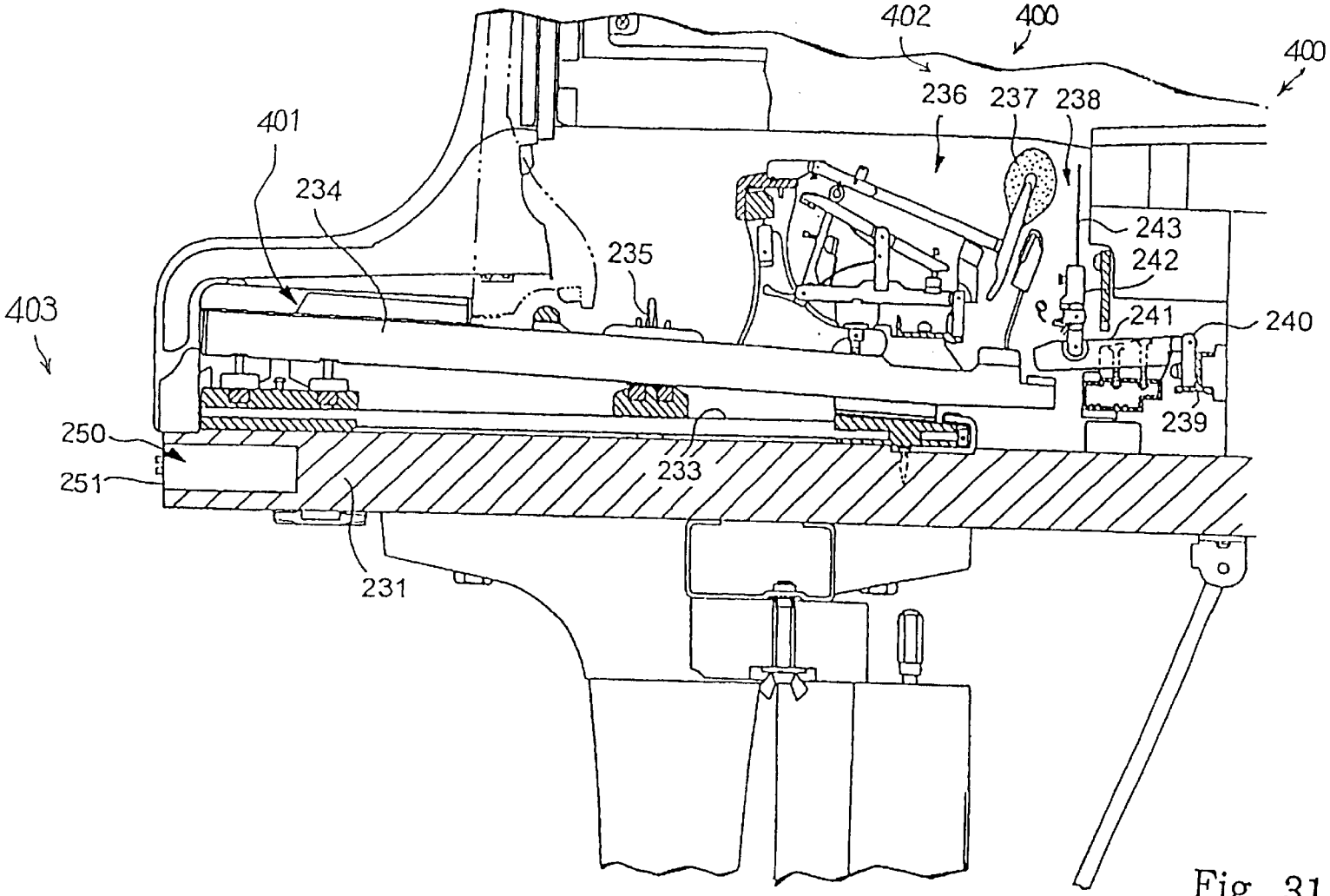
FIG. 31 is a cross sectional side view showing the inside of still another grand piano according to the present invention.
Figure 32:
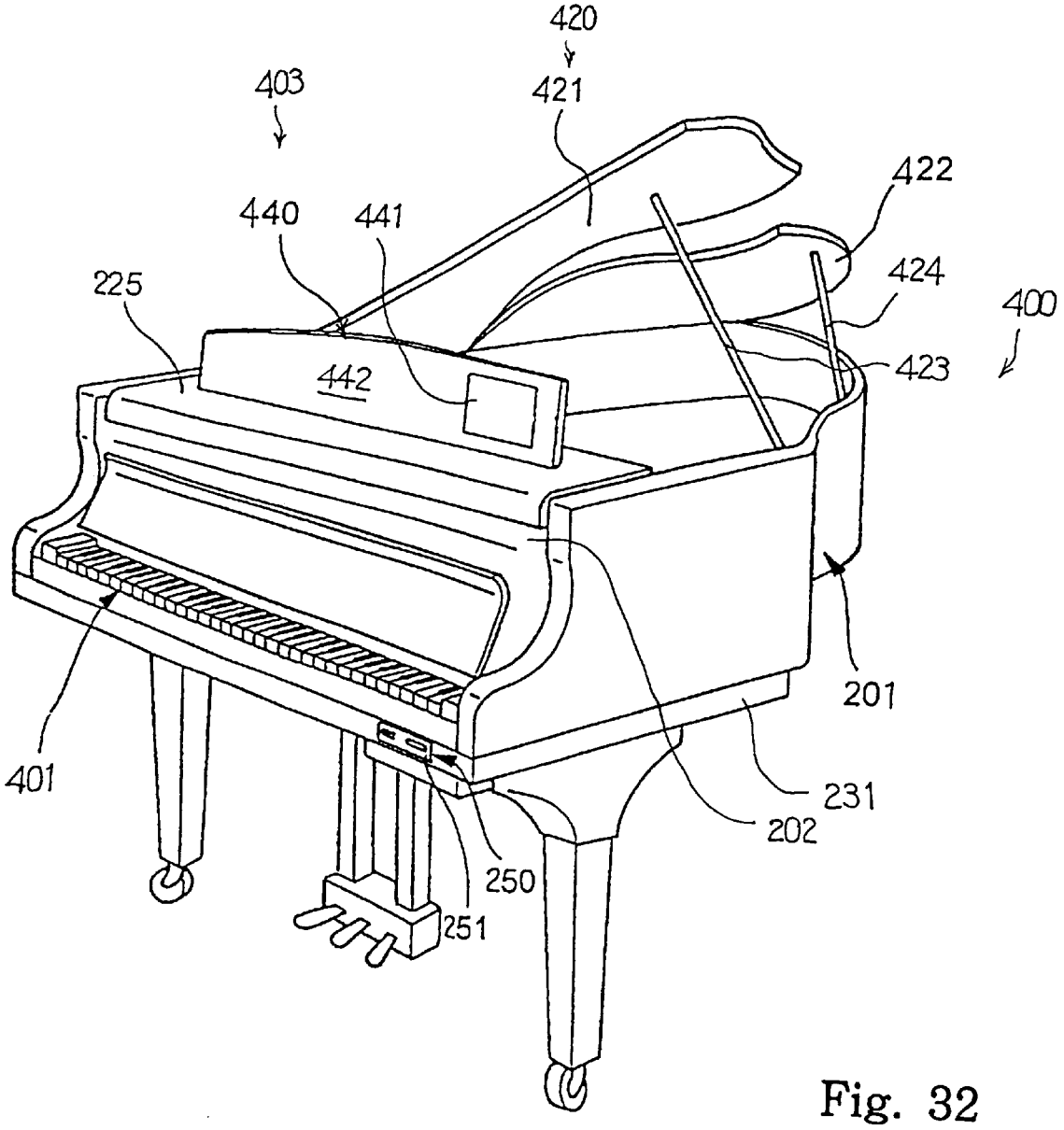
FIG. 32 is a schematic perspective view showing the appearance of the grand piano.
Figure 33:
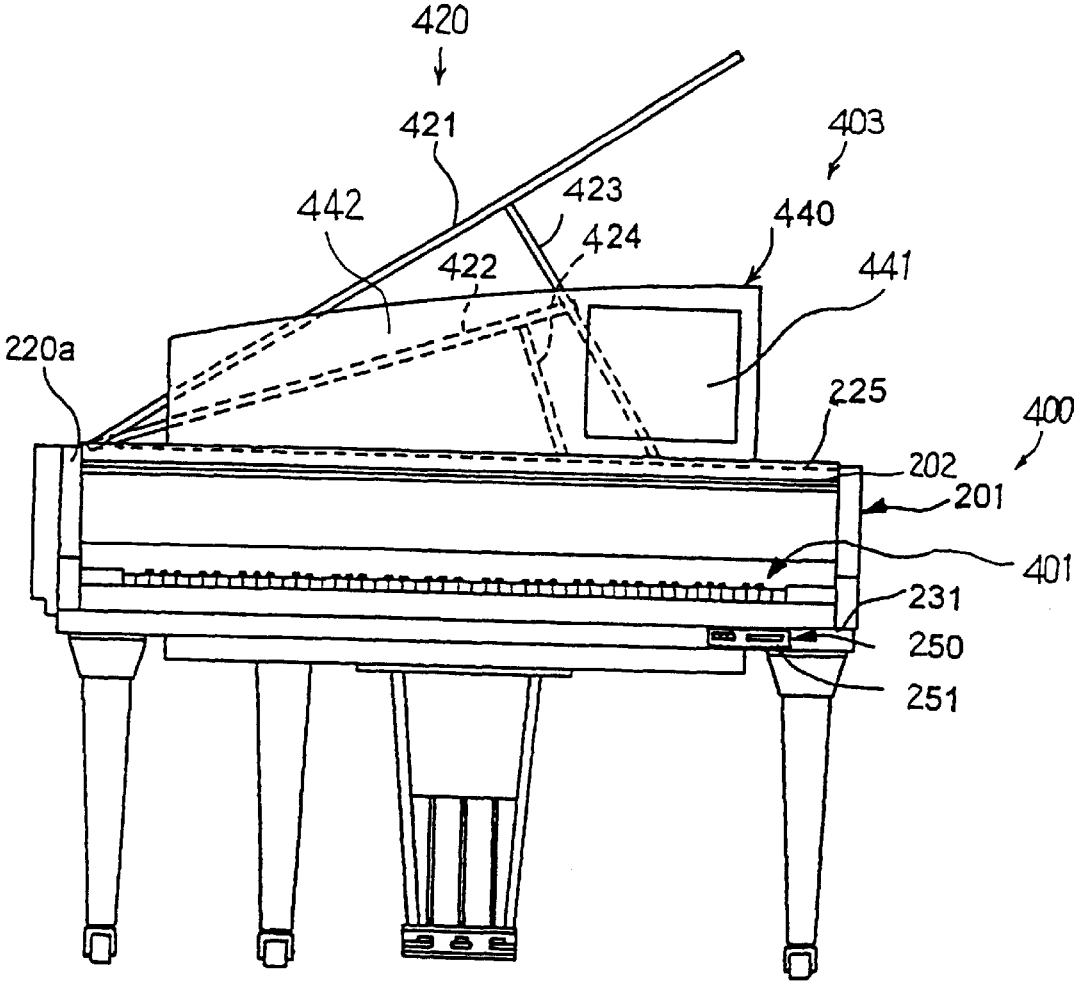
FIG. 33 is a front view showing the appearance of the grand piano from another angle.
Figure 34:
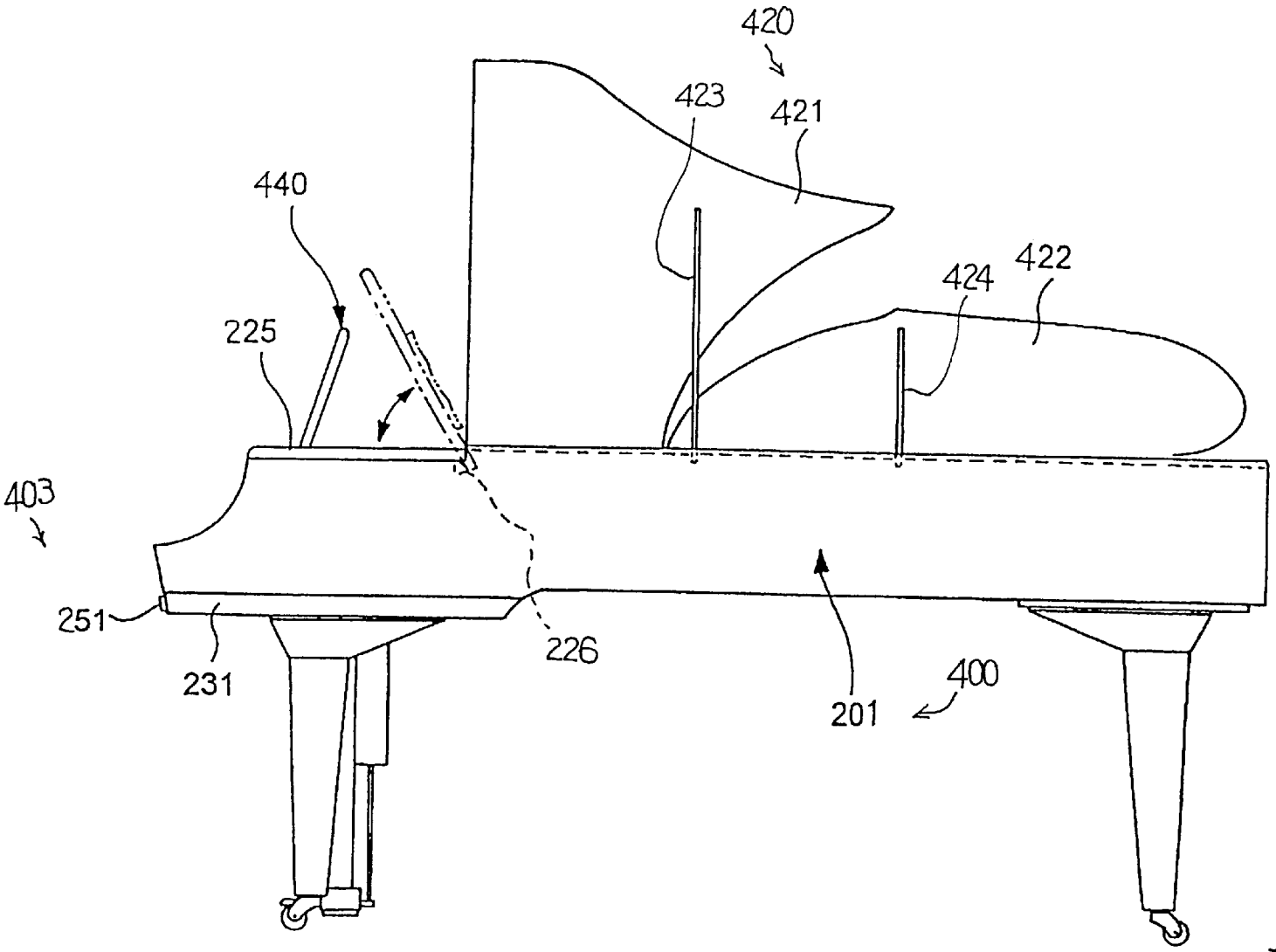
FIG. 34 is a side view showing the appearance of the grand piano from yet another angle.
Figure 35:
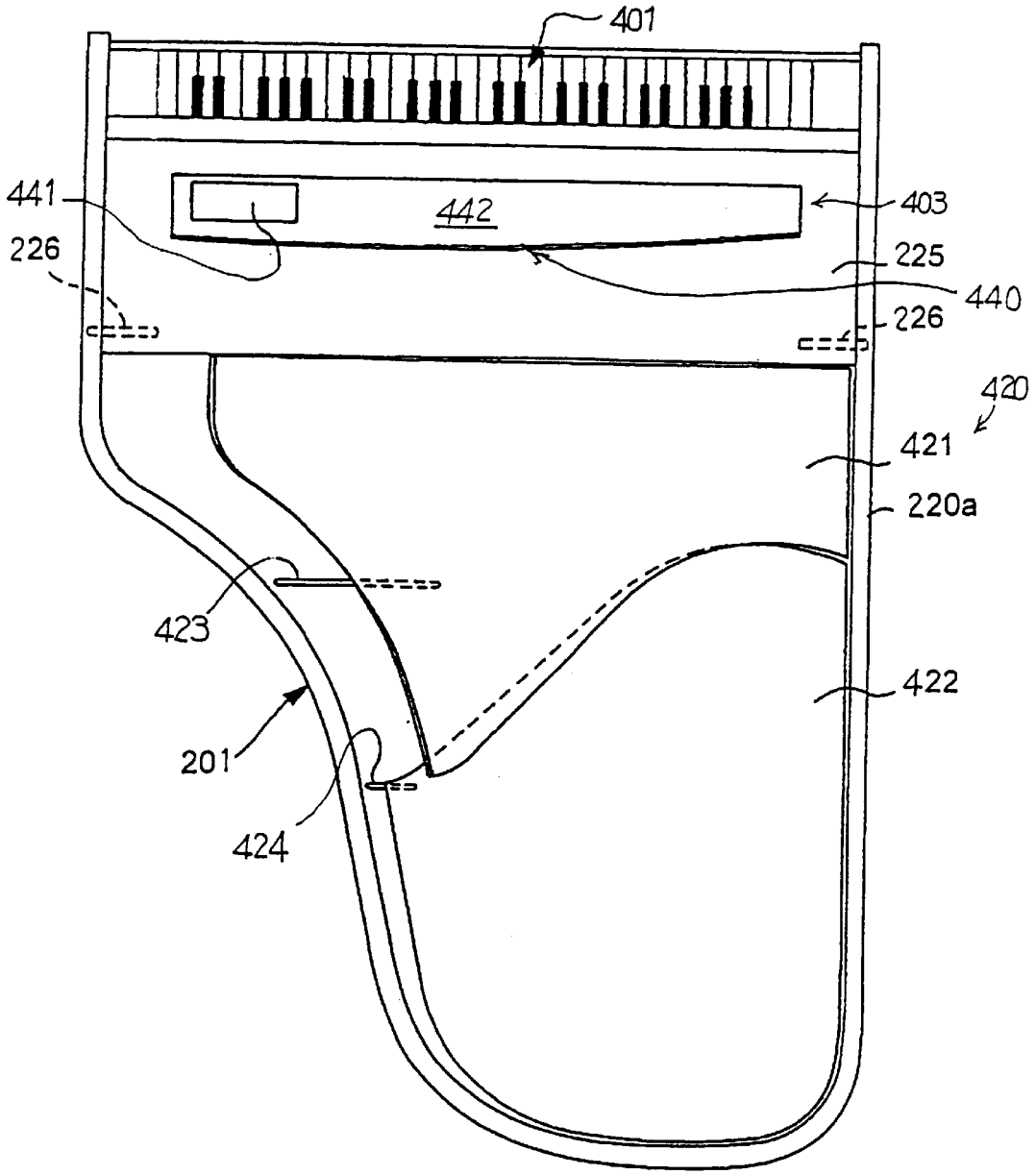
FIG. 35 is a plane view showing the appearance of the grand piano from still another angle.

Referring to FIG. 31 of the drawings, an acoustic piano embodying the present invention largely comprises a housing 400, a keyboard 401, a sound generating system 402 and an image producing system 403. In this instance, the acoustic piano is categorized in a grand piano, and the housing 400, the keyboard 401, the sound generating system 402 and the image producing system 403 are similar to those of the second embodiment. For this reason, boards and parts of the housing/the keyboard/the sound generating system/the image producing system 400/401/402/403 are labeled with the same references designating corresponding boards and corresponding parts of the second embodiment without detailed description.

FIGS. 32, 33, 34 and 35 show the appearance of the grand piano. The housing 400 defines an upper opening, and a pianist opens and closes a front cover board 225 and a split top board 420. When the pianist lowers the front cover board 225 and the split top board 420 onto the housing, the sound gencrating system 402 is enclosed inside the housing 400. On the other hand, when the pianist lifts the front end of the front cover board 225 and a side portion of the split top board 420, he inclines the front cover board 225 and the split top board 420 with respect to the housing, and the sound generating system 402 is exposed through the upper opening to the ambience.

The front cover board 225 is similar to that of the second embodiment, and is rotatably connected at both sides thereof to the side board 201 by means of the pins 226. For this reason, the front cover board 225 is labeled with the same reference. While a pianist is playing a tune on the keyboard 401, the front cover board 225 does not expose the sound generating system 402 to the ambience, and prevents the sound generating system 402 from dust and damages. The upper surface of the front cover board 225 is wide enough to put a metronome thereon.

The split top board 420 is similar to the split top board of the first embodiment, and the grand piano implementing the sixth embodiment is a combination of the first and second embodiments. In detail, the split top board 420 has a front sub-board 421 and a rear sub-board 422, and the front sub-board 421 and the rear sub-board 422 are independently hinged to the straight portion 220*a* of the housing 201. Lid prop assemblies 423/424 are hinged to the other side portion of the housing 400, and keep the sub-boards 421/422 inclined over the upper opening. Thus, the sub-boards 421/422 are selectively opened.

On the front cover board 225 is provided a music rack assembly 440 which is rotatably connected to the front cover board 225. The music rack assembly 440 extends in the lateral direction, and is wider than a music rack assembly of a standard grand piano. A visual display 441 is built into the right portion of the music rack assembly 440, and the remaining portion serves as a desk board 442 which a document such as, for example, a piano score stands against. In this instance, the video display 402 is implemented by a liquid crystal display. A ridge may be formed along the lower end of the music rack assembly 440 in order to make the document remain stationary. The visual display 441 forms a part of the image producing system 403.

Figure 36:
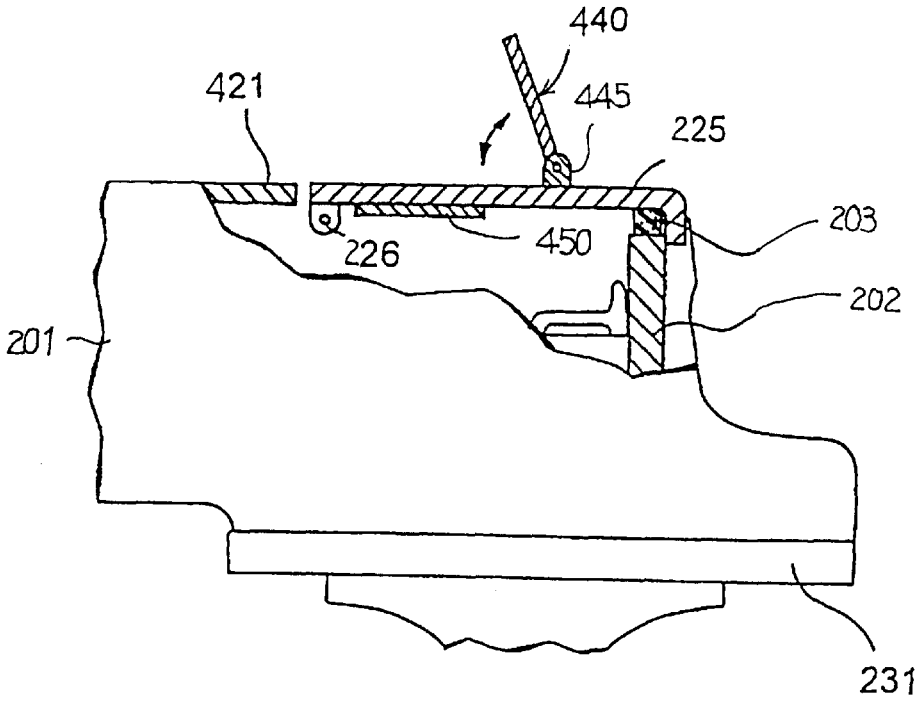
FIG. 36 is a partially cut-away side view showing a music rack assembly on a front cover board.

The upper beam 202 is wider than an upper beam of a standard grand piano, and a cushion 203 is attached to the upper edge of the upper beam 202. For this reason, the front cover board 225 offers a flat upper surface, and the music rack assembly 440 is rotatably supported by means of a display stand 445 on the flat upper surface as shown in FIG. 36. The music rack assembly 440 is laid on the flat upper surface of the front cover board 225. When a pianist uses the music rack assembly 440, he rotates the music rack assembly 440, and directs the front surface and the visual display 441 toward him. Thus, any rail member is not required for the music rack assembly 440, and the manufacturer can reduce the number of component parts.

A control box 450 is attached to the back surface of the front cover board 225, and forms a part of the image producing system 403. Though not shown in the drawings, a display driver is incorporated in the control box 450, and supplies scanning signals and image-carrying signals to the visual display 441. Thus, most of the component parts of the image producing system 403 are outside of the music rack assembly 440, and, accordingly, make the music rack assembly 440 light and thin.

Figure 37:
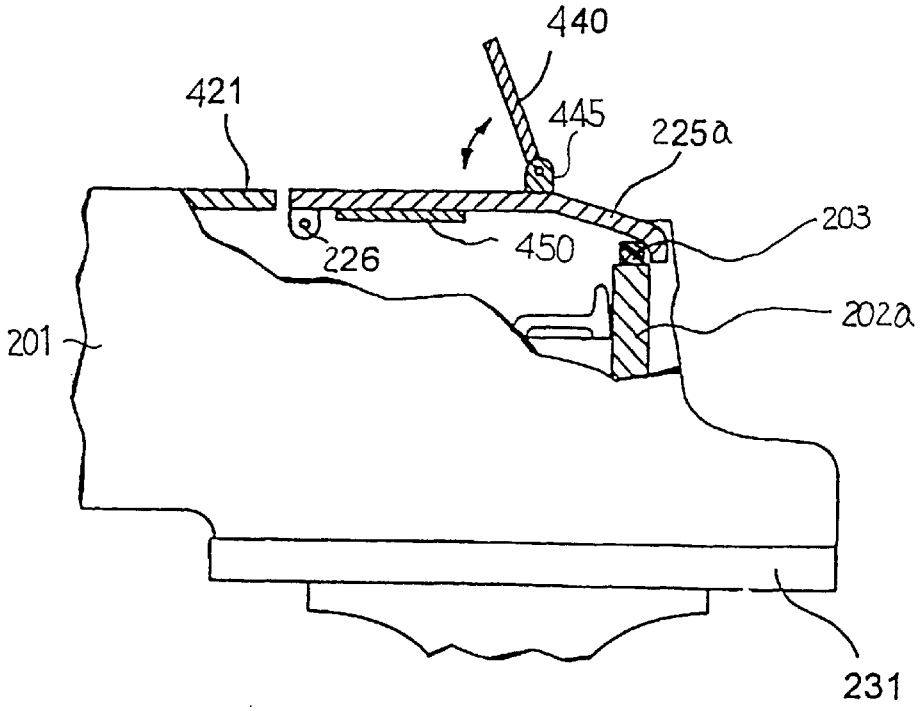
FIG. 37 is a partially cut-away side view showing the music rack assembly on another front cover board.

Of course, the upper mean 225*a* is available for the grand piano according to the present invention. In this instance, the front cover board 225 is replaced with a front cover board 225*a* as shown in FIG. 37. The front cover board 225*a* is bent so as to be brought into contact with the cushion 203 on the upper beam 202*a*.

A data processing unit 250 is connected through a suitable interface to a manipulating panel 251 and the control box 450, and the data processing unit 250 and the manipulating panel 251 form parts of the image producing system 403. The data processing unit 250 is accommodated in a space formed in the key bed 231, and the manipulating panel 251 is exposed to the pianist. Thus, only the manipulating panel 251 is exposed to the pianist, and the grand piano according to the present invention has an appearance like that of the standard grand piano.

Switches and a cursor controller are provided on the manipulating panel 251, and a slot is formed in the manipulating panel 251. A CD-ROM (Compact Disc Read Only Memory) disc is inserted into the slot, and is loaded onto a disc driver. The disc driver is also connected through the interface to the data processing unit 250, and transfers digital codes representative of pieces of information from the disc to a suitable memory incorporated in the data processing unit 250. The pieces of information relate to how to use the grand piano and how to tune the equalizer as will be described hereinlater.

Figure 38:
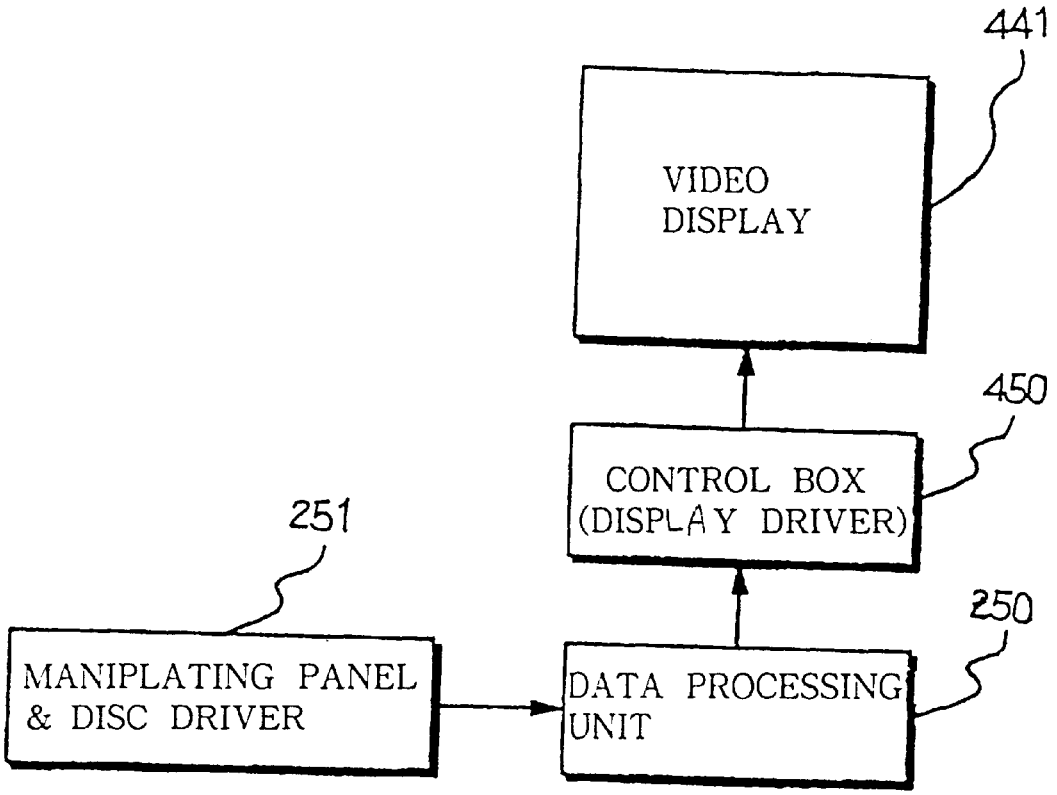
FIG. 38 is a block diagram showing an image producing system associated with the grand piano.

FIG. 38 illustrates the image producing system 403. The data processing unit 250 includes a microprocessor, a program memory, a working memory, an interface and a shared bus interconnecting the components. The digital codes are transferred from the disc through the interface to the working memory. The microprocessor periodically checks the manipulating board to see whether or not a pianist manipulates any one of the switches or the cursor controller. When the pianist wants prompt messages, he manipulates the switches on the manipulating board 251. Then, the image producing system 403 sequentially produces images on the visual display 441. The images may represent a sequence of questions. The data processing unit 250 instructs the display controller 450 to produce an image representative of a list of questions, and the pianist selects one of the questions. Then, the data processing unit 250 instructs the display driver 450 to produce an image representative of the next list of questions. When the pianist selects one of the next questions, the data processing unit 250 instructs the display driver 450 to produce an answer to the selected question. In this way, the pianist obtains the information from the image producing system 403. The information to be required is how to tune the equalizer or the split top board. The pianist establishes the grand piano into the desired mode through conversation with the data processing unit 250. Thus, the image producing system 403 serves as a prompter. The pianist may select the question through a touch panel produced on the screen of the visual display 441. Otherwise, the data processing unit 250 instructs the display driver 450 to produce a cursor on the screen, and periodically checks the manipulating panel 251 to see whether or not the pianist moves the cursor. If the pianist moves the cursor, the data processing unit 250 instructs the display driver to change the cursor to the position requested by the pianist. The data processing unit 250 further checks the manipulating panel 251 to see whether or not the pianist selects a question indicated by the cursor. If the pianist confirms the question, the data processing unit 250 proceeds to the next step. The questions are arranged in hierarchy. Of course, the questions may be listed.

Figure 39:
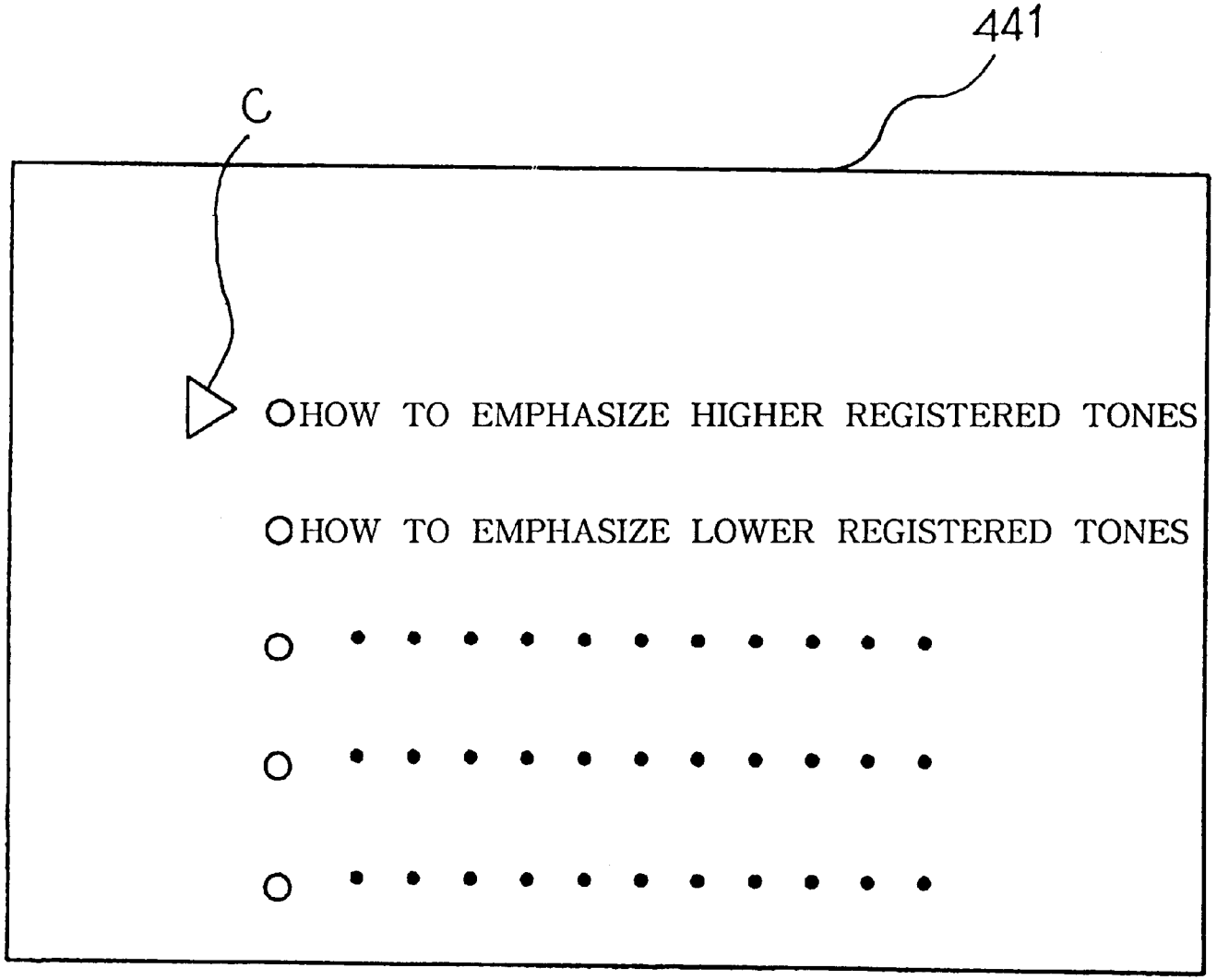
FIG. 39 is a view showing prompt messages produced on the visual display.

The pianist is assumed to request a piece of information regarding how to emphasize a register. When the pianist requests a list of questions to the data processing unit 250, the data processing unit 250 instructs the display driver 450 to produce images representative of the list of questions on the visual display 441 as shown in FIG. 39. The pianist is assumed to move the cursor C to the first question "HOW TO EMPHASIZE HIGHER REGISTERED TONES".

Figure 40:
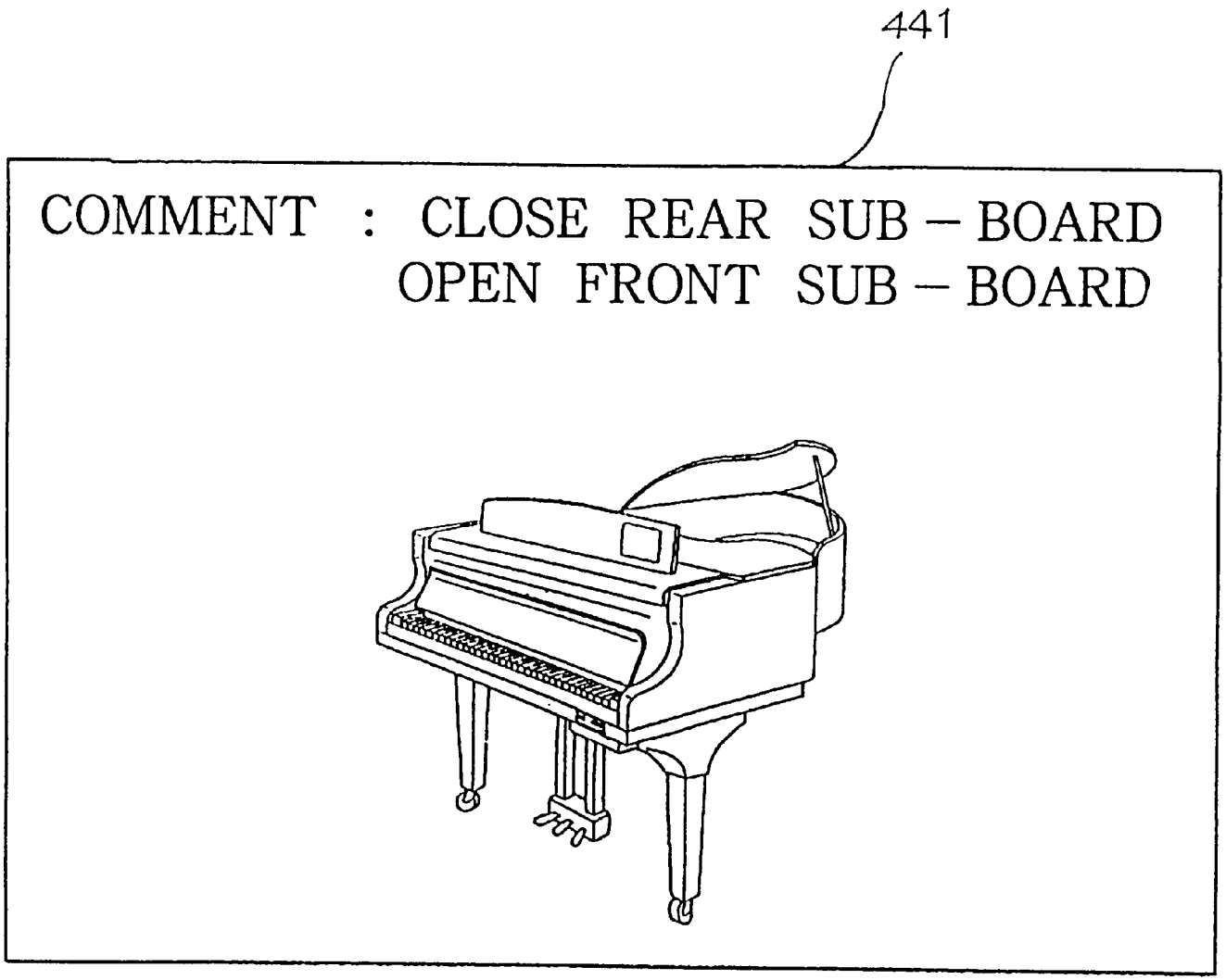
FIG. 40 is a view showing images produced on the visual display for emphasis of higher registered tones.

When the pianist confirms that the cursor C is indicative of the question which he has, the data processing unit 250 instructs the display driver 450 to produce images shown in FIG. 40 on the visual display 441. The image represents the grand piano where the front sub-board 421 and the rear sub-board 422 are respectively opened and closed, and a comment is given as "CLOSE REAR SUB-BOARD. OPEN FRONT SUB-BOARD." Even though the pianist is a beginner, he can understand how to tune the equalizer or the split top board from the image of grand piano.

Figure 41:
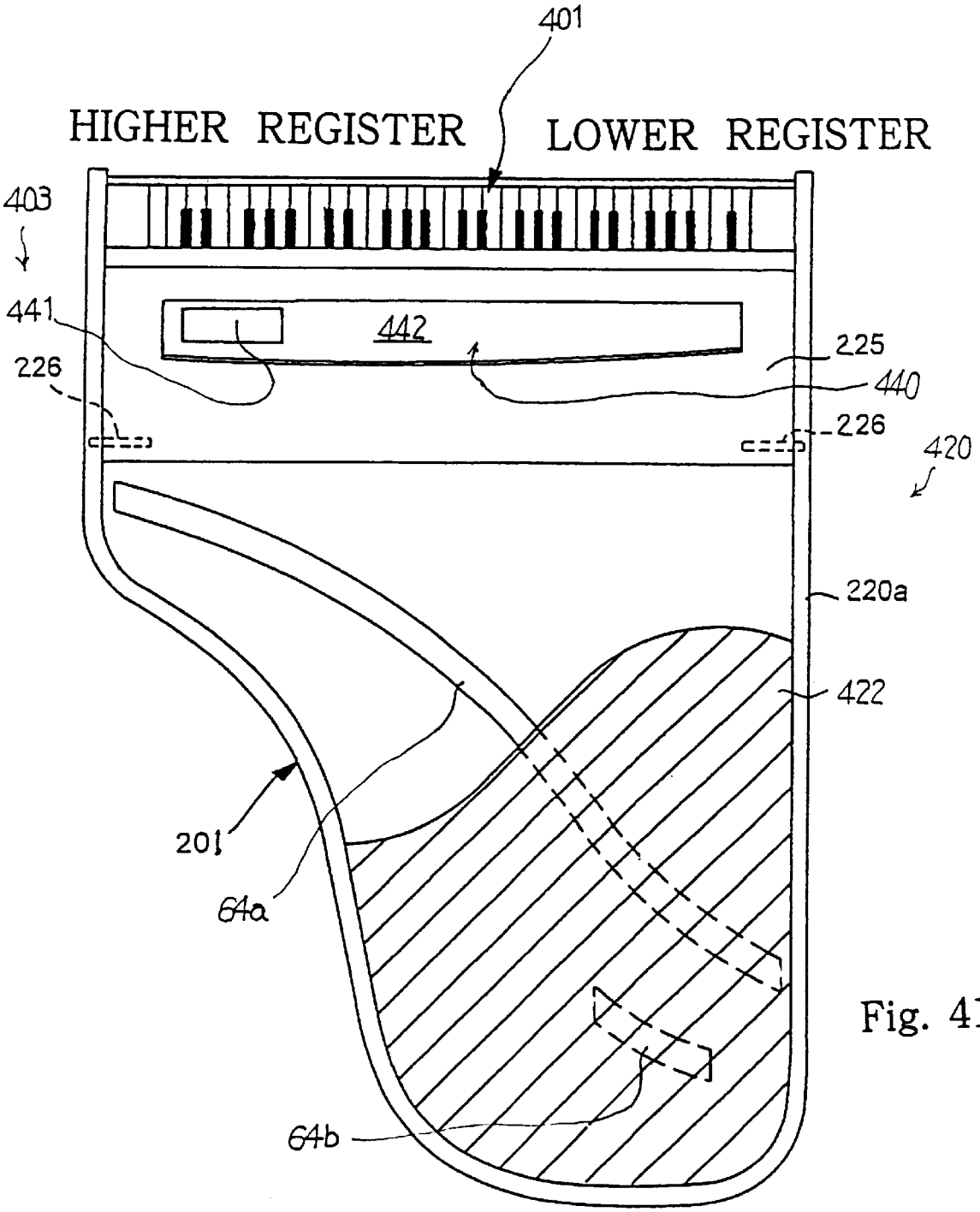
FIG. 41 is a plane view showing the grand piano tuned in accordance with the images.

The pianist lifts the front sub-board 421, and keeps it inclined by means of the lid prop assembly 423 as shown in FIG. 41. The pianist keeps the rear sub-board 422 closed. The front sub-board 421 radiates the higher registered tones, and the rear sub-board 422 impedes the radiation of lower registered tones. As a result, the higher registered tones are emphasized. The split line between the sub-boards 421 and 422 crosses the treble bridge 64*a* around the mid point thereof at right angle. The mid point virtually splits the treble bridge 64*a* into the left part and the right part, and the left part is convexly curved toward the pianist who sits on a chair in front of the keyboard 401.

Sensors may be provided in association with the sub-boards 421/422. In this instance, the sensors have informed the data processing unit 250 of the current status of the split top board 420. The data processing unit 250 instructs the display driver 450 to sequentially produce images representative of the manipulation to be required. The motion picture makes the pianist exactly understand how to tune the equalizer.

The data processing unit 250 may instruct the display driver to produce characters representative of the names of the parts such as "FRONT SUB-BOARD" and "REAR SUB-BOARD" beside the image of grand piano.

Figure 42:
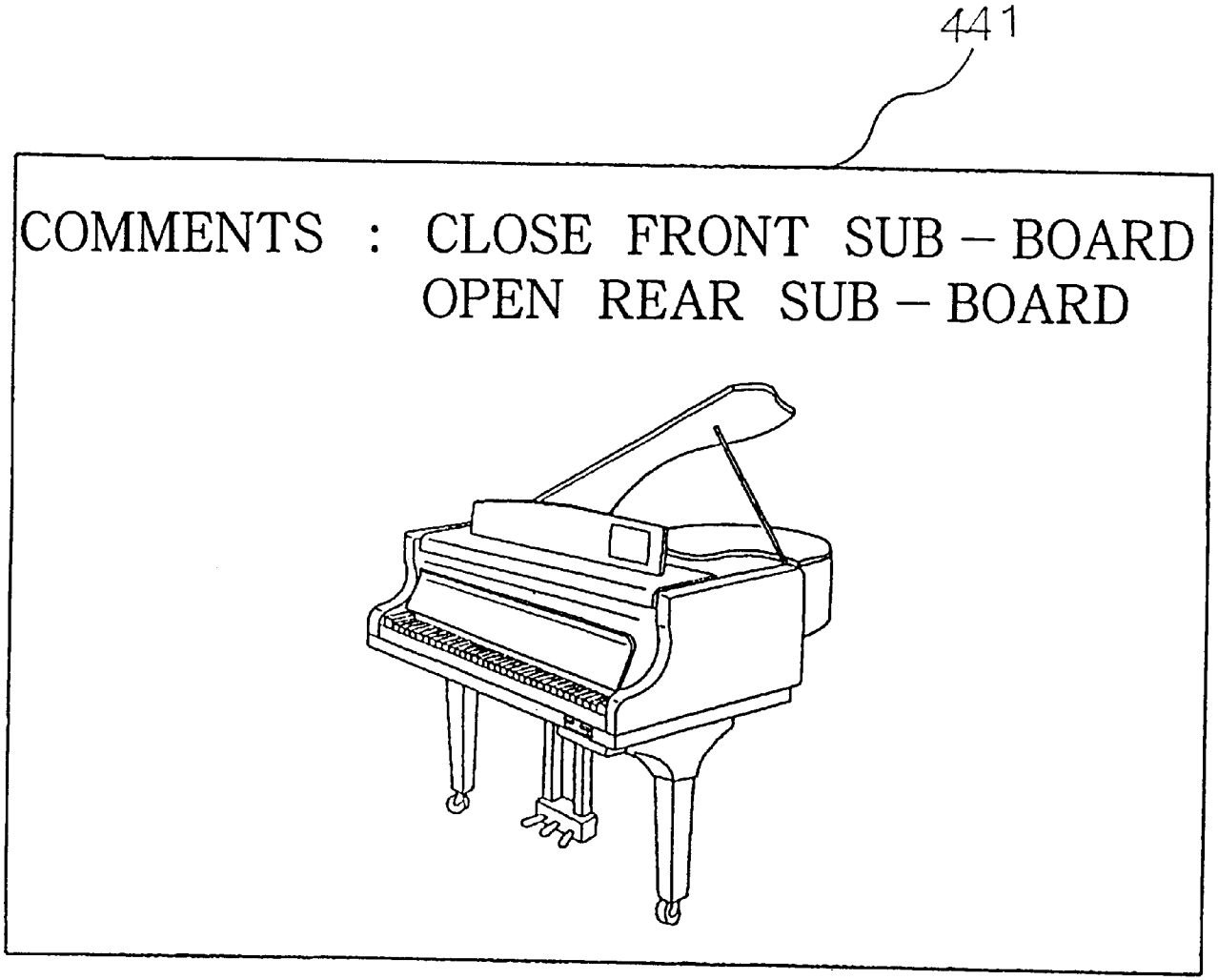
FIG. 42 is a view showing images produced on the visual display for emphasis of lower registered tones.

On the other hand, the pianist is assumed to move the cursor to the second question "HOW TO EMPHASIZE LOWER REGISTERED TONES". When the pianist confirms that the cursor is indicative of the question which he has, the data processing unit 250 instructs the display driver to produce images on the visual display 441 as shown in FIG. 42. The image of grand piano has the front sub-board 421 and the rear sub-board 422, which are closed and opened, respectively, and the messages are read as "CLOSE FRONT SUB-BOARD. OPEN REAR SUB-BOARD".

Figure 43:
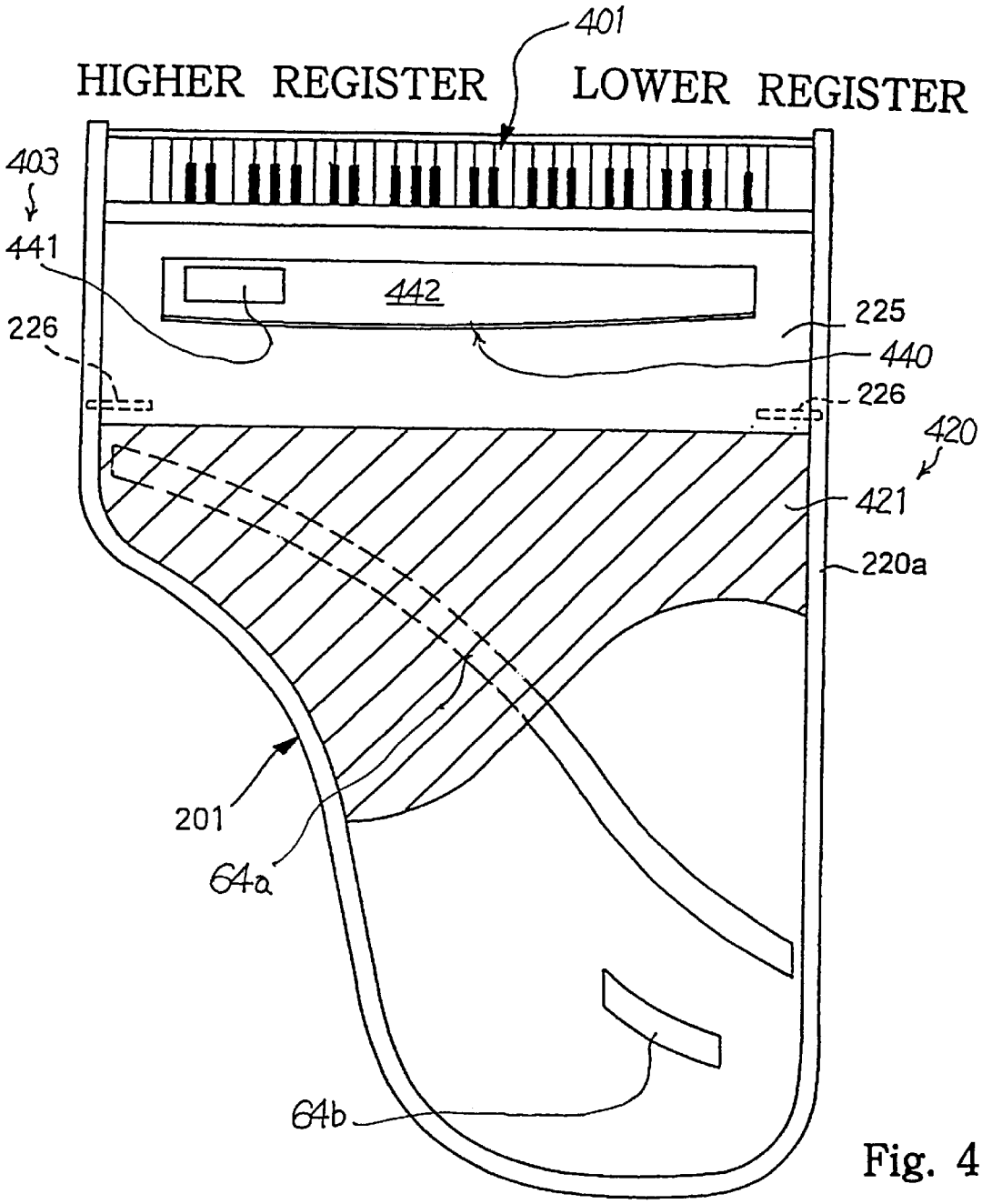
FIG. 43 is a plane view showing the grand piano tuned in accordance with the images.

The pianist opens the rear sub-board 422, and closes the front sub board 421 in accordance with the comments (see FIG. 43). The closed front sub-board 421 impedes the radiation of the higher registered tones. However, the rear sub-board 422 allows the strings to radiate the lower registered tones to the ambience. As a result, the lower registered tones are emphasized.

When the pianist requests an answer to the question that how he decreases the loudness of all the tones, the data processing unit 250 instructs the display driver to produce an image of piano with closed sub-boards 421/422 and a message read as "CLOSE BOTH SUB-BOARDS".

Although the split top board 420 is not familiar with pianists, the pianist obtains the information from the visual display 441, and easily establishes the grand piano to a desired emphasizing mode.

The data processing unit 250 is further responsive to the inquiry that how the pianist plays the grand piano. The inquiry may relate to the damper pedal. The data processing unit 250 instructs the display driver 450 to produce an image of grand piano with the damper pedal indicated by an arrow and comments for teaching an effect imparted to the piano tones.

Seventh Embodiment

Figure 44:
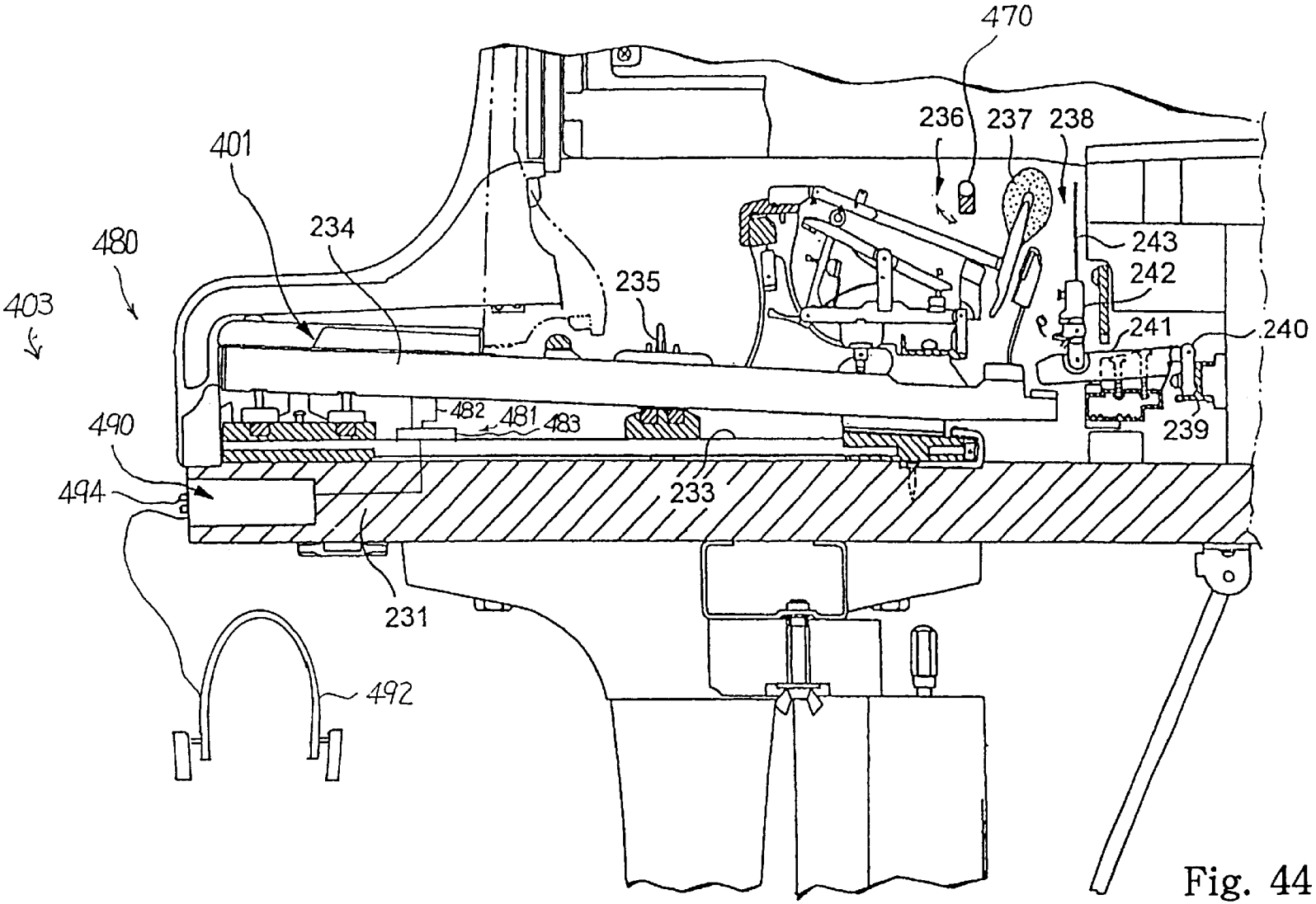
FIG. 44 is a cross sectional side view showing the inside of a silent piano according to the present invention.

Turning to FIG. 44 of the drawings, a silent piano is fabricated on the basis of the grand piano implementing the sixth embodiment. The silent piano has the split top board 420 and the image producing system 403. For this reason, component parts corresponding to those of the sixth embodiment are labeled with the same references without detailed description.

Figure 45:
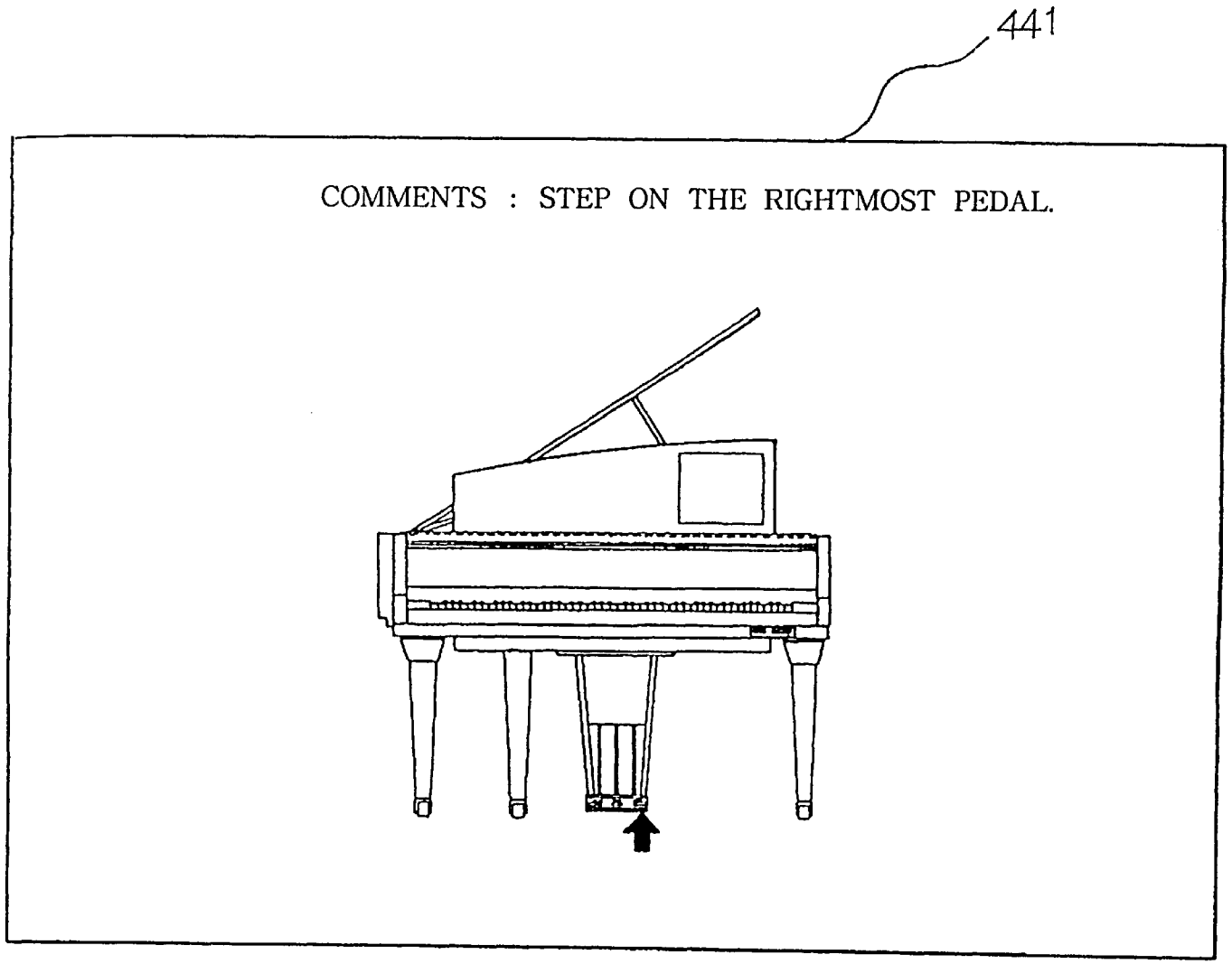
FIG. 45 is a view showing images produced on a visual display for a silent mode.

The silent piano further comprises a silent system and an electronic sound generating system 480. The silent system includes a hammer stopper 470 laterally extending over the hammer shanks, a pedal and a link mechanism. The hammer stopper 470 is linked with the pedal (see FIG. 45), and is changed between a free position and a blocking position. Accordingly, the silent piano is selectively established in an acoustic sound mode and a silent mode. While the hammer stopper 470 is staying in the free position, the hammers 237 strike the associated sets of strings. However, when the pianist changes the hammer stopper 470 to the blocking position, the hammers 237 rebound on the hammer stopper 470 before striking the strings, and any piano tone is generated from the strings.

The electronic sound generating system 480 includes key sensors 481, which are respectively associated with the black/white keys 234. Each of the key sensors 481 is implemented by a combination of a shutter plate 482 and a photo-coupler 483. The shutter plate 482 is attached to the lower surface of the associated black/white key 234, and the photo-coupler 483 radiates a light beam across the trajectory of the associated black/white key 234. When the pianist selectively depresses a black/white key 234, the shutter plate 482 interrupts the light beam, and gradually reduces the amount of photo-current generated in the photo-coupler 483. The photo-current is converted to a potential, and the potential is varied depending upon the current key position. Thus, the key sensors 481 monitors the associated black/white keys 234, and produce key position signals representative of the current key positions.

The electronic sound generating system 480 further includes a controller 490 and a headphone 492. The controller 490 is shared between the electronic sound generating system 480 and the image producing system 403. For this reason, switches for the electronic sound generating system 480 are provided on a manipulating panel 494 together with the switches and the slot for the image producing system 403.

The controller 490 serves as similar to the data processing unit 250, and instructs the display driver 450 to produce images. In this instance, the controller 490 periodically scans the interface to see whether or not any one of the black/white keys 234 changes the current key position, and determines the key code assigned to each depressed black/white key 2334. Furthermore, the controller 490 calculates the key velocity for each depressed black/white key 234, and decides a timing for generating an electronic sound and a timing to decay the electronic sound. The controller 490 has a tone generator, and the tone generator produces an audio signal from the pieces of music data information. The audio signal is supplied to the headphone 492, and the headphone 492 generates an electronic sound.

In this instance, the image producing system 403 teaches the pianist how to play a tune without any piano tones. When the pianist requests the image producing system 403 to teach how he changes the silent piano to the silent mode, the controller 490 instructs the display driver 450 to produce images shown in FIG. 45. An image of silent piano is accompanied with an arrow, which indicates the rightmost pedal. A message reads "STEP ON THE RIGHTMOST PEDAL". The rightmost pedal is linked with the hammer stopper 470. When the pianist steps on the rightmost pedal, the hammer stopper 470 is changed to the blocking position, and prohibits the strings from the vibrations due to the strikes with the hammers 237. Thus, even if a pianist is not familiar with the silent system, the image producing system 403 teaches the pianist how to establish the silent piano into the silent mode, and he can practice the fingering without piano tones.

The silent system may have a sensor for detecting the current position of the hammer stopper 470. When the sensor detects the hammer stopper 470 enters into the blocking position, the sensor supplies a detecting signal to the controller 490. In this instance, the controller 490 instructs the display driver to keep the images shown in FIG. 45 until the sensor detects the hammer stopper 470 in the blocking position. When the detecting signal arrives at the controller 490, the controller 490 instructs the display driver to produce a message such as "Enjoy a silent performance".

The silent system may have a mute mode. The hammer stopper 470 is positioned between the free position and the blocking position, and the hammers 237 are brought into contact with the hammer stopper concurrently with striking the strings. Thus, the hammers 237 faintly strike the strings, and soft piano tones are radiated from the strings. When a pianist inquiries how to establish the silent piano to the mute mode, the controller 490 instructs the display driver to produce an appropriate image and message on the visual display 441.

Figure 46:
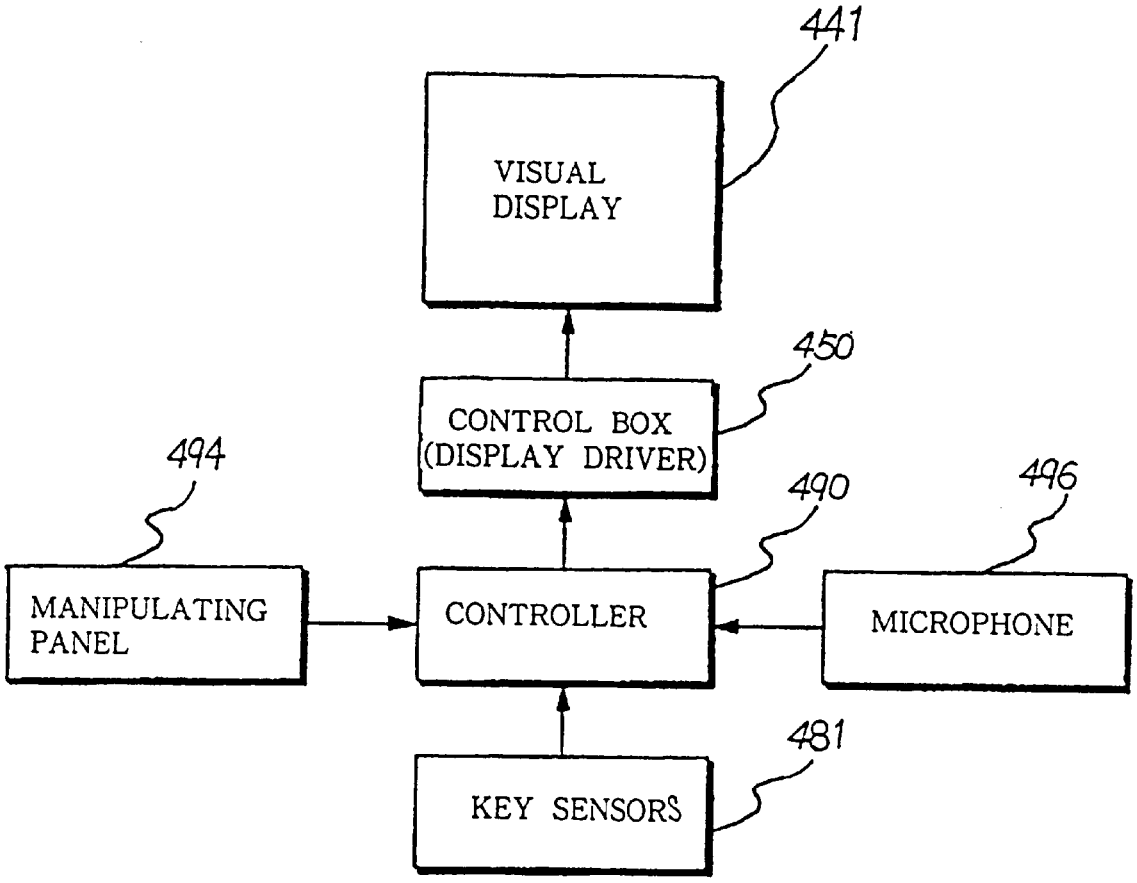
FIG. 46 is a block diagram showing a modification of the image producing system.

The image producing system 403 may teach how to tune the silent piano. Of course, the image producing systems incorporated in the second to fifth embodiments may also teach how to tune the grand piano. The image producing system may give instructions for other maintenance works to an operator through the visual display 441. FIG. 46 shows a modification of the image producing system responsive to the request for guiding a tuning work. A microphone 496 is connected to the interface of the controller 490, and picks up piano tones radiated from the strings.

In the tuning work, an operator is assumed to request the controller 490 to guide the tuning work. The controller 490 instructs the display driver 450 to produce a message read as "DEPRESS KEY". The operator depresses one of the black/white keys 234, and a piano tone is generated from the associated set of strings. The key sensor 481 detects the key motion, and reports the depressed black/white keys 234 to the controller 490. The controller 490 specifies the key code assigned to the depressed black/white key 234, and reads out a set of digital data codes representative of pieces of music data information from the memory for the depressed black/white key 234. The microphone 496 picks up the piano tone, and supplies an electric signal representative of the piano tone to the controller 490. The controller 490 analyzes the electric signal for the attributes such as a pitch and a beat, and produces a set of digital data codes. The controller 490 compares the digital data codes with the digital data codes read-out from the memory to see whether or not a unison tuning, an octave tuning and other tuning works are to be required, and diagnoses the set of strings associated with the depressed key 234. The controller 490 instructs the display driver to produce characters representative of the diagnosis, and the characters are produced on the visual display 441. The diagnosis may indicate a deviation from the target pitch such as, for example, "−5 cent".

The image producing system 403 may store intervals between the tuning works. The intervals are fixed, or are variable together with frequency in use, by way of example. In this instance, the sets of digital data codes, the microphone 496 and the key sensors 481 are unnecessary for the image producing system 403, and the image producing system is made simple. The controller 490 compares the lapse of time from the previous tuning work with the interval to see whether or not the silent/grand piano requires a tuning work. If the tuning work is to be required, the controller 490 instructs the display controller 450 to produce a message on the visual display 441.

Figure 47:
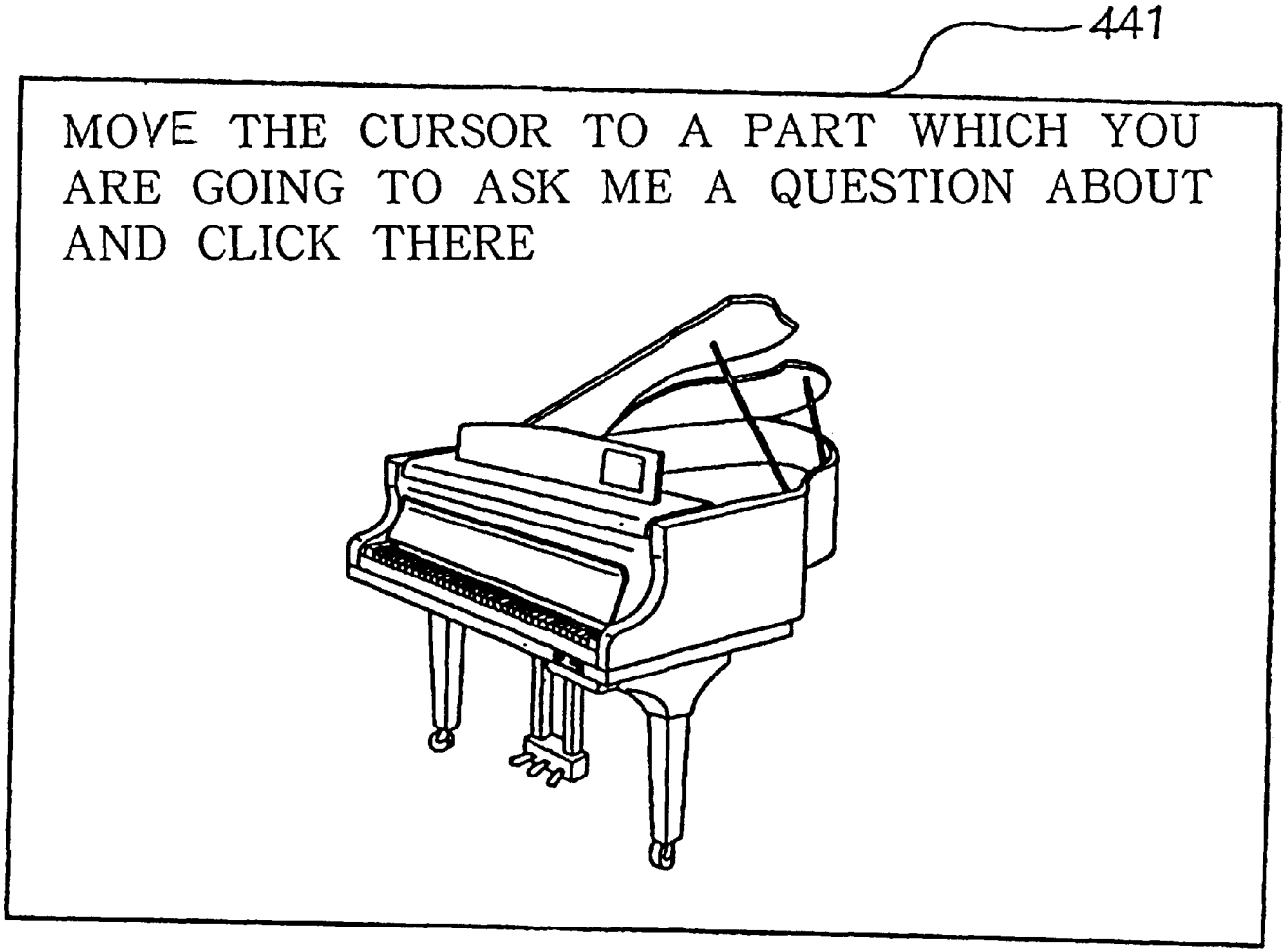
FIG. 47 is a view showing an image and a message for urging a pianist to put a question.

The image producing system 403 may urge a pianist to input a question through images shown in FIG. 47. An image of silent/grand piano and a message "MOVE THE CURSOR TO A PART WHICH YOU ARE GOING TO ASK ME A QUESTION ABOUT, AND CLICK THERE" are produced on the visual display 441. When the pianist moves a cursor to a part such as the split top board and clicks there, the controller 490 instructs the display driver to produce a list of questions or messages/comments together with an image on the visual display 441. If the pianist has a question about the split top board, he moves the cursor to the split top board, and clicks there. Then the controller 490 instructs the display driver to produce the image of silent/grand piano, the name of the board and further questions.

Figure 48:
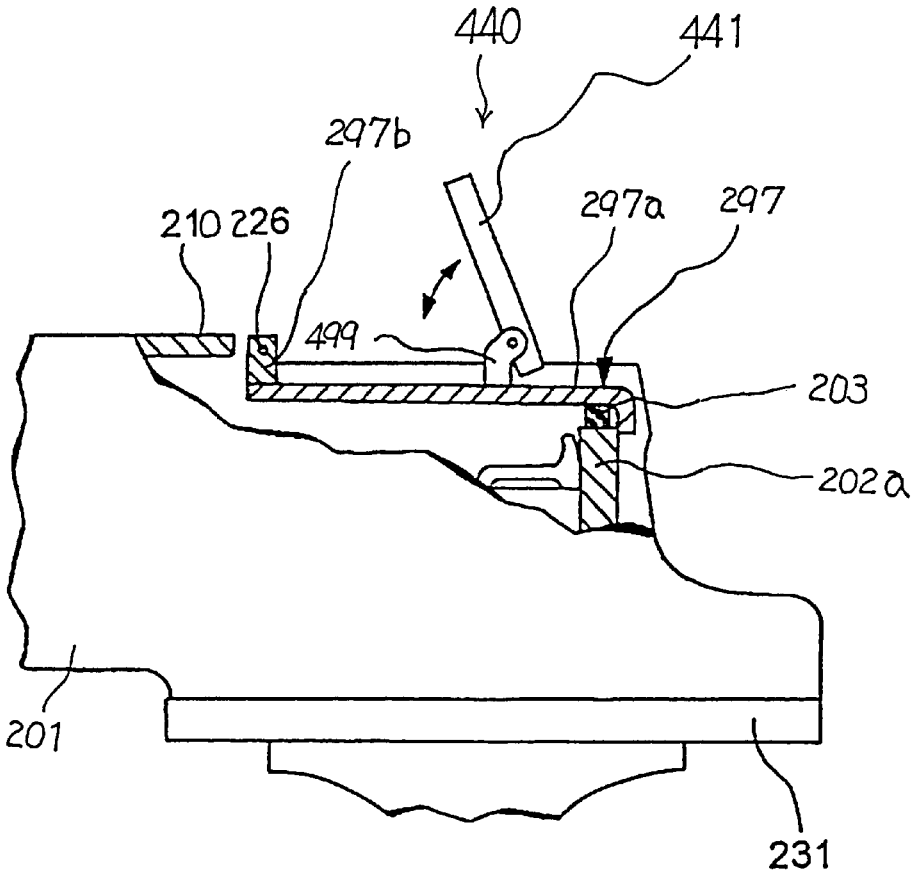
FIG. 48 is a partially cut-away side view showing a modification of the silent piano.

The front cover board 225 may be replaced with a front cover board 297 shown in FIG. 48. The front cover board 297 has a generally L-letter shaped cross section, and a flat cover plate 297*a* is connected to a connecting plate 297*b* at right angle. The connecting plate 297*b* is connected at both sides thereof to the side board 201 by means of the pins 226, and a display stand 499 is fixed to the flat cover plate 297*a*. The visual display 411 is rotatably supported by the display stand 499, and a pianist freely inclines the visual display 211 with respect to the flat cover plate 297*a*. The flat cover plate 297*a* is lower than the front cover board 225, and the manufacturer uses the upper beam 202*a* of the standard grand piano. However, the display stand 499 keeps the visual display 411 as high as the visual display 411 on the front cover board 225. Thus, the front cover board 297 allows the manufacturer to use the upper beam 202*a* of the standard grand piano without sacrifice of the visual angle.

Eighth Embodiment

Figure 49:
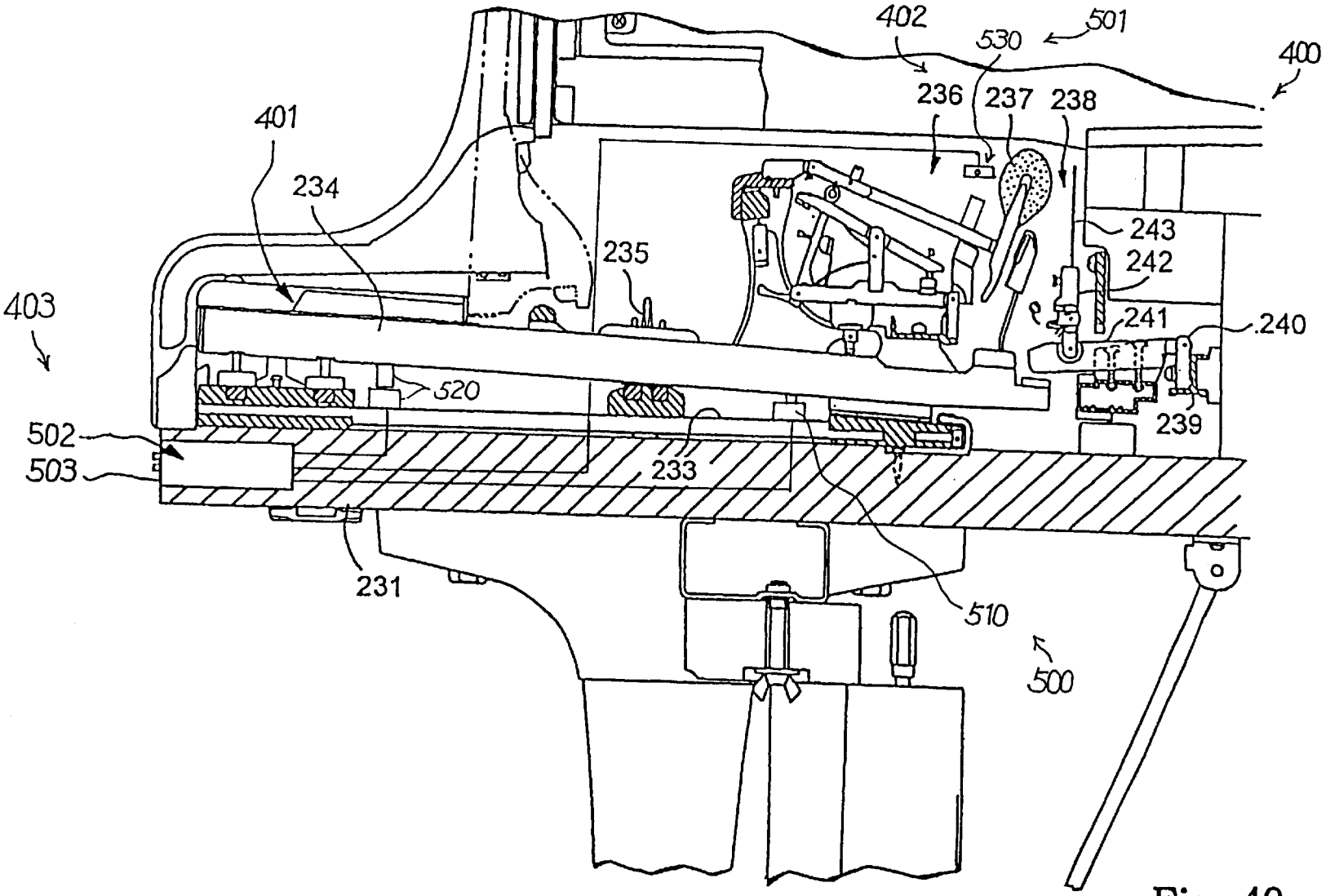
FIG. 49 is a cross sectional side view showing an automatic playing piano according to the present invention.
Figure 51:
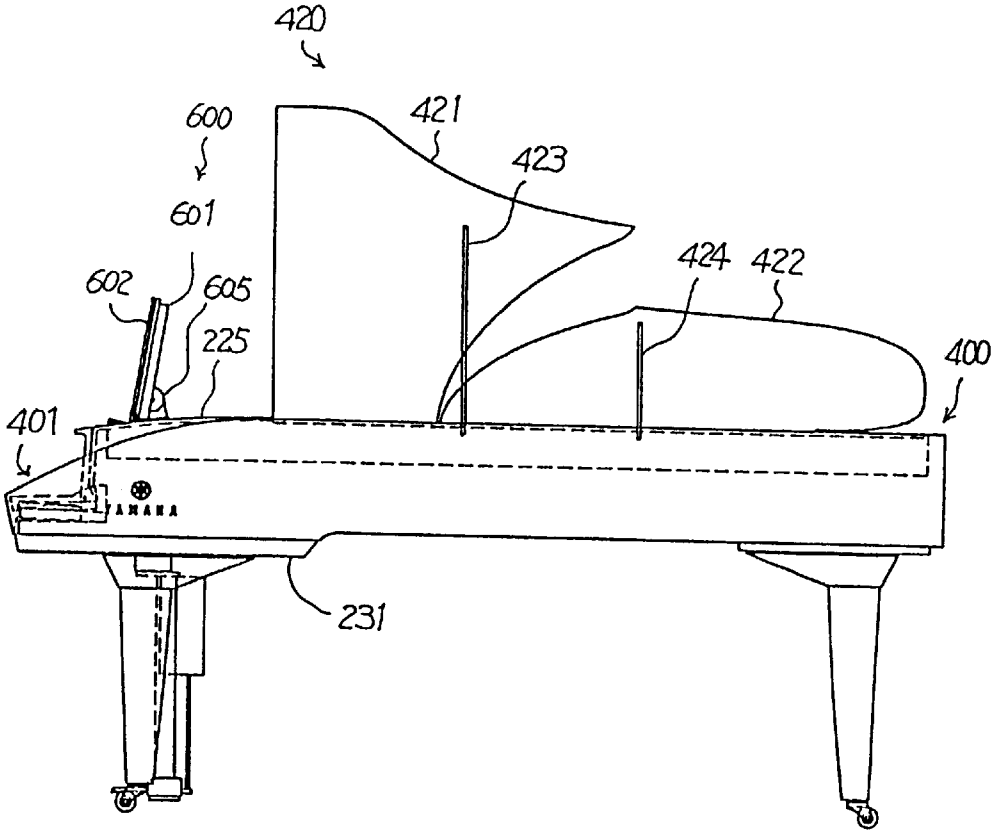
FIG. 51 is a side view showing the keyboard musical instrument shown in FIG. 50.
Figure 50:
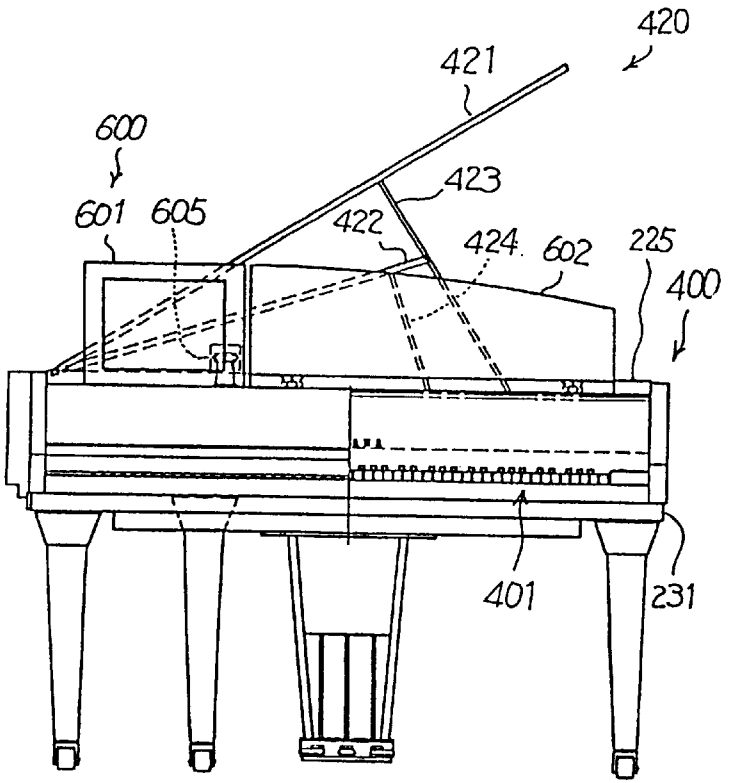
FIG. 50 is a front view showing one of the grand piano, the silent piano and the automatic player piano according to the present invention.
Figures 52, 53:
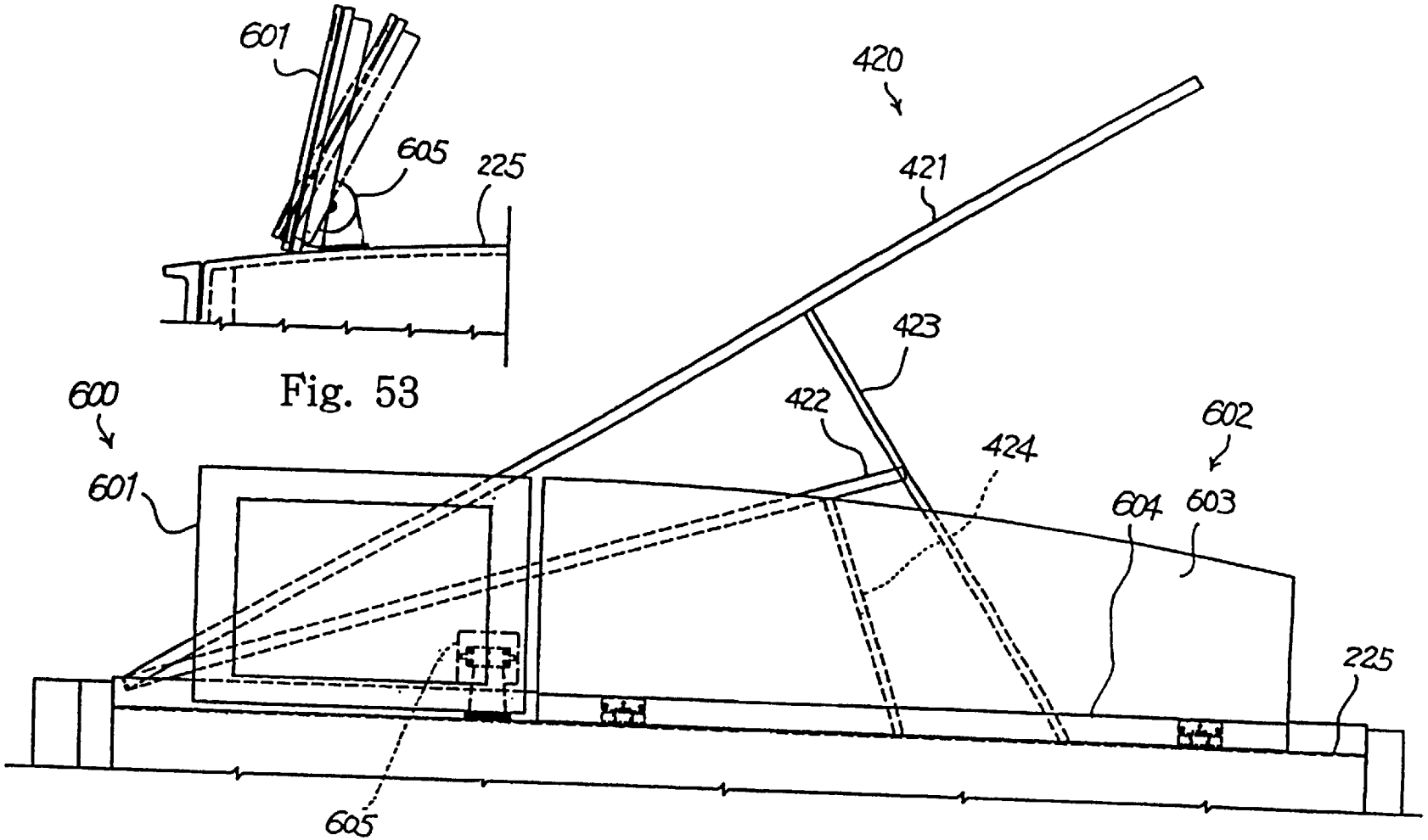
FIG. 52 is a front view showing the visual display incorporated in the keyboard musical instrument.
FIG. 53 is a side view showing the visual display.
Figure 54:
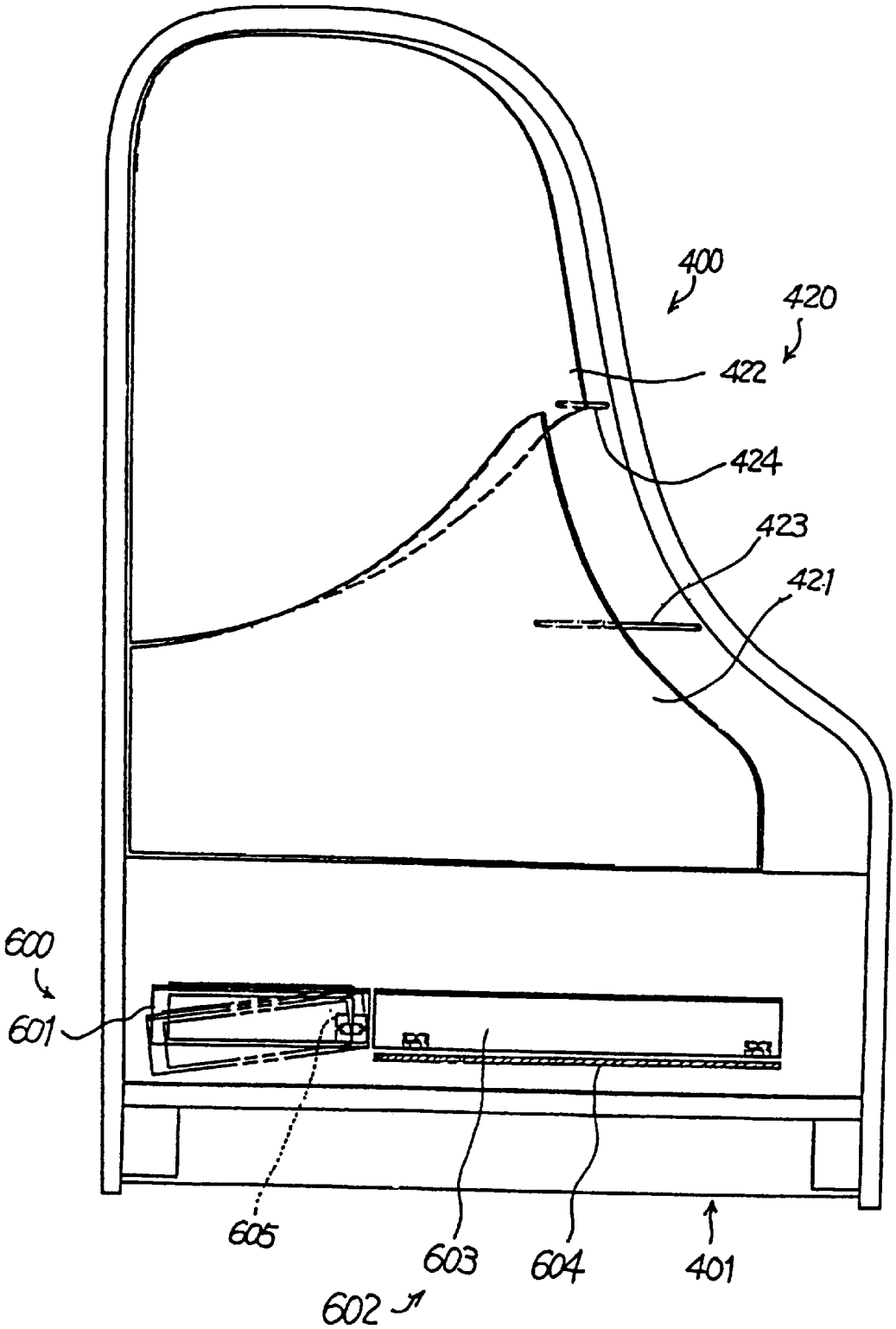
FIG. 54 is a plane view showing the keyboard musical instrument.

Turning to FIG. 49 of the drawings, an automatic player piano is fabricated on the basis of the grand piano implementing the sixth embodiment. However, the split top board 421 may be replaced with a standard non-split top board. An automatic playing system 500 and a recording system 501 are incorporated in the automatic player piano, and a controller 502 is shared between the image producing system 403, the automatic playing system 500 and the recording system 501. The controller 502 is connected to a manipulating panel 503, and switches for the automatic playing/recording systems 500/501 are provided on the manipulating panel 503 together with the switches and slot for the image producing system 403.

The automatic playing system 500 further includes solenoid-operated key actuators 510. The solenoid-operated key actuators 510 are respectively associated with the black/white keys 234, and mounted on the key bed 231. The solenoid-operated key actuators 510 are connected to a driver circuit incorporated in the controller 503, and a microprocessor of the controller 503 instructs the driver circuit to selectively energizes the coils of the solenoid-operated key actuators 510. Then, the plungers upwardly projects from the coils, and move the associated black/white keys 234 without fingering. A set of music data codes is transferred from a disc to a memory of the controller 503, and the microprocessor supplies instructions to the driver circuit at appropriate timings on the basis of the set of music data codes. The pianist can change the tempo or the loudness through the controller 503 in the playback.

The recording system 501 further includes key sensors 520 and hammer sensors 530. The key sensors 520 are provided under the black/white keys 234, respectively, and produce key position signals representative of current positions of the associated black/white keys 234. On the other hand, the hammer sensors 530 are respectively provided for the hammers 237, and produce hammer position signals representative of impact timings against the sets of strings. The key sensors 520 and the hammer sensors 530 are connected in parallel to an interface of the controller 502, and the microprocessor periodically checks the interface to see whether or not the black/white keys 234 and the hammers 237 change the current positions. Thus, the key motions and the hammer motions are reported to the microprocessor, and the microprocessor produces a set of music data codes representative of a performance on the keyboard 401.

In this instance, the image producing system 403 also serves as a prompter. A pianist asks the prompter how he tunes the equalizer or the split top board 420 and how he establishes the automatic player piano in the recording mode or the automatic playing mode. Further, the pianist requests the controller 503 to teach how he changes the tempo and the loudness in the playback. The controller 503 instructs the display driver to produce appropriate images and messages/comments on the visual display 441.

All the modifications for the sixth and seventh embodiments are applicable to the automatic player piano.

Ninth Embodiment

FIGS. 50, 51, 52, 53 and 54 show a keyboard musical instrument embodying the present invention. The keyboard musical instrument is categorized in one of the grand piano, the silent piano and the automatic player piano. Boards and parts are labeled with the references designating corresponding boards and parts of the grand piano implementing the sixth embodiment without detailed description.

An image producing system 600 is also incorporated in the keyboard musical instrument, and includes a visual display 601, which is independent of a music rack assembly 602. In this instance, the music rack assembly 602 is implemented by a desk board 603 and a ridge 604. The desk board 603 is hinged to the front cover board 25, and is tiltable. The ridge is fixed to the front cover board 225, and extends along the lower edge of the desk board 603. A document such as, for example, a music score stands against the desk board 603, and the ridge 604 prevents the document from slippage.

The visual display 601 is connected to a display stand 605, which is fixed to the front cover board 225. The display stand 605 allows a pianist to tilt the visual display 601 (see FIG. 53) and turn therearound (see FIG. 54). Thus, the visual display 601 is three-dimensionally moved with respect to the front cover board 225, and the pianist can regulate the visual display to an appropriate direction. Thus, the visual display 601 is independent of the music rack assembly 602, and, accordingly, the pianist directs the screen to him through the three-dimensional motion.

Though not shown in the figures, the control box 450 is attached to the back surface of the front cover board 225, and the controller 250/490/502 is embedded in the key bed 231. The manipulating board 251/491/503 is exposed to the pianist, and the controller 250/490/502 is connected to the manipulating board 251/491/503 and the control box 450. The image producing system of the keyboard musical instrument also serves as a prompter, and the controller 250/490/502 is responsive to the request from the pianist so as to produce images and comments/messages on the visual display 601. The images and the comments/messages may be similar to those described hereinbefore.

Although particular embodiments of the present invention have been shown and described, it will be apparent to those skilled in the art that various changes and modifications may be made without departing from the spirit and scope of the present invention.

For example, a split top board according to the present invention may have more than two sub-boards.

Another kind of visual display such as, for example, a plasma display is available for the keyboard musical instrument according to the present invention.

A touch panel may be produced on the screen of the visual display 283. In this instance, the manipulating panel 251 may be deleted from the controller 250. The music rack assembly 280 or the combination of the desk board and the visual display 330 may be provided for an upright piano.

The image producing system may be provided for a mute piano, which has a movable board attached to the wooden frame. The loudness of piano tones is varied in dependent on the position of the board. In this instance, the image producing system teaches the pianist how to move the board for changing the loudness. When the pianist wants to know how he decreases the loudness, the controller instructs the display driver to produce an image of the mute piano with the wooden frame covered with the board together with an appropriate message. On the other hand, when the pianist wants to know how he recovers the mute piano from the soft tones, the controller instructs the display driver to produce an image of the mute piano with the wooden frame uncovered with the board together with an appropriate message.

The image producing system may communicate with a pianist so as to obtain pieces of control data information such as, for example, the data information disclosed in U.S. Pat. Nos. 5,864,078 and 5,908,997.

The messages and the comments may be given through a speaker system or the headphone.

What is claimed is:

1. An acoustic keyboard musical instrument in the category of a grand piano comprising a housing having an upper opening, a front cover board turnable with respect to said housing and assigned a front part of said upper opening, plural music strings stretched inside of said housing and assigned notes of a scale, respectively, a sound board supported by said housing and extending under said plural music strings, a bass bridge mounted on said sound board and giving tension to the music strings serving as a part of said plural music strings and assigned to lower registered acoustic sounds, a treble bridge mounted on said sound board and giving tension to the music strings serving as another part of said plural music strings and assigned to other lower registered acoustic sounds and to higher registered acoustic sounds, a keyboard exposed to a player and having plural keys assigned said notes of said scale, respectively, plural vibration generating mechanisms respectively linked with said keys and selectively actuated by the associated keys manipulated by said player for producing acoustic sounds through vibrations of said associated music strings, and a split top board having plural sub-boards respectively assigned parts of said upper opening and independently changed between open positions where associated parts of said plural music strings are open to the ambience and closed positions where said associated parts are covered with the associated plural sub-boards.

2. The acoustic keyboard musical instrument as set forth in claim 1, in which said split top board has a front sub-board and a rear sub-board, and a split line between said front sub-board and said rear sub-board crosses said treble bridge at a boundary between said music strings assigned to said other lower registered acoustic sounds and said music strings assigned to said higher registered acoustic sounds.

3. The acoustic keyboard musical instrument as set forth in claim 2, in which a left part of said treble bridge from said boundary with respect to said player is curved in such a manner as to project toward said player.

4. The acoustic keyboard musical instrument as set forth in claim 1, in which said plural sub-boards have respective end portions rotatably connected to a side portion of said housing so that lid prop assemblies keep said plural sub-boards at angles with respect to said housing in said open positions.

5. The acoustic keyboard musical instrument as set forth in claim 4, in which the lengths of said lid prop assemblies are independently regulable so as to change said angles.

6. The acoustic keyboard musical instrument as set forth in claim 1, in which a music rack assembly is provided on said front cover board.

7. The acoustic keyboard musical instrument as set forth in claim 1, in which said plural sub-boards are supported by means of respective lifters each connected to both sides of associated one of said plural sub-boards, and said lifters are projectable from and retractable into the inside of said housing.

8. A keyboard musical instrument comprising:

a housing defining an inner space;

a keyboard supported by said housing, and including plural keys respectively assigned notes of a scale and selectively depressed by a player;

a sound generating system accommodated in said housing, and generating sounds having the notes identical with the notes assigned to the depressed keys;

a desk board supported by said housing, and keeping a document standing there against for providing a piece of information to said player; and an image producing system including a video display independent of and adjacent to the side of said desk board, supported by said housing and responsive to an image-carrying signal for producing visual images on a screen thereof and a controller responsive to instructions of said player for generating said image-carrying signal.

9. The keyboard musical instrument as set forth in claim 8, in which said visual display is slidable in a lateral direction of said housing.

10. The keyboard musical instrument as set forth in claim 9, in which said desk board is slidable in said lateral direction, and allows said visual display to be partially overlapped therewith.

11. The keyboard musical instrument as set forth in claim 8, in which said visual display further has a display stand three-dimensionally changing the attitude of said screen with respect to said housing.

12. The keyboard musical instrument as set forth in claim 8, in which said sound generating system includes hammer action mechanisms respectively associated with said keys and actuated by said depressed keys, plural music strings respectively associated with said keys and selectively vibrating for generating said sounds and hammers respectively associated with said hammer, selectively driven for rotation by the associated hammer action mechanisms actuated by said depressed keys, thereby striking the associated music strings, said keyboard musical instrument further comprising a top board rotatably supported by said housing and changing an attitude thereof for closing said sound generating system in said inner space and exposing said sound generating system through a rear part of an upper opening defined by said housing to an ambience depending upon said position and a front cover board rotatably supported by said housing and offering an upper surface when said front cover board closes a front part of said upper opening, said visual display and said desk board being independently connected to said upper surface.

13. The keyboard musical instrument as set forth in claim 12, in which said visual display further has a display stand three-dimensionally changing the attitude of said screen with respect to said front cover board.

14. The keyboard musical instrument as set forth in claim 8, in which said controller teaches how to use said keyboard musical instrument through said visual images.

15. An acoustic keyboard musical instrument comprising a housing having an upper opening, plural music strings stretched inside of said housing and assigned notes of a scale, respectively, a keyboard exposed to a player and having plural keys assigned said notes of said scale, respectively, plural vibration generating mechanisms respectively linked with said keys and selectively actuated by the associated keys manipulated by said player for producing acoustic sounds through vibrations of said associated music strings, a split top board having plural sub-boards respectively assigned parts of said upper opening and independently changed between open positions where associated parts of said plural music strings are open to the ambience and closed positions where said associated parts are covered with the associated sub-boards, and an information providing means supported by said housing and including a document stand directing a document to said player for providing a first piece of information and a visual display adjacent to said document stand and producing visual images on a screen thereof for providing a second piece of information together with said first piece of information.

16. The acoustic keyboard musical instrument as set forth in claim 15, in which said document stand is a part of a music rack assembly, and said visual display is embedded in another part of said music rack assembly.

17. The acoustic keyboard musical instrument as set forth in claim 15, in which said visual display is independent of said document stand.

18. The acoustic keyboard musical instrument as set forth in claim 17, in which said visual display is three-dimensionally movable with respect to said housing.

19. The acoustic keyboard musical instrument as set forth in claim 18, in which said visual display is provided on a front cover board laterally extending over a front part of an upper opening defined by said housing, and said document stand is rotatably supported by said front cover board.

20. The acoustic keyboard musical instrument as set forth in claim 15, each of said vibration generating mechanisms has a hammer action mechanism actuated by one of said plural keys and a hammer driven for rotation by said one of said plural keys for striking one of said plural music strings.

21. The acoustic keyboard musical instrument as set forth in claim 20, in which said document stand is a part of a music rack assembly, and said visual display is embedded in another part of said music rack assembly.

22. The acoustic keyboard musical instrument as set forth in claim 21, further comprising an electronic sound generating system responsive to a fingering on said keyboard for producing electronic sounds and a silent system changed between a free position and a blocking position, said hammer being allowed to strike said one of said plural music strings in said free position and rebounding on said silent system before striking said one of said plural music strings in said blocking position.

23. The acoustic keyboard musical instrument as set forth in claim 21, further comprising an automatic playing system having plural key actuators for selectively moving said plural keys without a fingering thereon.

24. The acoustic keyboard musical instrument as set forth in claim 20, in which said visual display is independent of said document stand.

25. The acoustic keyboard musical instrument as set forth in claim 24, in which said visual display is three-dimensionally movable with respect to said housing.

26. The acoustic keyboard musical instrument as set forth in claim 24, further comprising an electronic sound generating system responsive to a fingering on said keyboard for producing electronic sounds and a silent system changed between a free position and a blocking position, said hammer being allowed to strike said one of said plural music strings in said free position and rebounding on said silent system before striking said one of said plural music strings in said blocking position.

27. The acoustic keyboard musical instrument as set forth in claim 24, further comprising an automatic playing system having plural key actuators for selectively moving said plural keys without a fingering thereon.

28. The acoustic keyboard musical instrument as set forth in claim 15, in which said information providing means further has a controller for producing images on said visual display, and said controller teaches how to use said acoustic keyboard through said images.

29. The acoustic keyboard musical instrument as set forth in claim 28, in which said controller teaches how to selectively emphasize said acoustic sounds through said images.

* * * * *